US011998081B2

(12) United States Patent
Orand

(10) Patent No.: US 11,998,081 B2
(45) **Date of Patent: *Jun. 4, 2024**

(54) FOOT SUPPORT SYSTEMS INCLUDING TILTABLE FOREFOOT COMPONENTS

(71) Applicant: NIKE, Inc., Beaverton, OR (US)

(72) Inventor: Austin Orand, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/176,706

(22) Filed: Mar. 1, 2023

(65) Prior Publication Data

US 2023/0200488 A1 Jun. 29, 2023

Related U.S. Application Data

(63) Continuation of application No. 17/325,580, filed on May 20, 2021, now Pat. No. 11,617,412.

(Continued)

(51) Int. Cl.

*A43B 13/14* (2006.01)
*A43B 3/24* (2006.01)

(Continued)

(52) U.S. Cl.

CPC ..... *A43B 13/184* (2013.01); *A43B 3/246* (2013.01); *A43B 7/24* (2013.01); *A43B 13/141* (2013.01); *A43B 13/186* (2013.01); *A43B 13/28* (2013.01)

(58) Field of Classification Search

CPC ..... A43B 7/24; A43B 13/14; A43B 13/141

(Continued)

(56) References Cited

U.S. PATENT DOCUMENTS 5,224,810 A 7/1993 Pitkin
5,345,701 A 9/1994 Smith (Continued)

FOREIGN PATENT DOCUMENTS

EP 0815756 B1 3/2002
EP 1958527 B1 1/2016

(Continued)

OTHER PUBLICATIONS

"I tried to wear a Donkey's leather shoes", Gigazine, gigazine.net Mar. 13, 2017, https://web.archive.org/web/20170313021351/https://gigazine.net/news/20170312-donki-slide-sole-change/Discloses a shoe sole having aremovable heel portion which slides along rails (translated).

(Continued)

*Primary Examiner* — Marie D Bays
(74) *Attorney, Agent, or Firm* — Banner & Witcoff, Ltd.

(57) ABSTRACT

Sole structures, foot support systems, articles of footwear, and/or other foot-receiving devices include: (a) a first footwear component having a ground-facing surface, wherein a forefoot portion of the ground-facing surface includes arched medial and lateral surfaces and (b) a second footwear component having an upper-facing surface, wherein a forefoot portion of the upper-facing surface includes arched medial and lateral surfaces that face (and optionally contact) the respective arched medial and lateral surfaces of the first footwear component. The first and second footwear components are movably engaged together such that: (a) the arched medial surface of the first footwear component moves with respect to and along the arched medial surface of the second footwear component and (b) the arched lateral surface of the first footwear component moves with respect to and along the arched lateral surface of the second footwear component.

20 Claims, 31 Drawing Sheets

Related U.S. Application Data

(60) Provisional application No. 63/028,305, filed on May 21, 2020.

(51) Int. Cl.
*A43B 7/24* (2006.01)
*A43B 13/18* (2006.01)
*A43B 13/28* (2006.01)

(58) Field of Classification Search
USPC ..... 36/142–144, 31
See application file for complete search history.

(56) References Cited

U.S. PATENT DOCUMENTS

| | | | |
|---|---|---|---|
| 5,353,522 | A | 10/1994 | Wagner |
| 5,392,537 | A | 2/1995 | Goldberg |
| 5,682,689 | A | 11/1997 | Walker et al. |
| 5,867,923 | A | 2/1999 | Lehneis |
| 5,881,478 | A | 3/1999 | McMahon et al. |
| 5,921,009 | A | 7/1999 | Hice |
| 6,115,943 | A | 9/2000 | Gyr |
| D443,974 | S | 6/2001 | Schelling |
| 6,550,160 | B2 | 4/2003 | Miller, II |
| 6,829,848 | B2 | 12/2004 | Gallegos |
| 7,254,905 | B2 | 8/2007 | Dennison |
| 7,377,055 | B2 | 5/2008 | Bramani |
| 7,578,077 | B2 | 8/2009 | Marc |
| 7,596,888 | B2 | 10/2009 | Meschan et al. |
| 7,654,014 | B1 | 2/2010 | Moore et al. |
| 8,141,276 | B2 | 3/2012 | Ellis |
| 8,291,618 | B2 | 10/2012 | Ellis |
| 9,226,545 | B2 | 1/2016 | Peyton et al. |
| 9,445,643 | B2 | 9/2016 | Amos et al. |
| 9,820,531 | B2 | 11/2017 | Walker et al. |
| 10,123,586 | B2 | 11/2018 | Meschter |
| 10,226,102 | B2 | 3/2019 | Santos et al. |
| 11,445,784 | B2 | 9/2022 | Brown et al. |
| 11,617,412 | B2 * | 4/2023 | Orand ..... A43B 13/184 36/29 |
| 2005/0246923 | A1 | 11/2005 | Bergamin |
| 2008/0016719 | A1 | 1/2008 | Aveni et al. |
| 2008/0022562 | A1 | 1/2008 | Manis |
| 2008/0222920 | A1 | 9/2008 | Rovida |
| 2010/0281716 | A1 | 11/2010 | Luthi et al. |
| 2012/0198720 | A1 | 8/2012 | Farris et al. |
| 2014/0041256 | A1 | 2/2014 | Espinola |
| 2017/0049183 | A1 | 2/2017 | Foxen |
| 2019/0261737 | A1 | 8/2019 | Walsh et al. |
| 2020/0093220 | A1 | 3/2020 | Oda |

FOREIGN PATENT DOCUMENTS

| | | | |
|---|---|---|---|
| EP | 2984956 | A1 | 2/2016 |
| WO | 2014193078 | A1 | 12/2014 |
| WO | 2019172760 | A1 | 9/2019 |

OTHER PUBLICATIONS

"Nike Convert 1.O", Climate Colab, climatecolab.org, Jun. 11, 2016, https://web.archive.org/web/20160611110604/https://www.climatecolab.org/contests/2016/materials-matter/c/proposal/1331584/ Discloses an athletic shoe with replaceablesole elements.

Aug. 9, 2021—(WO) ISR & WO—App. No. PCT/US21/033530.

* cited by examiner

FOOT SUPPORT SYSTEMS INCLUDING TILTABLE FOREFOOT COMPONENTS

RELATED APPLICATION DATA

This application (a) is a continuation of U.S. patent application Ser. No. 17/325,580, filed May 20, 2021, which application (b) claims priority benefits to and is a U.S. Non-Provisional patent application based on U.S. Provisional Patent Application Ser. No. 63/028,305 filed May 21, 2020. Each of U.S. patent application Ser. No. 17/325,580 and U.S. Provisional patent application. Ser. No. 63/028,305 is entirely incorporated herein by reference.

FIELD OF THE INVENTION

The present invention relates to foot support systems in the field of footwear or other foot-receiving devices. At least some aspects of the present invention pertain to sole structures, foot support systems, articles of footwear, and/or other foot-receiving devices that include a footwear component that slides, rotates, or tilts with respect to another footwear component about an axis arranged in a generally horizontal and longitudinal direction of the sole structure, foot support system, article of footwear, and/or other foot-receiving device. In some examples of such structures, at least a lateral side of the sole structure, article of footwear, and/or other foot-receiving device may slide, tilt, or rotate upward as the wearer applies force (e.g., a downward and outward force) to a contact surface beneath his/her medial forefoot.

BACKGROUND

Conventional articles of athletic footwear include two primary elements, an upper and a sole structure. The upper may provide a covering for the foot that securely receives and positions the foot with respect to the sole structure. In addition, the upper may have a configuration that protects the foot and provides ventilation, thereby cooling the foot and removing perspiration. The sole structure may be secured to a lower surface of the upper and generally is positioned between the foot and any contact surface. In addition to attenuating ground reaction forces and absorbing energy, the sole structure may provide traction and control potentially harmful foot motion, such as over pronation.

The upper forms a void on the interior of the footwear for receiving the foot. The void has the general shape of the foot, and access to the void is provided at an ankle opening. Accordingly, the upper extends over the instep and toe areas of the foot, along the medial and lateral sides of the foot, and around the heel area of the foot. A lacing system often is incorporated into the upper to allow users to selectively change the size of the ankle opening and to permit the user to modify certain dimensions of the upper, particularly girth, to accommodate feet with varying proportions. In addition, the upper may include a tongue that extends under the lacing system to enhance the comfort of the footwear (e.g., to modulate pressure applied to the foot by the laces). The upper also may include a heel counter to limit or control movement of the heel.

"Footwear," as that term is used herein, means any type of wearing apparel for the feet, and this term includes, but is not limited to: all types of shoes, boots, sneakers, sandals, thongs, flip-flops, mules, scuffs, slippers, sport-specific shoes (such as golf shoes, tennis shoes, baseball cleats, soccer or football cleats, ski boots, track spikes, basketball shoes, cross training shoes, etc.), and the like. "Foot-receiving device," as that term is used herein, means any device into which a user places at least some portion of his or her foot. In addition to all types of "footwear," foot-receiving devices include, but are not limited to: bindings and other devices for securing feet in snow skis, cross country skis, water skis, snowboards, and the like; bindings, clips, or other devices for securing feet in pedals for use with bicycles, exercise equipment, and the like; bindings, clips, or other devices for receiving feet during play of video games or other games; and the like. "Foot-receiving devices" may include one or more "foot-covering members" (e.g., akin to footwear upper components), which help position the foot with respect to other components or structures, and one or more "foot-supporting members" (e.g., akin to footwear sole structure components), which support at least some portion(s) of a plantar surface of a user's foot. "Foot-supporting members" may include components for and/or functioning as midsoles and/or outsoles for articles of footwear (or components providing corresponding functions in non-footwear type foot-receiving devices).

SUMMARY

This Summary is provided to introduce some general concepts relating to this technology in a simplified form that are further described below in the Detailed Description. This Summary is not intended to identify key features or essential features of the invention.

Aspects of this technology relate to sole structures, foot support systems, articles of footwear, and/or other foot-receiving devices, e.g., of the types described and/or claimed below and/or of the types illustrated in the appended drawings. Such sole structures, foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

More specific aspects of this technology relate to sole structures, foot support systems, articles of footwear, and/or other foot-receiving devices that include a forefoot footwear (e.g., a sole) component that slides, rotates, or tilts with respect to another footwear component, e.g., about an axis arranged in a generally horizontal and generally longitudinal direction of the sole structure, foot support system, article of footwear, and/or other foot-receiving device. In some examples of such structures, at least a lateral side of the sole structure, article of footwear, and/or other foot-receiving device may slide, tilt, and/or rotate upward as the wearer applies force (e.g., a downward and outward force) to a contact surface beneath his/her medial forefoot (e.g., a downward and outward force applied by a first metatarsal head region of a wearer's foot).

While aspects of this technology are described in terms of foot support systems and articles of footwear including them, additional aspects of this technology relate to methods of making such foot support systems and/or articles of footwear and/or methods of using such foot support systems and/or articles of footwear.

BRIEF DESCRIPTION OF THE DRAWINGS

The foregoing Summary, as well as the following Detailed Description, will be better understood when considered in conjunction with the accompanying drawings in which like reference numerals refer to the same or similar elements in all of the various views in which that reference number appears.

DETAILED DESCRIPTION

In the following description of various examples of footwear structures and components according to the present technology, reference is made to the accompanying drawings, which form a part hereof, and in which are shown by way of illustration various example structures and environments in which aspects of the technology may be practiced. It is to be understood that other structures and environments may be utilized and that structural and functional modifications may be made to the specifically described structures, functions, and methods without departing from the scope of the present disclosure.

Figure 1A:
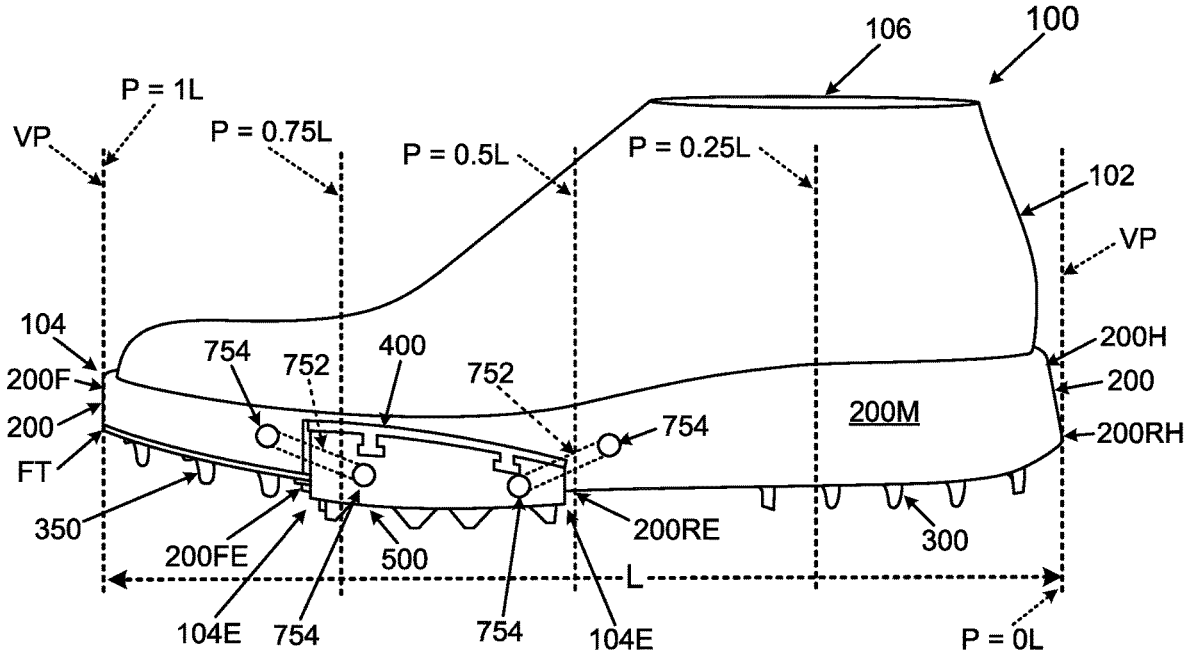
FIGS. 1A-1D provide various views of an article of footwear according to one example of this technology.
Figure 1B:
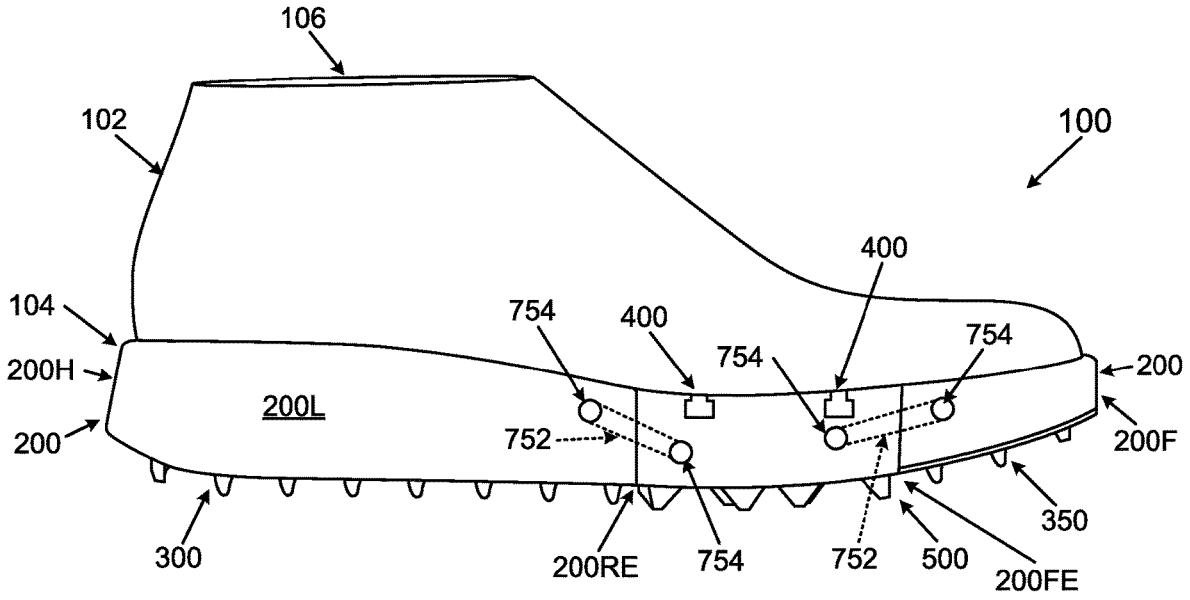
Figure 1C:
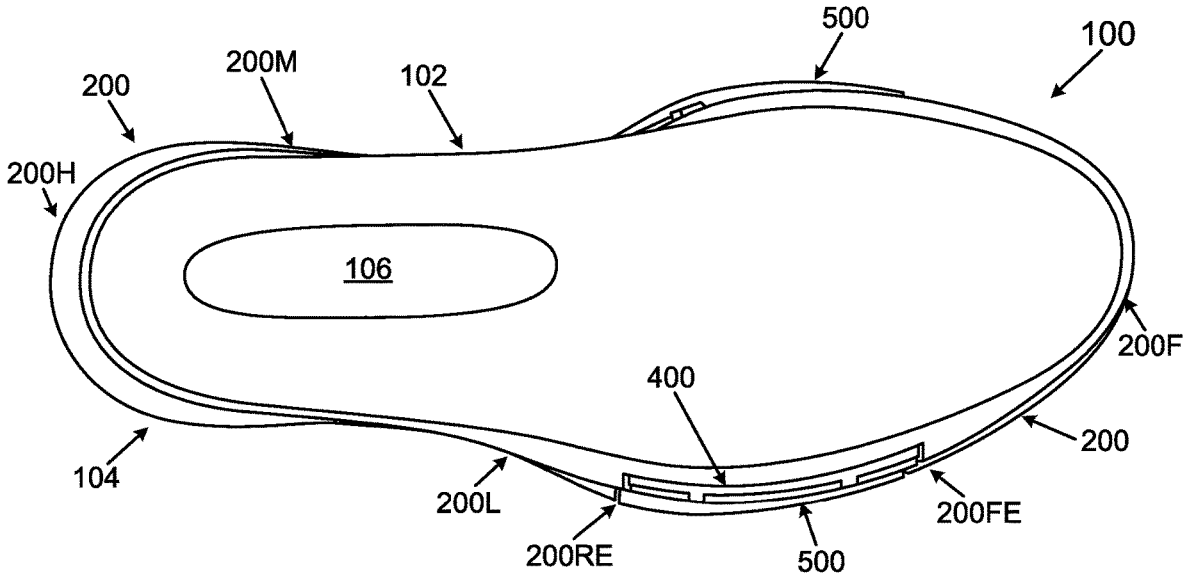
Figure 1D:
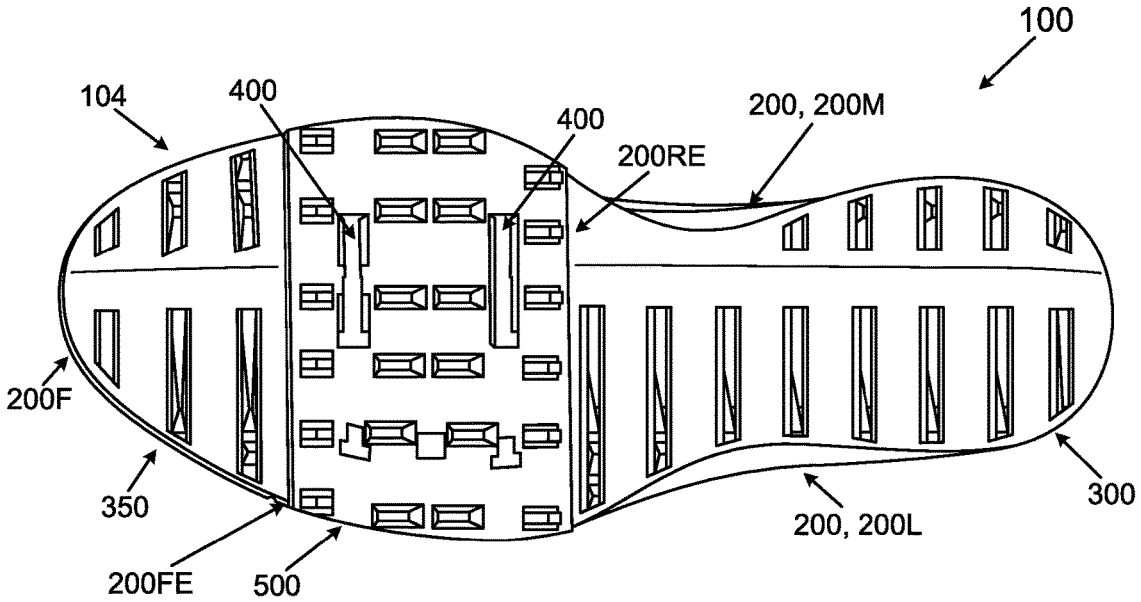

Various structures and parameters of articles of footwear and sole structures thereof are described in this specification based on a sole "length" or article of footwear "length" parameter L. See FIG. 1A. These lengths L can be found with the article of footwear and/or sole structure oriented on a horizontal support surface S on its ground-facing surface in an unloaded condition (e.g., with no weight applied to it other than weight of other components of the article of footwear and/or sole structure). Once so oriented, parallel vertical planes VP perpendicular to the horizontal support surface S are oriented to contact the rearmost heel (RH) location(s) and forwardmost toe (FT) location(s) of the relevant part (e.g., the article of footwear and/or sole structure). The parallel vertical planes VP should be oriented facing one another (e.g., extending into and out of the page of FIG. 1A) and as far away from one another as possible while still in contact with the rearmost heel RH and forwardmost toe FT locations. The direct distance between these vertical parallel planes VPs corresponds to the length (e.g., a longitudinal length) L of the article of footwear and/or sole structure. The locations of various footwear components or features are described in this specification based on their respective locations along the length L as measured forward from the rear heel vertical plane VP. The rearmost heel location(s) is (are) located at position 0 L and the forwardmost toe location(s) is (are) located at position 1 L along the length L. Intermediate locations along the length L are referred to by fractional locations (e.g., 0.5 L, 0.75 L) along the length L measured forward from the rear heel vertical plane VP. The term "parallel planes" as used herein are planes oriented parallel to the vertical planes VP. These parallel planes may intersect the longitudinal length L or longitudinal direction somewhere between P=0 L and P=1.0 L to identify the locations of various features. Note FIG. 1A, which includes parallel plane location designators at 0.25 L, 0.5 L, and 0.75 L.

This specification refers to "means for movably engaging" two footwear components together. In some instances, this "means for movably engaging" will include at least one "track" engaged within at least one "channel." These terms are used herein (unless otherwise noted or clear from the context) such that a "track" includes at least one male member portion that extends into and engages at least one female portion provided in a corresponding "channel." A "track" may constitute a structure akin to a train track or rail. A "channel" may constitute a recess or groove into which at least some portion of a "track" extends, and the track may be movably engaged with respect to the channel. Channels may extend partially and/or completely through the component in which they are formed and/or may be provided as a gap between two components into which the track is fit. Tracks and channels may form portions of tongue and groove joints, dovetail joints, T-joints, C-joints, and other types of slidable joints.

Means for movably engaging parts together also may include retaining elements, which may constitute separate parts or parts of another footwear component, that at least partially help hold the relatively movable parts together (e.g., to secure a track within a channel). In some examples, the "retaining element" may constitute a part or characteristic of the component(s) forming the track and/or channel and/or a part or characteristic of the track and/or channel itself (e.g., their shape(s) when formed as a dovetail joint, a tongue and groove joint, T-joint, C-joint, etc.). In some examples, the "retaining element" may constitute a separate footwear part or component from the component(s) forming the track and/or groove and/or it may be a separate part or component engaged with one or both component(s) forming the track and/or groove.

Other structures for providing the "means for movably engaging" may be provided as well. Such structures may include, for example, one or more roller structures (e.g., balls, cylinders, etc.) located within channel(s) provided in two adjacent footwear components (so that one footwear component moves with respect to the other footwear component due to motion of the roller structure(s)).

Also, the term "slide/tilt/rotate" or variations thereof are used in this specification to describe relative motion of the noted footwear component parts (e.g., movement of the top footwear component part or portion with respect to the bottom footwear component part or portion). This term, as used herein, is intended to mean related motion that includes any one or more of sliding, tilting, and/or rotation.

I. General Description of Aspects of this Technology

As noted above, aspects of this technology relate to sole structures, foot support systems, articles of footwear, and/or other foot-receiving devices, e.g., of the types described and/or claimed below and/or of the types illustrated in the appended drawings. Such sole structures, foot support systems, articles of footwear, and/or other foot-receiving devices may include any one or more structures, parts, features, properties, and/or combination(s) of structures, parts, features, and/or properties of the examples described and/or claimed below and/or of the examples illustrated in the appended drawings.

Some more specific aspects or examples of this technology relate to sole structures and/or articles of footwear that include:

(a) a first footwear component including a ground-facing surface, wherein a forefoot portion of the ground-facing surface includes: (i) an arched medial surface arching downward from a medial side edge of the sole structure toward a central region of the first footwear component, and (ii) an arched lateral surface arching downward from a lateral side edge of the sole structure toward the central region of the first footwear component, wherein the first footwear component includes one of a first track or a first channel; and (b) a second footwear component including an upper-facing surface, wherein a forefoot portion of the upper-facing surface includes: (i) an arched medial surface arching downward from a medial side edge of the second footwear component toward a central region of the second footwear component and facing the arched medial surface of the first footwear component, and (ii) an arched lateral surface arching downward from a lateral side edge of the second footwear component toward the central region of the second footwear component and facing the arched lateral surface of the first footwear component, wherein the second footwear component includes the other of the first track or the first channel (e.g., one not included in the first footwear component).

In such structures, the first track is engaged with the first channel, and the first footwear component is movably engaged with the second footwear component by movement of the first track with respect to the first channel.

Other aspects or examples of this technology relate to sole structures and/or articles of footwear that include:

(a) a first footwear component including a ground-facing surface, wherein a forefoot portion of the ground-facing surface includes: (i) an arched medial surface arching downward from a medial side edge of the sole structure toward a central region of the first footwear component, and (ii) an arched lateral surface arching downward from a lateral side edge of the sole structure toward the central region of the first footwear component;

(b) a second footwear component including an upper-facing surface, wherein a forefoot portion of the upper-facing surface includes: (i) an arched medial surface arching downward from a medial side edge of the second footwear component toward a central region of the second footwear component and facing the arched medial surface of the first footwear component, and (ii) an arched lateral surface arching downward from a lateral side edge of the second footwear component toward the central region of the second footwear component and facing the arched lateral surface of the first footwear component; and (c) means for movably engaging the first footwear component with the second footwear component such that: (i) the arched medial surface of the first footwear component moves with respect to and along the arched medial surface of the second footwear component and (ii) the arched lateral surface of the first footwear component moves with respect to and along the arched lateral surface of the second footwear component.

Sole structures and/or articles of footwear according to any of these aspects or examples of this technology may include one or more of the following properties: (a) the arched medial surface of the first footwear component includes an axial direction extending in a heel-to-toe direction of the article of footwear; (b) the arched medial surface of the second footwear component includes an axial direction extending in the heel-to-toe direction of the article of footwear; (c) the arched lateral surface of the first footwear component includes an axial direction extending in the heel-to-toe direction of the article of footwear; and/or (d) the arched lateral surface of the second footwear component includes an axial direction extending in the heel-to-toe direction of the article of footwear. Additionally or alternatively, the means for movably engaging the first footwear component with the second footwear component and/or the first footwear component and the second footwear component may be movably engaged by structures that enable slide, tilt, or rotation of the first footwear component with respect to the second footwear component about an axis extending in a heel-to-toe direction and/or a generally horizontal direction of the sole structure and/or article of footwear. As still additional examples or alternatives, the means for movably engaging the first footwear component with the second footwear component and/or the first footwear component and the second footwear component may be movably engaged by structures that enable: (a) sliding of the arched medial surface of the first footwear component with respect to and/or along the arched medial surface of the second footwear component and (b) sliding of the arched lateral surface of the first footwear component with respect to and/or along the arched lateral surface of the second footwear component.

Given the general description of features, examples, aspects, structures, processes, and arrangements according to certain examples of the technology provided above, a more detailed description of specific example foot support structures, articles of footwear, and methods in accordance with this technology follows.

Figure 2A:
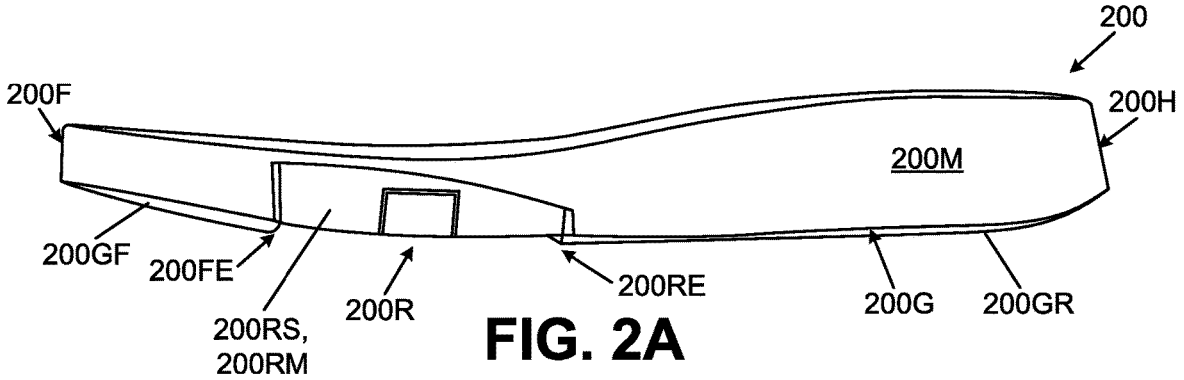
FIGS. 2A-2F provide various views of a main sole component (e.g., a midsole component) included in the article of footwear of FIGS. 1A-1D.
Figure 2B:
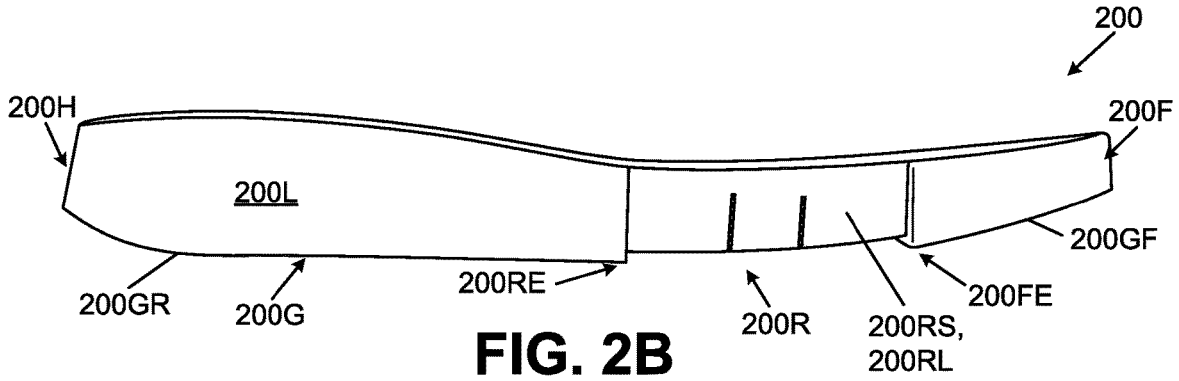
Figure 2C:
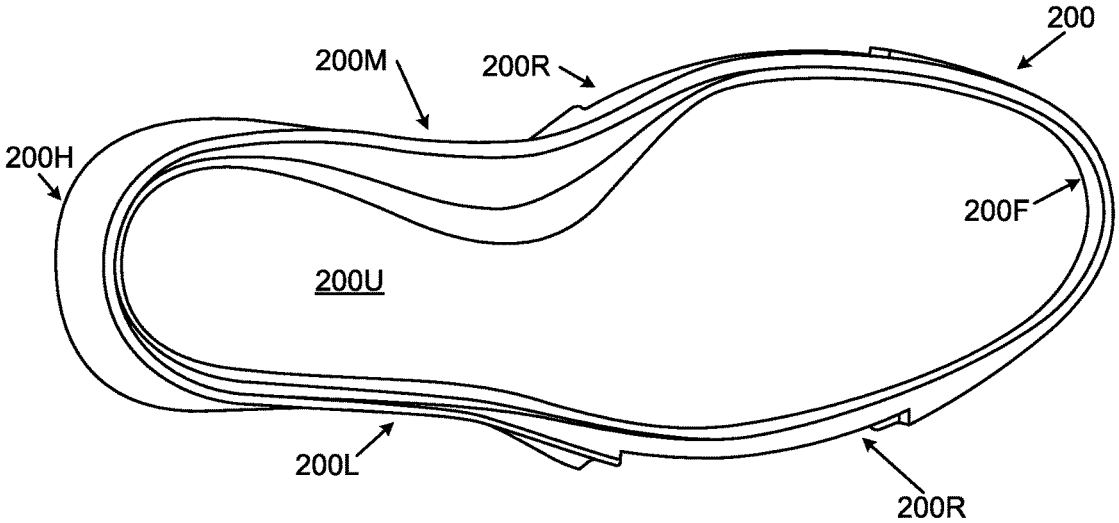
Figure 2D:
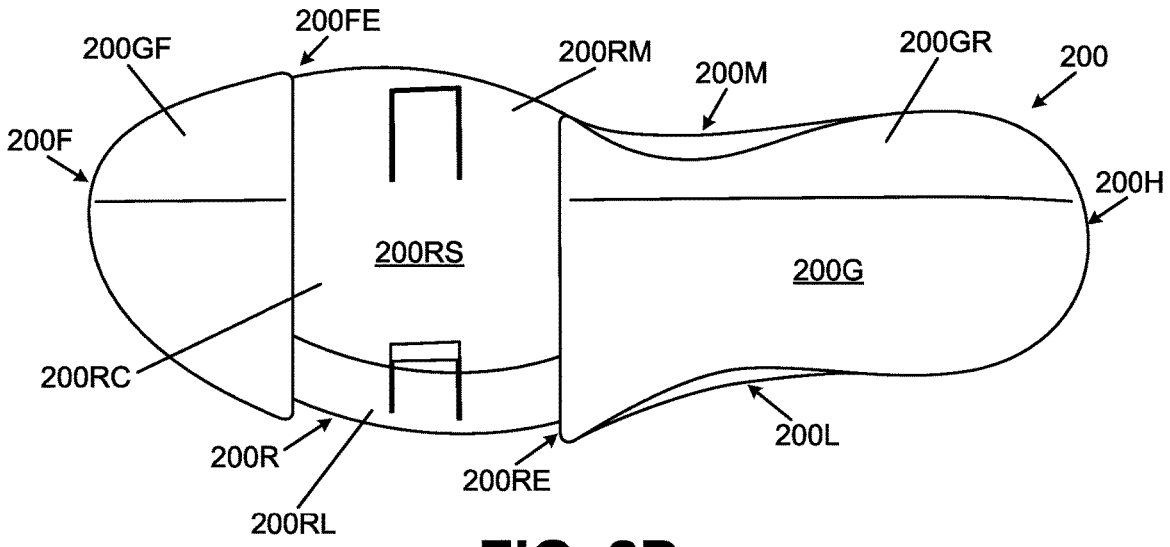
Figure 2E:
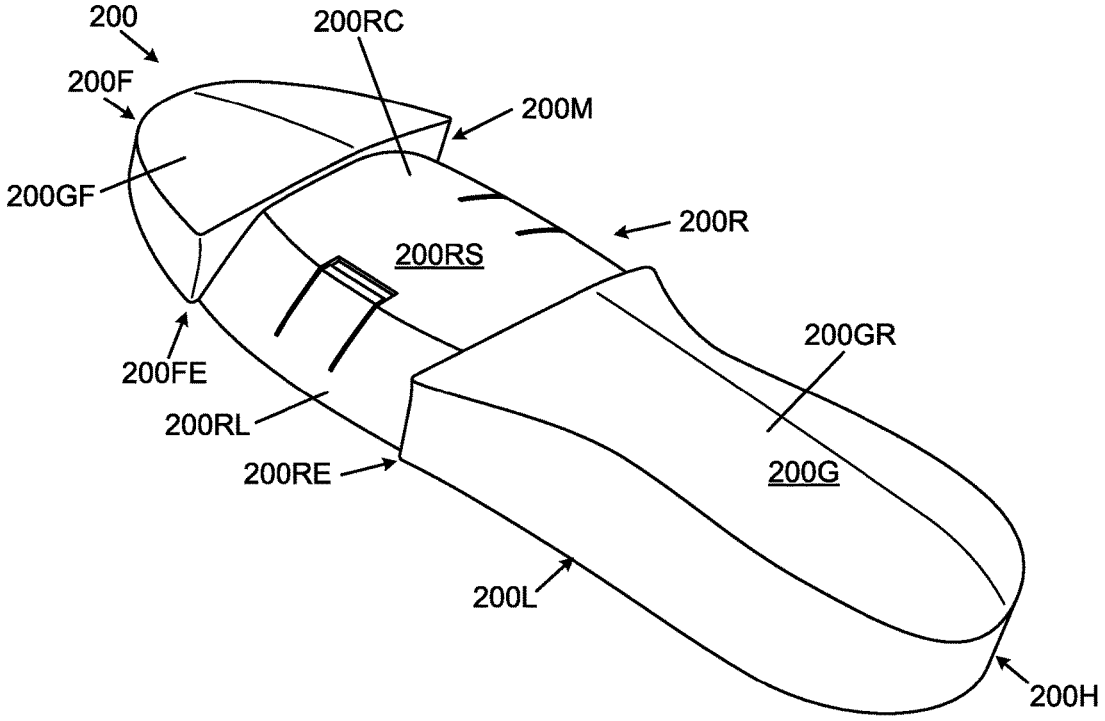
Figure 2F:
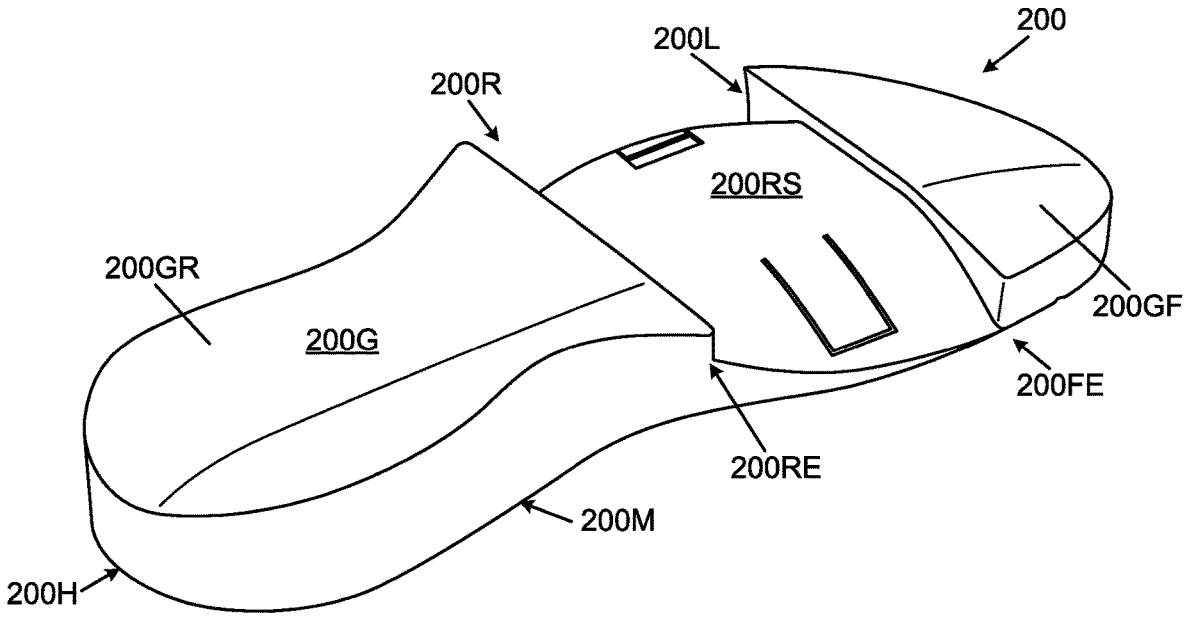
Figure 3A:
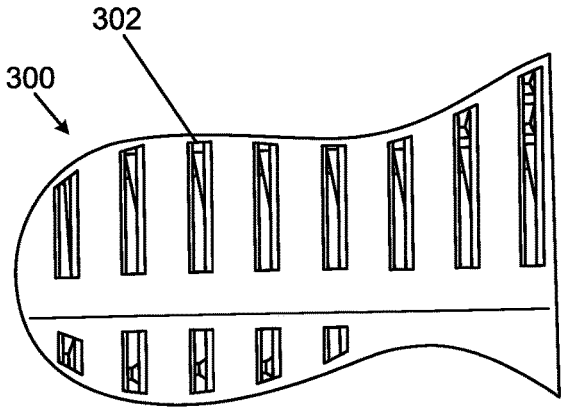
FIGS. 3A and 3B illustrate rear and forward outsole components, respectively, included in the article of footwear of FIGS. 1A-1D.
Figure 3B:
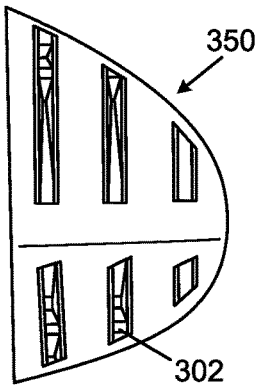
Figure 4A:
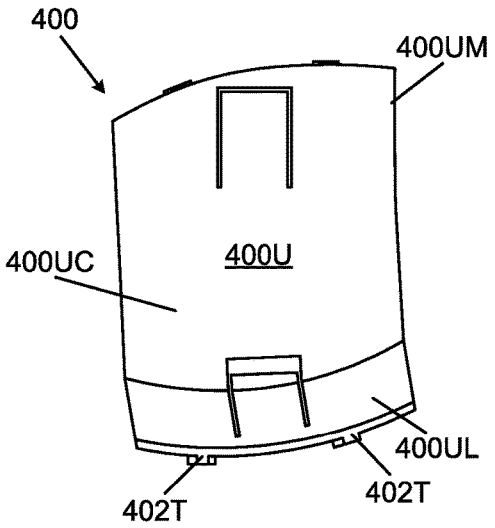
FIGS. 4A-4D provide various views of a top footwear component that provides relative movement features included in the article of footwear of FIGS. 1A-1D.
Figure 4B:
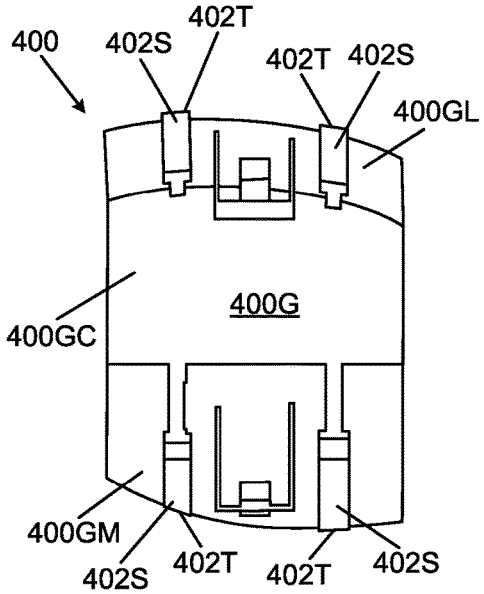
Figure 4C:
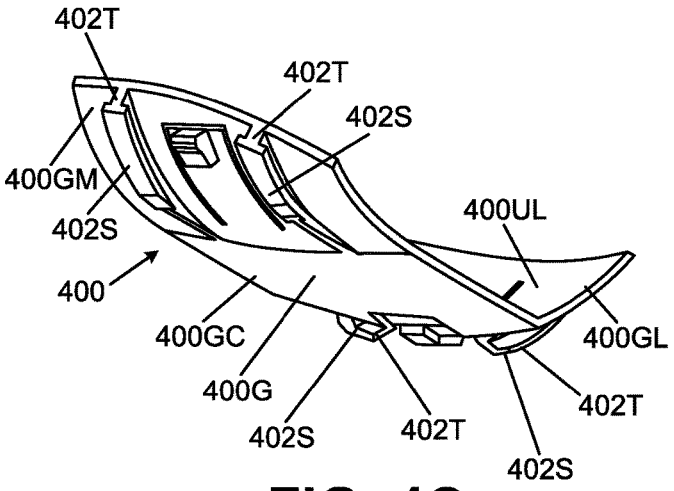
Figure 4D:
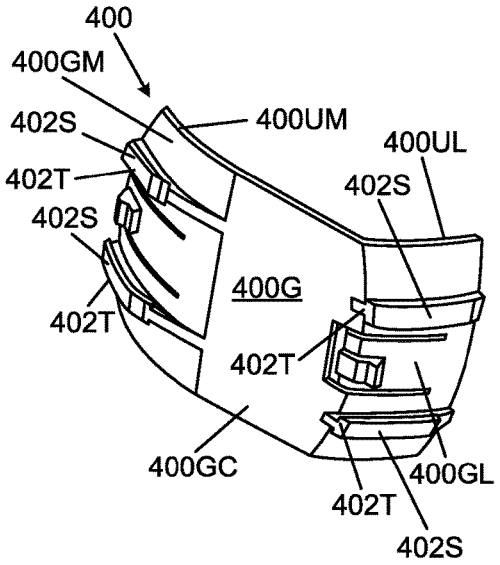
Figure 5A:
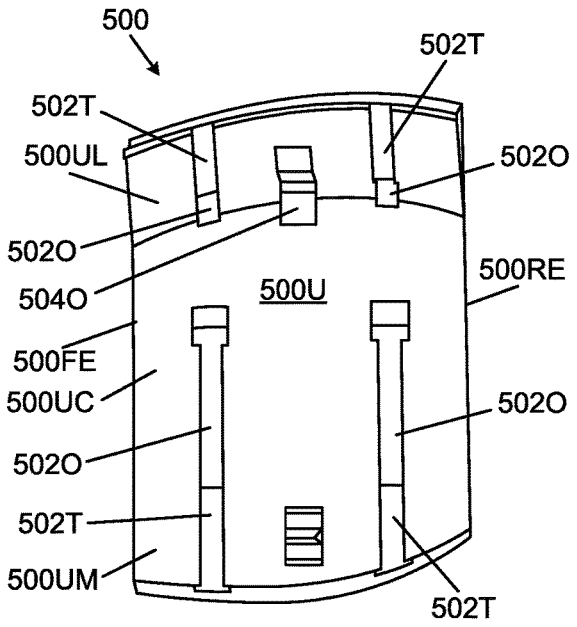
FIGS. 5A-5D provide various views of a bottom footwear component that provides relative movement features included in the article of footwear of FIGS. 1A-1D.
Figure 5B:
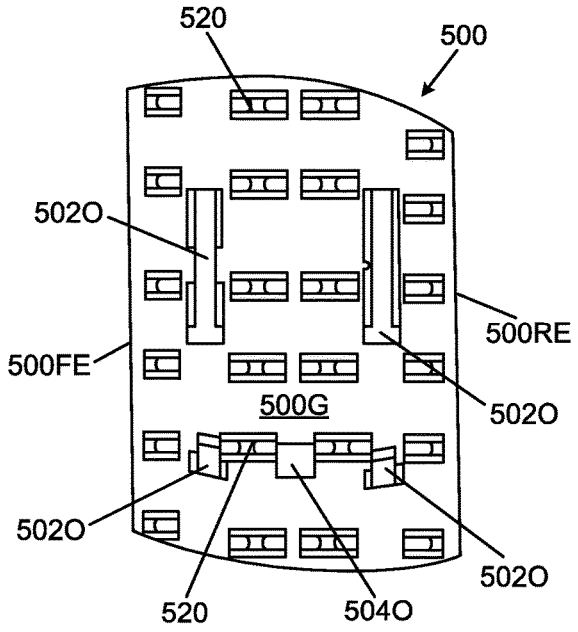
Figure 5C:
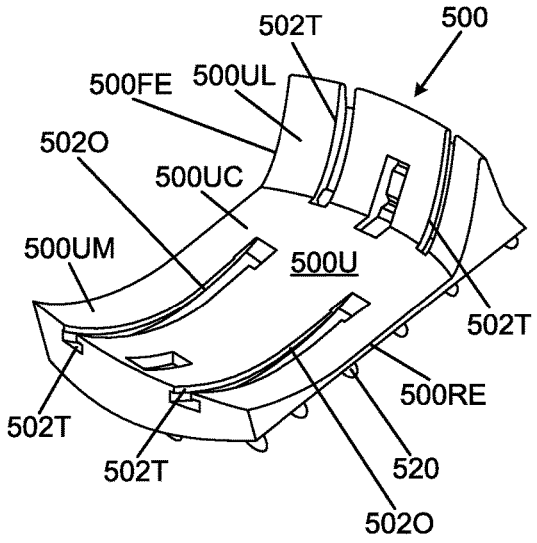
Figure 5D:
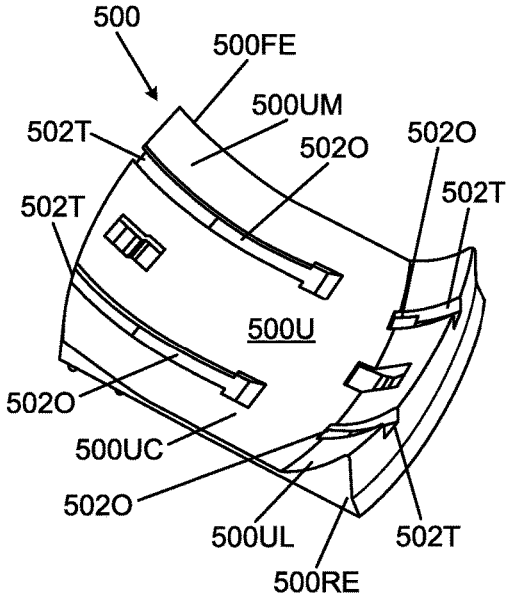
Figure 6A:
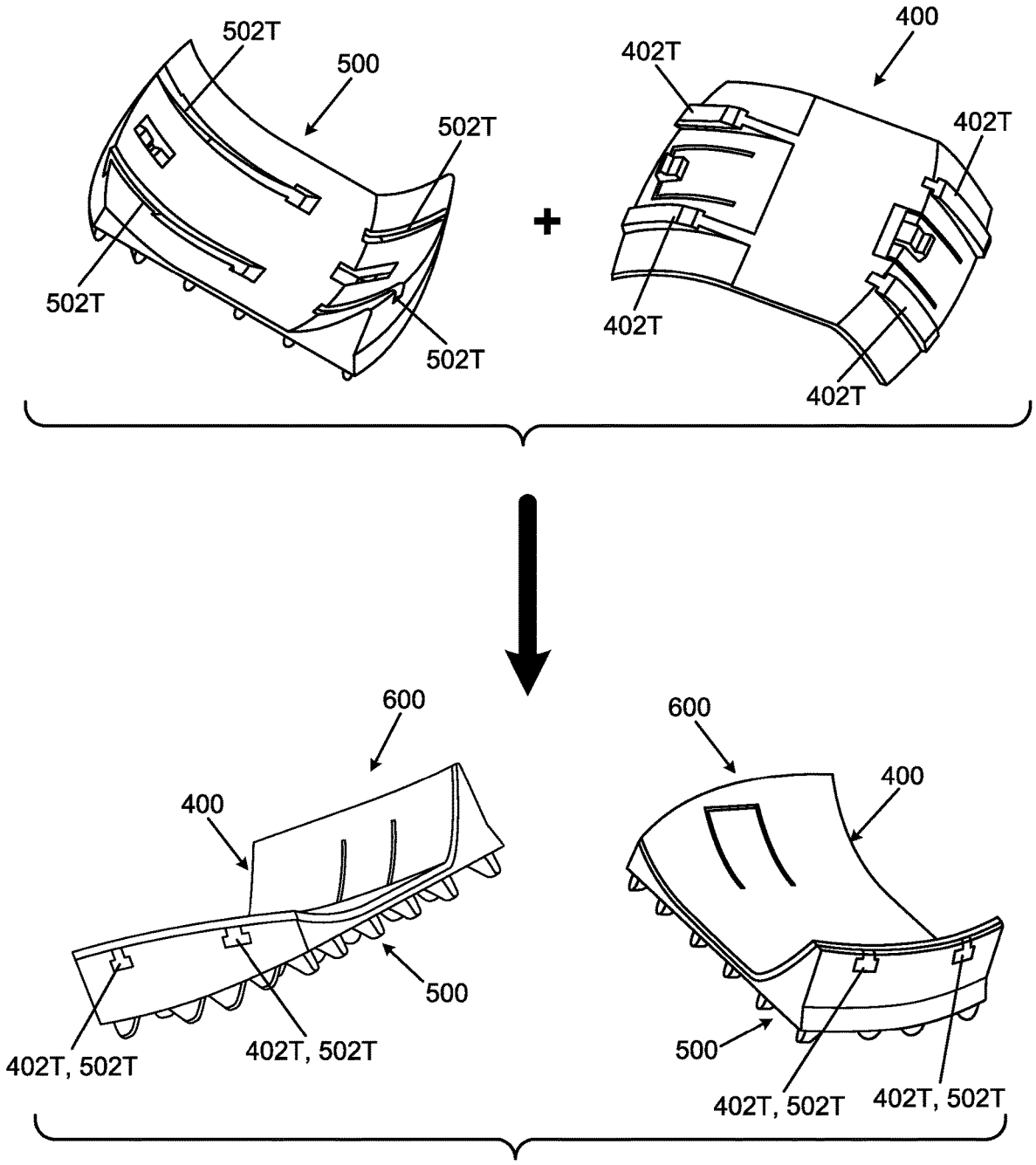
FIGS. 6A-6C illustrate assembly of the sole structure of the article of footwear of FIGS. 1A-1D.
Figure 6B:
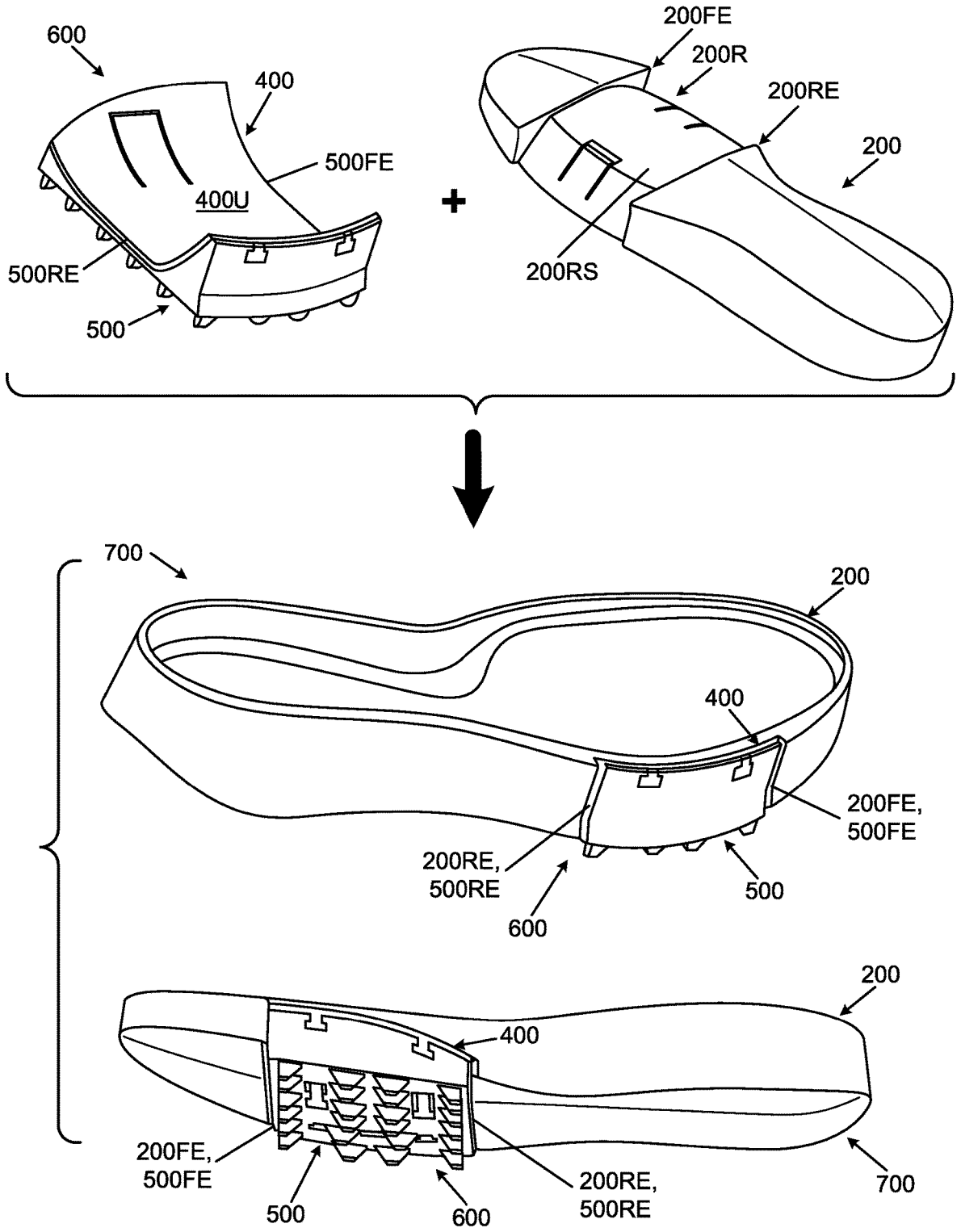
Figure 6C:
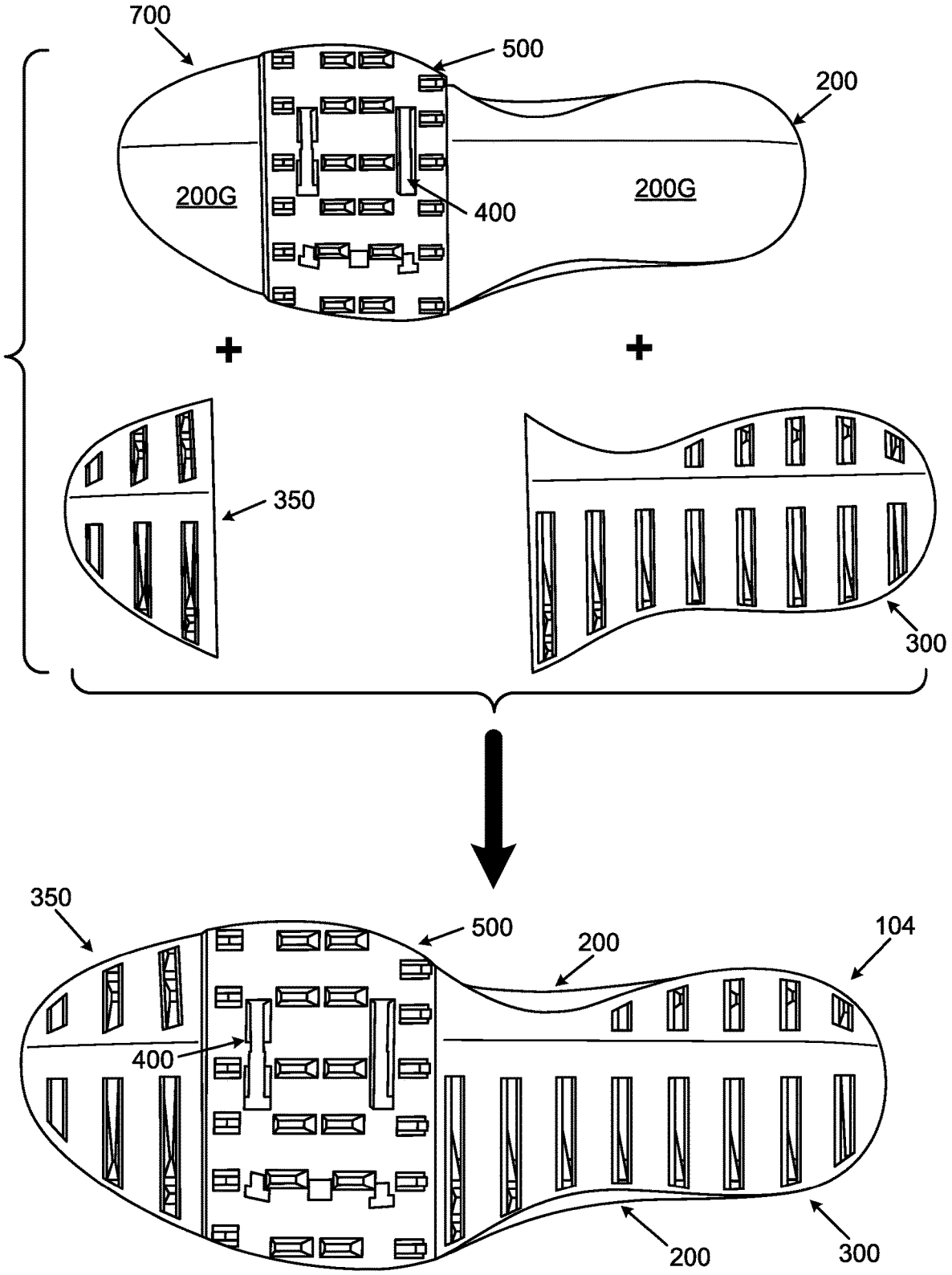
Figure 7:
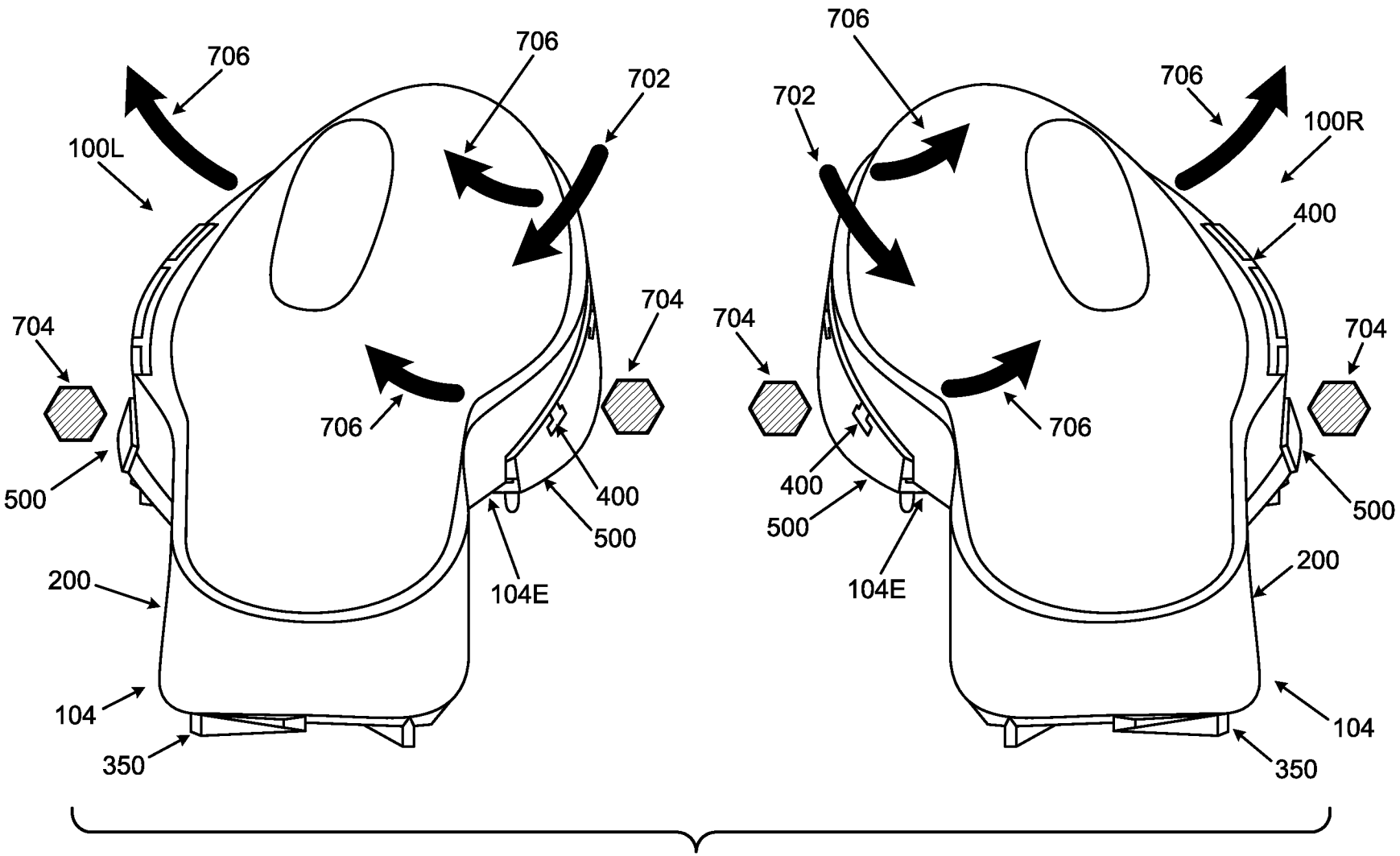
FIG. 7 illustrates features of potential movement of the article of footwear of FIGS. 1A-1D.

II. Detailed Description of Example Articles of Footwear, Foot Support Systems, and Other Components/Features According to this Technology FIGS. 1A-1D provide medial side, lateral side, top, and bottom views, respectively, of an example article of footwear 100 in accordance with some examples of this technology. Various views of the main midsole component 200 of this example article of footwear 100 are shown in FIG. 2A (a medial side view), FIG. 2B (a lateral side view), FIG. 2C (a top view), FIG. 2D (a bottom view), FIG. 2E (a rear, bottom, lateral perspective view), and FIG. 2F (a rear, bottom, medial perspective view). FIGS. 3A and 3B provide bottom views of outsole components 300, 350 of the example article of footwear 100 shown in FIGS. 1A-1D. FIG. 4A provides a top view of one footwear component 400 (also referred to as a "first footwear component," "first component," or "top component" herein) that provides the desired tilt/rotational/sliding action, and FIGS. 4B, 4C, and 4D provide a bottom view; a bottom, rear, medial perspective view; and a bottom, rear, lateral perspective view, respectively of first footwear component 400. FIG. 5A provides a top view of another footwear component 500 (also referred to as a "second footwear component," "second component," or "bottom component" herein) that provides the desired tilt/rotational/sliding action, and FIGS. 5B, 5C, and 5D provide a bottom view; a top, rear, medial perspective view; and a top, rear, lateral perspective view, respectively, of second footwear component 500. FIGS. 6A-6C illustrate assembly of sole structure 104 of article of footwear 100, and FIG. 7 illustrates aspects of the relative motion provided by sole structures 104 and/or articles of footwear 100 of this type. While the specific example shown in FIGS. 1A-7 constitutes a sole structure for a golf shoe, those skilled in the art, given the benefit of this disclosure, will recognize that aspects of this article of footwear 100 and/or sole structure 104 may be used in other types of footwear as well.

The article of footwear 100 of FIGS. 1A-1D includes an upper 102 and a sole structure 104 engaged with the upper 102. The upper 102 and sole structure 104 may be engaged together in any desired manner, including in manners conventionally known and used in the footwear arts (such as by one or more of adhesives or cements, stitching or sewing, mechanical connectors, etc.), provided at least some of the disclosed relative motion activities in accordance with aspects of this technology can be carried out.

The upper 102 (which may be formed from one or more parts), potentially together with the sole structure 104, defines a foot-receiving interior chamber 106 for containing a wearer's foot. The bottom of the upper 102 may include a strobel or other component engaged with or integrally formed with another portion of the upper 102. The upper 102 may include other components as well. For example, the upper 102 may include a tongue member located across the foot instep area and positioned to moderate the feel of the footwear's closure system on the wearer's foot; a closure system (e.g., including one or more of a lace type closure system, a zippered closure system, a buckle type closure system, elastic stretch elements, etc.); a heel counter; a toe cap; securing straps; etc. Additionally or alternatively, the upper 102 may include a "sock-like" upper component, e.g., made from fabric and configured to closely fit the wearer's foot like a conventional sock.

The upper 102 may be made from any desired material(s) and/or in any desired constructions and/or manners without departing from this technology. As some more specific examples, all or at least a portion of the upper 102 (and optionally a majority, substantially all, or even all of the upper 102) may be formed as a woven textile component, a knitted textile component, another textile component, a natural leather component, a synthetic leather component, a polymeric component (e.g., a TPU, etc.), etc. The components for upper 102 may have structures and/or constructions like those used in footwear products commercially available from NIKE, Inc. of Beaverton, OR and/or other manufacturers, including conventional structures and constructions as are known and used in the art.

Additionally or alternatively, if desired, the upper 102 construction may include uppers having foot securing and engaging structures, e.g., of the types described in U.S. Patent Appln. Publn. No. 2013/0104423, which publication is entirely incorporated herein by reference. As some additional examples, if desired, uppers 102 and articles of footwear 100 in accordance with this technology may include foot securing and engaging structures of the types used in footwear products commercially available from NIKE, Inc. of Beaverton, Oregon. These types of structures may at least partially wrap around and securely hold the wearer's foot, particularly in the midfoot and/or heel areas.

As yet another alternative or additional feature, if desired, uppers 102 and articles of footwear 100 in accordance with at least some examples of this technology may include fused layers of upper materials, e.g., uppers of the types that include upper materials bonded by hot melt or other adhesive materials, such as in footwear products commercially available from NIKE, Inc. of Beaverton, Oregon. As still additional examples, uppers of the types described in U.S. Pat. No. 7,347,011 and/or 8,429,835 may be used without departing from this technology (each of U.S. Pat. Nos. 7,347,011 and 8,429,835 is entirely incorporated herein by reference).

More specific features, constructions, and operation of the example articles of footwear 100 and sole structures 104 thereof now will be described in more detail in conjunction with FIGS. 1A to 7. The example sole structure 104 of this article of footwear 100 includes five component parts, although each individual component part described below may be made from one or more parts (including two or more parts that are joined together and/or two or more parts that provide the same function and/or structure). Some of the component parts also may be combined into a single part. The five component parts include: (a) a main sole component 200, which may include a midsole component 200 (see FIGS. 2A-2F); (b) a rear outsole component 300 (see FIG. 3A); (c) a forefoot outsole component 350 (see FIG. 3B); (d) a top component 400 (see FIGS. 4A-4D); and (e) a bottom component 500 (see FIGS. 5A-5D). The top component 400 and the bottom component 500 of this example are located in a midfoot-to-forefoot support region of the sole structure 104 and support the relative motion functions described in more detail below.

First, the main sole component 200 of this example will be described in more detail. As shown in FIGS. 1A-2F, the main sole component 200 of this example includes a midsole component, which may be made from one or more component parts. As some more specific examples, the midsole component 200 may be made from a polymeric foam material, such as ethylvinyl acetate (EVA), polyurethane foam, and/or thermoplastic materials. Additionally or alternatively, if desired, the midsole component 200 may include one or more fluid-filled bladders and/or one or more mechanical shock absorbing components as impact force attenuating elements (e.g., to attenuate ground-reaction forces when a wearer lands a step or jump). When present, any fluid-filled bladder(s) and/or mechanical shock absorbing component(s) may be engaged with another part of the midsole component 200 and/or at least partially embedded in the midsole component 200 (e.g., embedded in foam material). The midsole component 200 may have any desired number of parts and/or any desired structures or constructions, including parts, structures, and/or constructions as are known and used in the footwear art.

Midsole component 200 includes a ground-facing surface 200G and an upper-facing surface 200U. While other constructions are possible, in this illustrated example, the upper-facing surface 200U of midsole component 200 extends in a heel-to-toe direction and a medial side-to-lateral side direction of the sole structure 104 and article of footwear 100 to a sufficient extent to support an entire plantar surface of a wearer's foot. The midsole component 200 includes a lateral sidewall 200L, a medial sidewall 200M, a heel wall 200H, and a forefoot wall 200F. These walls may define a recess extending downward to the upper-facing surface 200U that provides the plantar support surface for the wearer's foot. At least some portions of lateral sidewall 200L, medial sidewall 200M, heel wall 200H, and/or forefoot wall 200F may be exposed in the final sole structure 104 and/or final article of footwear 100 construction. In this illustrated example, the upper-facing surface 200U extends to provide a continuous support for an entire plantar surface of a wearer's foot.

As further shown, e.g., in FIGS. 2A-2F, the ground-facing surface 200G of midsole component 200 of this example has a recess 200R (or recessed area) defined therein. The recess 200R also may be defined in part by the lateral sidewall 200L and/or the medial sidewall 200M. As shown in FIGS. 2A-2F, the recess 200R extends completely from the lateral sidewall 200L to the medial sidewall 200M. The forwardmost edge 200FE of the recess 200R may be located beyond a parallel plane located at 0.7 L of a longitudinal length L measured between a rearmost heel RH location of the shoe 100 and/or sole structure 104 and a forwardmost toe FT location of the shoe 100 and/or sole structure 104 (and in some examples, forward of a parallel plane located at 0.75 L or even forward of a parallel plane located at 0.8 L). The rearmost edge 200RE of the recess 200R may be located beyond a parallel plane located at 0.4 L of the longitudinal length L identified above (and in some examples, forward of a parallel plane located at 0.45 L or even forward of a parallel plane at 0.5 L). In at least some examples of this technology, the overall longitudinal length of the recess 200R (and/or the components fitting into this recess 200R as described in more detail below) may be between 0.2 L and 0.4 L. "L" in the discussion above may constitute the longitudinal length of the midsole component 200, the overall sole structure 104, and/or the footwear structure 100.

The recess 200R includes a downward-facing surface 200RS shaped to accommodate receipt of the first footwear component 400, as will be described in more detail below. In this illustrated example, the downward-facing surface 200RS has an arched or curved lateral surface 200RL, an arched or curved medial surface 200RM, and a flat or curved central surface 200RC joining surfaces 200RL and 200RM. The arched or curved medial surface 200RM and lateral surface 200RL may have the same or different curvature, and/or the central surface 200RC may be flat or flatter than the surfaces 200RL, 200RM when the sole structure 104 is mounted on its ground-facing surface 200G on a horizontal base surface. The shape of the downward-facing surface 200RS may be complementary to and/or directly contact the upper-facing surface 400U of the first footwear component 400, as will be described in more detail below. The recess 200R of this example sole structure 104 may be shaped, positioned, configured, and well suited to support rotation of a wearer's forefoot, e.g., during various phases of a golf swing. The shape of recess 200R also may be structured to resist movement of midsole component 200 with respect to first footwear component 400 when a force is applied to the sole structure 104 (e.g., due to discontinuity(ies) in the curve/arch shape, the flat or flattened central surface 200RC, non-constant radius or curvature from the lateral edge to the medial edge, etc.).

FIGS. 3A and 3B illustrate bottom surfaces of outsole components 300, 350, respectively. These outsole components 300, 350 engage with ground-facing surface 200G of the midsole component 200. More specifically, the upper-facing surface (not shown in FIG. 3A) of rear outsole component 300 (which may be made from one or more parts) engages with the rear portion 200GR of the ground-facing surface 200G (aft of recess 200R). Similarly, the upper-facing surface (not shown in FIG. 3B) of forward outsole component 350 (which also may be made from one or more parts) engages with the forward portion 200GF of the ground-facing surface 200G (forward of recess 200R). Outsole components 300, 350 of this example sole structure 104 are completely separated from one another by recess 200R. While outsole component 300 of this example would completely cover the rear portion 200GR of midsole component 200's ground-facing surface 200G and outsole component 350 would completely cover the forward portion 200GF of midsole component 200's ground-facing surface 200G, this is not a requirement. Rather, if desired, the ground-facing surface 200G could be exposed at the exterior of the overall sole structure 104 in one or more locations through and/or around each of outsole component 300 and/or outsole component 350.

The outsole component(s) 300, 350 may be engaged with the midsole component 200 in any desired manner without departing from this technology, including by any one or more of adhesives, mechanical connectors, fusing techniques, etc. Additionally or alternatively, if desired, while not shown in the example of FIGS. 1A-7, either or both of the outsole component(s) 300, 350 may include sidewalls that extend upward to engage some or all of lateral sidewall 200L and/or medial sidewall 200M of midsole component 200. Also, because this example article of footwear 100 and sole structure 104 comprise a golf shoe, the bottoms of each outsole component 300 and 350 include cleats 302 or other traction-enhancing features, e.g., suitable for use while playing golf. Other types of golf cleats, spikes, other cleats (including detachable and replaceable cleats), or other traction-enhancing features may be provided without departing from this technology. The outsole components 300, 350 may be made from any desired materials, including materials as are conventionally known and used in the footwear arts including the golf shoe art (e.g., rubbers, TPUs, etc.). The outsole components 300, 350 need not be made from the same materials, although the same materials could be used in each.

The sole structure 104 of this example further includes a top component 400 that supports the desired slide, tilt, and/or rotation features and forms a portion of a "means for movably engaging" the various footwear parts together. Top component 400 may be considered a rail component (e.g., an upper rail component) that engages corresponding (and/or complementary) structures in bottom component 500. FIGS. 4A-4D show a top view, a bottom view, a bottom, rear, medial perspective view, and a bottom, rear, lateral perspective view, respectively, of this example top component 400. If desired, the top component 400 may be made from multiple parts, provided it supports the desired sliding/tilting/rotation functions described herein. Top component 400 may be made from any desired material or materials that will support its desired functions (e.g., have sufficient strength, durability, hardness, etc. to remain structurally stable in use). Some example materials include metals (e.g., one or more of aluminum, aluminum alloys, titanium, titanium alloys, steel, etc.) and plastics (e.g., commercially available polyether block amines, thermoplastic polyurethanes, other thermoplastic elastomers, thermosetting polymers, fiber-reinforced polymers (e.g., carbon fiber materials), etc.).

FIG. 4A shows the upper-facing surface 400U of this example top component 400. The upper-facing surface 400U of top component 400 may be permanently and fixedly engaged in the recess 200R of midsole component 200 in any desired manner without departing from this technology, including by any one or more of adhesives, mechanical connectors, fusing techniques, etc. The upper-facing surface 400U of this example is complementary shaped with respect to the shape of the downward-facing surface 200RS of recess 200R. More specifically, this example upper-facing surface 400U has: (a) an arched or curved lateral surface 400UL for engaging the arched or curved lateral surface 200RL of recess 200R, (b) an arched or curved medial surface 400UM for engaging the arched or curved medial surface 200RM of recess 200R, and (c) a flat or curved central surface 400UC for engaging the flat or curved central surface 200RC of recess 200R. The flat or curved central surface 400UC joins lateral surface 400UL and medial surface 400UM of upper-facing surface 400U.

Top component 400 also includes a ground-facing surface 400G opposite the upper-facing surface 400U (see FIGS. 4B-4D). The ground-facing surface 400G of this example includes: (a) an arched or curved lateral surface 400GL arching downward from a lateral side edge of the top component 400, the article of footwear 100, and/or the overall sole structure 104 and (b) an arched or curved medial surface 400GM arching downward from a medial side edge of the top component 400, the article of footwear 100, and/or the overall sole component 104. If desired, and as shown in the example of FIGS. 4B-4D, the ground-facing surface 400G further may include a flat or curved central surface 400GC joining lateral surface 400GL and medial surface 400GM of ground-facing surface 400G. Central surface 400GC is flatter than both of surfaces 400GL and 400GM in this example. Also, in this illustrated example, medial surface 400GM is flatter than lateral surface 400GL (e.g., more horizontal when the top component 400, article of footwear 100, and/or sole structure 104 is supported on a horizontal base surface). The ground-facing surface 400G need not be parallel to the upper-facing surface 400U, although these surfaces 400G and 400U may be parallel or substantially parallel over some of their surface areas.

Alternatively, if desired, curvature of the ground-facing surface 400G could continue continuously from the lateral side edge to the medial side edge of the top component 400, article of footwear 100, and/or sole structure 104, optionally with no distinct curvature change location (e.g., as a single radiused surface). Any ground-facing surface 400G shape (including flat portion(s)), curvature, combination of shapes, and/or combination of curvatures) that supports or accommodates the desired sliding/tilting/rotation functions may be used without departing from at least some aspects of this technology.

The ground-facing surface 400G of this example top component 400 includes one or more (four shown) raised tracks 402T. Two parallel tracks 402T are formed in the arched or curved lateral surface 400GL (separated from one another in the front-to-back direction of the sole structure 104), and two parallel tracks 402T are formed in the arched or curved medial surface 400GM (separated from one another in the front-to-back direction of the sole structure 104). The bottom surfaces 402S of tracks 402T may generally parallel the surfaces 400GM and 400GL on which the tracks 402T are included over at least some portion of their longitudinal lengths (e.g., at least 50%, at least 60%, at least 75%, etc.). The internal ends of one or more of the tracks 402T taper toward the ground-facing surface 400G, e.g., toward its central area 400GC. The tracks 402T of this example top component 400 have a T-shaped cross section and shape that help retain the tracks 402T within their corresponding channels, as will be described in more detail below. Other retaining shapes are possible, such as dovetail joints, etc.

The sole structure 104 of this example further includes a bottom component 500 that supports the desired slide, tilt, and/or rotation features and forms a portion of the "means for movably engaging" the various footwear parts together (supports moving one component with respect to the other component). Bottom component 500 may be considered a rail component (e.g., a lower rail component) that engages corresponding (and/or complementary) structures in top component 400. FIGS. 5A-5D show a top view, a bottom view, a top, rear, medial perspective view, and a top, rear, lateral perspective view, respectively, of this example bottom component 500. If desired, the bottom component 500 may be made from multiple parts, provided it supports the desired sliding/tilting/rotation functions described herein. Bottom component 500 may be made from any desired material or materials that will support its desired functions (e.g., have sufficient strength, durability, hardness, etc. to remain structurally stable in use). Some example materials include metals (e.g., one or more of aluminum, aluminum alloys, titanium, titanium alloys, steel, etc.) and plastics (e.g., commercially available polyether block amines, thermoplastic polyurethanes, other thermoplastic elastomers, thermosetting polymers, fiber-reinforced polymers (e.g., carbon fiber materials), etc.). In this illustrated example, the ground-facing surface 500G of bottom component 500 is designed to directly contact the ground in use, and it includes traction elements 520 (e.g., golf cleats or other traction-enhancing elements of the types described above for FIGS. 3A and 3B). Additionally or alternatively, if desired, at least some (or even all) of the ground-facing surface 500G may be formed as one or more separate parts that is/are engaged with the bottom surface of a component that includes other features of bottom component 500.

FIGS. 5A, 5C, and 5D show the upper-facing surface 500U of this example bottom component 500. This upper-facing surface 500U includes: (a) an arched or curved lateral surface 500UL arching downward from the lateral side edge of the bottom component 500, the article of footwear 100, and/or the overall sole structure 104 toward the central region of the bottom component 500 (and configured to lie facing the arched or curved lateral surface 400GL of top component 400) and (b) an arched or curved medial surface 500UM arching downward from the medial side edge of the bottom component 500, the article of footwear 100, and/or overall sole component 104 toward a central region of the bottom component 500 (and configured to lie facing the arched or curved medial surface 400GM of top component 400). If desired, and as shown in the example of FIGS. 5A, 5C, and 5D, the upper-facing surface 500U further may include a flat or curved central surface 500UC configured to face the flat or curved central surface 400GC of top component 400 (when present). The flat or curved central surface 500UC of this example joins lateral surface 500UL and medial surface 500UM of upper-facing surface 500U. Central surface 500UC is flatter than both of surfaces 500UL and 500UM. Also, in this illustrated example, medial surface 500UM is flatter than lateral surface 500UL (e.g., more horizontal when the bottom component 500, article of footwear 100, and/or sole structure 104 is supported on a horizontal base surface).

Alternatively, if desired, curvature of the upper-facing surface 500U could continue continuously from the lateral side edge to the medial side edge of the bottom component 500, article of footwear 100, and/or sole structure 104, optionally with no distinct curvature change location (e.g., as a single radiused surface). Any upper-facing surface 500U shape (including flat portion(s)), curvature, combination of shapes, and/or combination of curvatures) may be used without departing from at least some aspects of this technology, provided it can cooperate with the top component 400 and support or accommodate the desired sliding/tilting/rotation functions.

The upper-facing surface 500U of this example bottom component 500 includes one or more (four shown) recessed channels 502T. Two parallel channels 502T are formed in the arched or curved lateral surface 500UL (separated from one another in the front-to-back direction of the sole structure 104), and two parallel channels 502T are formed in the arched or curved medial surface 500UM (separated from one another in the front-to-back direction of the sole structure 104). The path defined by the channel(s) 502T may generally parallel the surfaces 500UM and 500UL on which they are formed over at least some portion of their longitudinal lengths (e.g., at least 50%, at least 60%, at least 75%, etc.). The internal ends of one or more of the channels 502T taper until they extend completely through the thickness of the bottom component 500 to define openings 502O through the bottom component 500 located toward the central area and through the central surface 500UC or sidewall surface 500UL and/or 500UM. These openings 502O may help provide access to the channels 502O when inserting tracks 402T into the channels 502T during assembly and/or allow for freer movement of the tracks 402T with respect to the channels 502T during use (e.g., so, if necessary, the end portion of a track 402T can move to a location outside the channel 502T during a sliding/tilting/rotation action). If desired, one or more other openings 504O may be defined completely through the bottom component 500. These other openings 504O may be provided at desired locations, e.g., to lighten the bottom component 500, to enhance and/or control flexibility, for aesthetic/design purposes, etc.

The channels 502T of this example bottom component 500 have a T-shaped cross section (see FIG. 1A) that helps retain the tracks 402T within their corresponding channel 502T. Other retaining shapes are possible, such as dovetail joints, etc. The channel 502T shape is complementary to the track 402T shape to be inserted into it.

FIGS. 6A-6C illustrate features of assembly of the sole structure 104 in accordance with at least some aspects of this technology. These steps may be altered in order in any appropriate manner without departing from this technology.

FIG. 6A illustrates assembly of the relatively movable footwear components of this example structure, i.e., top component 400 joined to bottom component 500 to form aggregate component 600. As shown, in this example, the T-shaped track(s) 402T of top component 400 is/are inserted into the corresponding T-shaped channel(s) 502T of the bottom component 500. If necessary or desired, the track(s) 402T and/or channel(s) 502T may include materials and/or may be formed from materials that include a lubricant (e.g., a polytetrafluoroethyene (PTFE) coating) to promote relative movement of the top component 400 with respect to the bottom component 500. Additionally or alternatively, the surface(s) of the track(s) 402T and/or channel(s) 502T may be formed from materials or include material(s) having a low coefficient of friction with respect to the other to promote the desired relative motion. In this illustrated example, top component 400 is movable with respect to the bottom component 500 in a sliding/tilting/rotating manner via movement of the track(s) 402T along channel(s) 502T. The T-shapes retain the track(s) 402T within the channel(s) 502T. In addition to the track(s) 402T and channel(s) 502T, the facing surfaces 400G and 500U of the top component 400 and the bottom component 500, respectively, may be formed from and/or include a lubricant and/or relatively low coefficient of friction materials with respect to one another to promote the desired sliding, tilting, and/or rotational motion.

If necessary or desired, one or more "stop members" may be provided to limit slide/tilt/rotation of the top component 400 with respect to the bottom component 500, e.g., to prevent dangerous over-rotation and/or complete separation of footwear component parts 400 and 500. Alternatively, the shape(s) of the footwear component parts 400 and/or 500 (e.g., their central regions 400GC and/or 500UC) may function as a stop member.

As an alternative structure, rather than track(s) 402T in channel(s) 502T, one or more of the track(s) may be omitted and one or more roller structures (e.g., roller balls, roller cylinders, etc.) can be placed in channel(s) 502T to support the desired motion. In such structures, the roller structure(s) should be tall enough and shaped to contact each of the top component 400 and the bottom component 500 (e.g., span from the surface of the channel 502T to the bottom of the top component 400). In this manner, the top component 400 moves with respect to the bottom component 500 in a sliding/tilting/rotating manner via rolling on the roller structure(s) located within the channel(s) 502T. If roller structure(s) are used, some other manner of securing bottom component 500 to the remainder of the footwear 100 structure may be needed, such as engagement of bottom component 500 with one or more other sole structure 104 components (such as an outsole component 300 and/or 350 described above), the exterior shapes of the sole structure components, etc.

FIG. 6B illustrates the step of engaging the aggregate component 600 in the recess 200R of main sole component 200. Reference number 700 refers to the aggregate footwear component formed by the aggregate footwear component 600 and midsole component 200. The exterior perimeter of the aggregate footwear component 600 and the interior perimeter of the recess 200R may be complementary shaped such that aggregate component 600 lies substantially flush within the recess 200R, at least along the recess 200R's forward edge 200FE and rear edge 200RE. If necessary or desired, the forward edge 500FE and rear edge 500RE of the bottom component 500 and/or the forward edge 200FE and/or rear edge 200RE of the recess 200R (i.e., the adjacent and facing surfaces thereof) may be formed from and/or include a lubricant and/or relatively low coefficient of friction materials with respect to one another to promote the desired sliding, tilting, and/or rotational motion.

In this example structure, if desired, the bottom of aggregate component 600 (provided by bottom component 500), on at least one of the lateral or medial sides thereof, may extend downward somewhat from the bottom surfaces of the remainder of the sole structure 104 at areas adjacent the forward edge 200FE and rear edge 200RE. See FIG. 1A. This downward extension 104E may be in the range of 0.5 mm to 10 mm, and in some examples within the range of 1 mm to 8 mm. This downward extension, when present, helps the aggregate component 600 contact the ground earlier in the step cycle than the adjacent sole component areas to more easily initiate the desired sliding/tilting/rotational action.

The top surface of the aggregate component 600 (provided by upper-facing surface 400U of top component 400) may be permanently and fixedly engaged with the ground-facing surface 200RS of recess 200R by adhesives and/or in any desired manner (e.g., as mentioned above). But the bottom component 500 in this example aggregate structure 700 is not fixed with respect to midsole component 200 to allow it to be movable with respect to midsole component 200 and top component 400.

FIG. 6C illustrates the step of applying outsole components 300, 350 to the ground-facing surface 200G of midsole component 200, which in this example method comprises part of aggregate footwear component 700. As noted above, outsole components 300, 350 may be fixedly engaged with the ground-facing surface 200G of midsole component 200 in any desirable manner, such as via adhesives, to form the overall sole structure 104. Outsole components 300, 350 in this example structure are not engaged with bottom component 500. Outsole components 300, 350 may be engaged with the midsole component 200 at any time during the process of forming sole structure 104. The sole structure 104 also may be engaged with the footwear upper 102 at any desired time in the assembly process.

FIG. 7 illustrates function and use of aspects of this technology, e.g., during a golf swing. When setting up for a golf swing, the golfer stands aside the ball with the left shoe 100L spread apart from the right shoe 100R. Aspects of this technology allow the golfer to apply a downward and optionally outward force (shown by arrows 702) at the forefoot region to firmly engage the bottom component 500 of the sole structure 104 with the ground. Because bottom component 500 is firmly engaged with the ground (shown by "stop" signs 704) (e.g., due to location of substantial force applied by the foot to the ground) but not fixedly engaged with the remainder to the sole structure 104/footwear structure 100, areas of the forefoot of the midsole component 200 can slide, tilt, or rotate outward (at least to some degree) as needed. This outward slide/tilt/rotation is shown in FIG. 7 by arrows 706. In this manner, the ball of the foot can remain firmly planted to the ground during initial stance and throughout the golf swing while permitting somewhat easier and/or natural motion of the remainder of the foot. Much of the force applied by a wearer's foot during the stance and/or some phases of the golf swing is applied at the first metatarsal head area—at the forefoot, medial side of the sole. Thus, this sole structure 104 provides a very stable base and feel, particularly for the rear foot of the golfer during the downswing and ball contact phases of the golf swing. Similarly, in these shoes 100R, 100L, inward rotation of the article of footwear 100R, 100L at the forward and rearward areas of the sole structure 104 also may be supported with the bottom component 500 fixed to the ground, e.g., to allow some additional inward rotation of the front foot with respect to the bottom component 500 during the follow through phase of the golf swing.

The relative motion features of the bottom component 500 with respect to the remainder of the footwear 100 and/or sole structure 104 can be maintained during all use of the shoe, including when walking or during other activities. The relative rotational features allow somewhat more free and natural motion of the foot during a typical step cycle. Alternatively, if desired, a locking mechanism could be provided to releasably secure bottom component 500 with or with respect to one or more other parts of the sole structure 104 (e.g., midsole 200, top component 400, outsole components 300 and/or 350) and/or article of footwear 100 to prevent relative slide/tilt/rotation when not desired. For example, one or more non-stretchable connectors 752 could be selectively engaged (connected and disconnected) between pegs 754 provided in the bottom component 500 and another footwear part to temporarily and releasably fix the components together and prevent slide/tilt/rotation. See FIGS. 1A and 1B. As another example, a spring-loaded obstruction could be selectively moved to extend into and out of one or more channels 502T to physically block movement of the track(s) 402T in their channel(s) 502T in one or both directions. Suitable locking mechanisms also could be electronically controlled to change between locked and unlocked conditions.

Figure 9A:
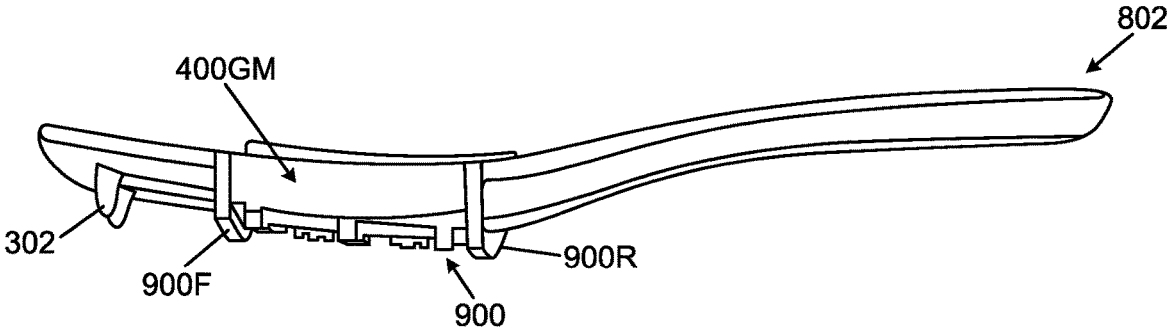
FIGS. 9A-9F provide various views of a main sole component included in the article of footwear of FIGS. 8A-8D.
Figure 9B:
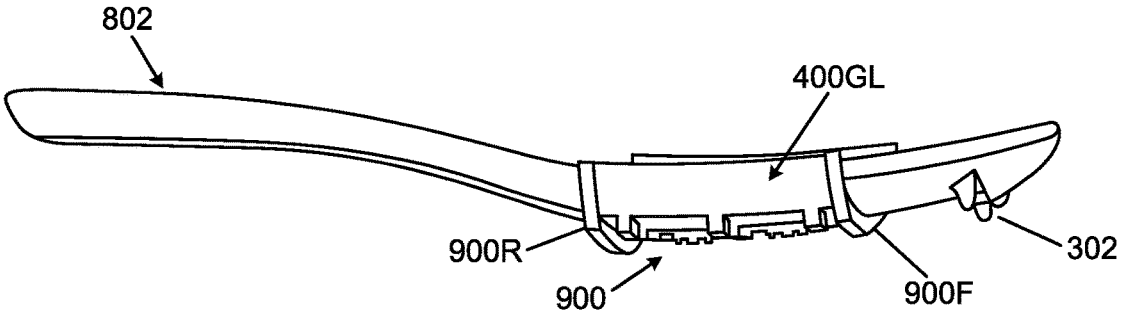
Figure 9C:
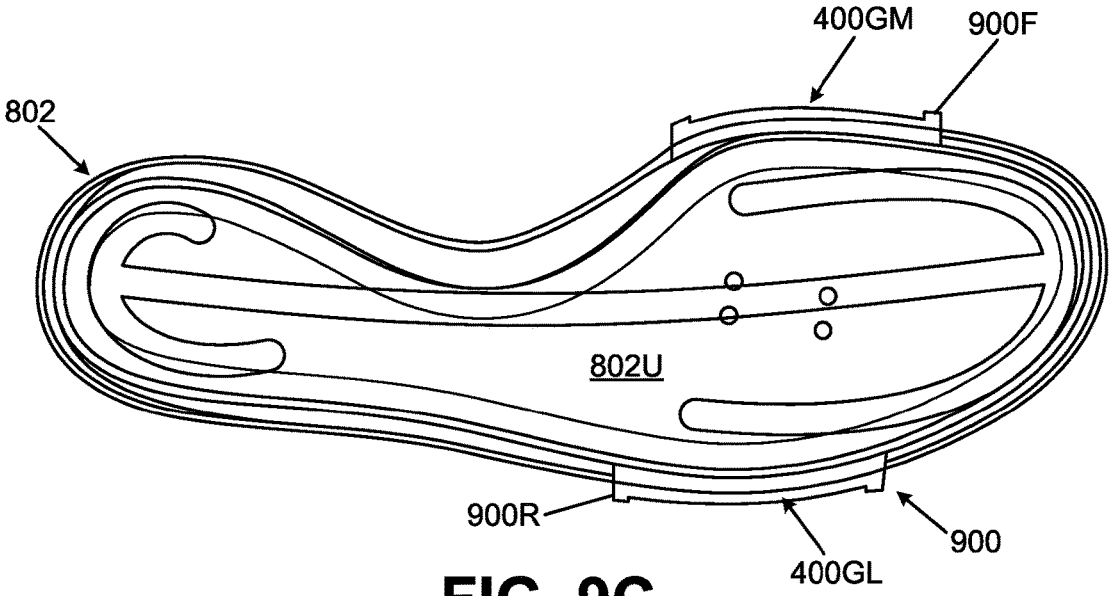
Figure 9D:
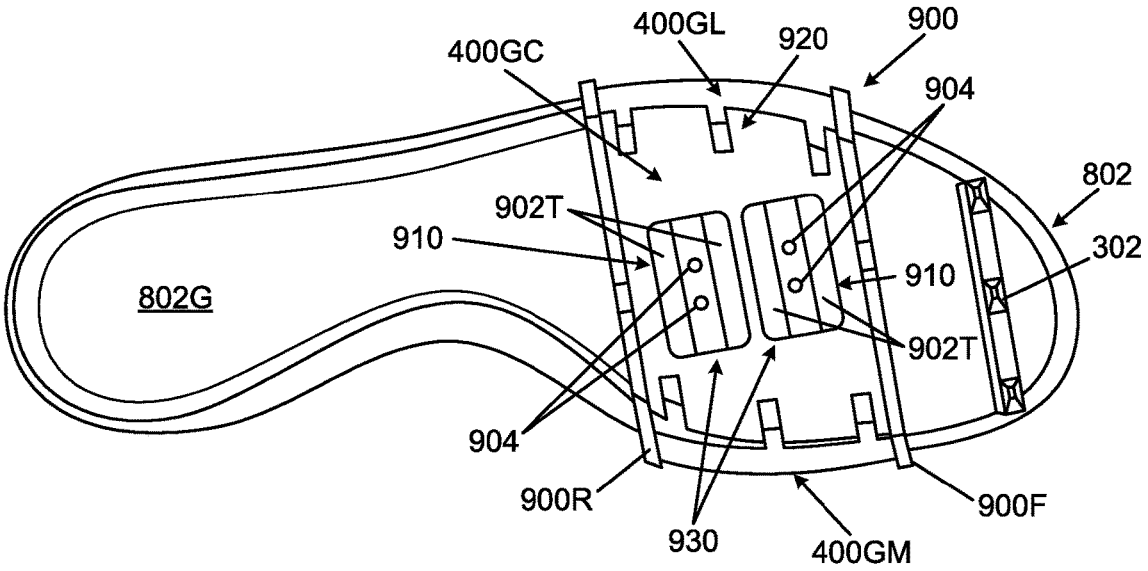
Figure 9E:
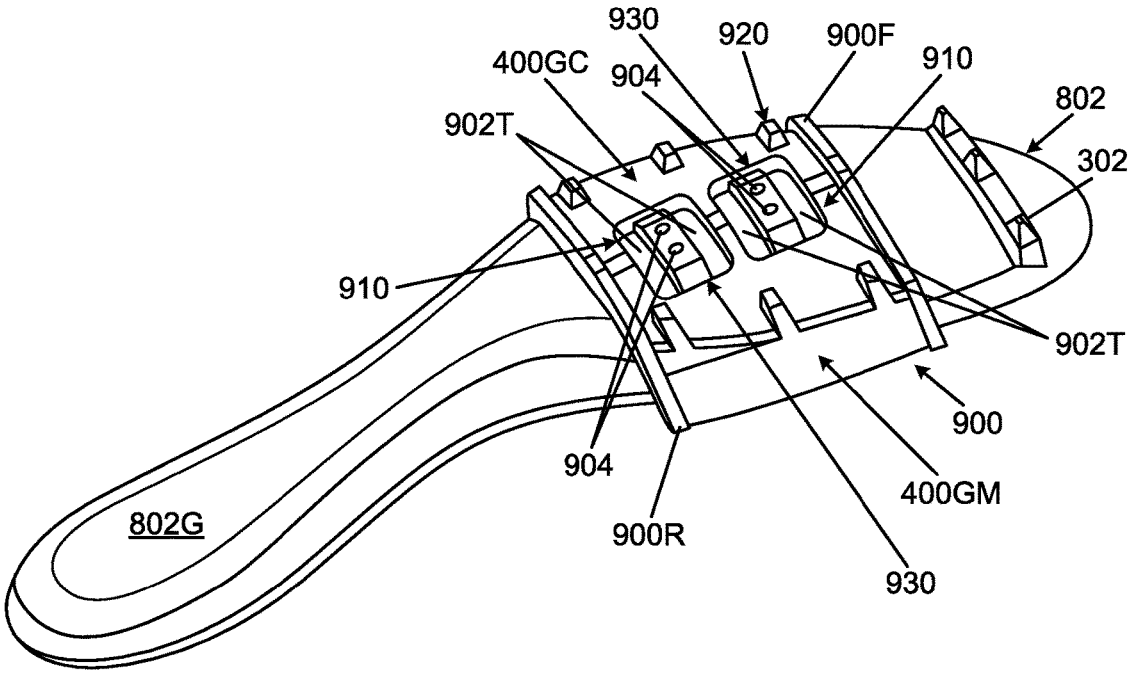
Figure 9F:
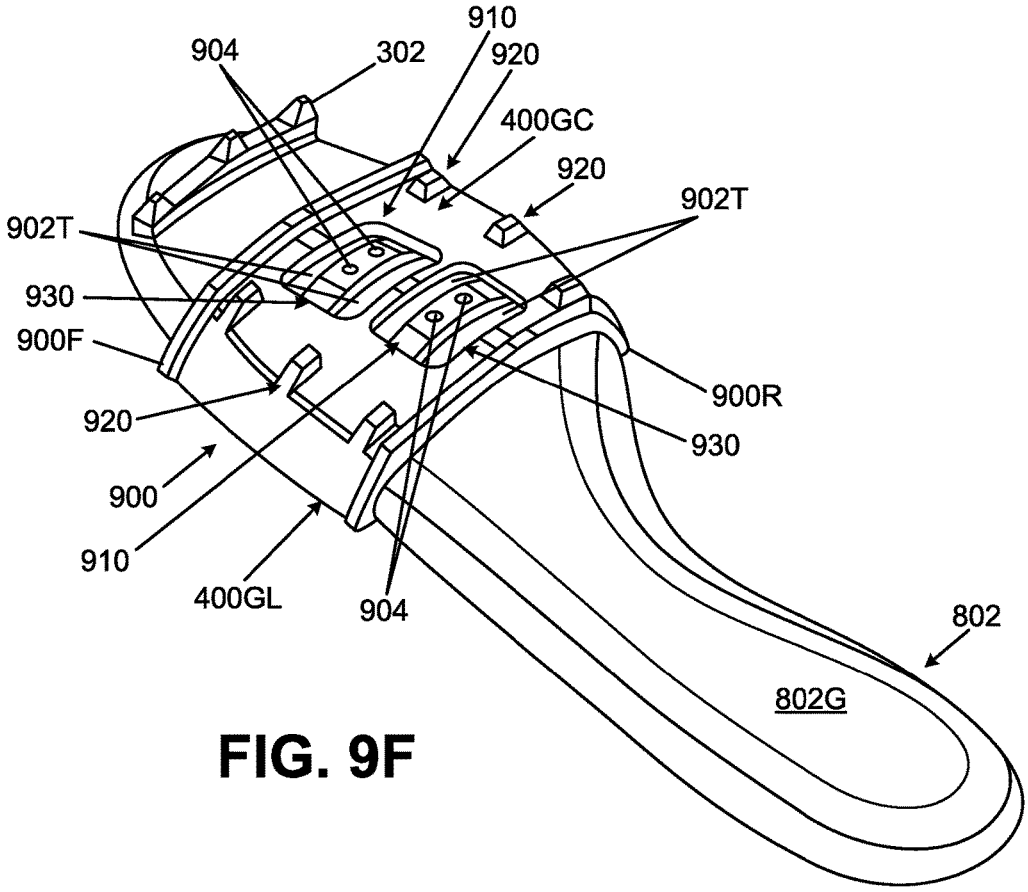
Figure 10A:
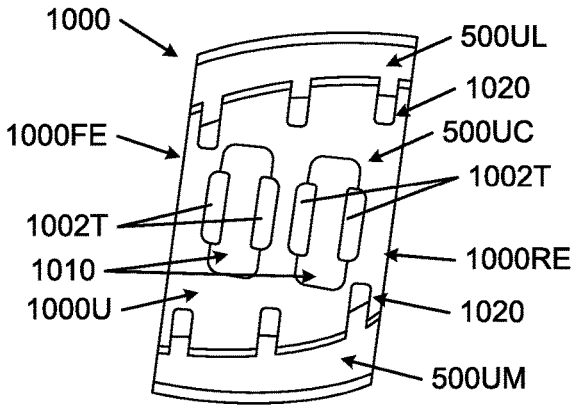
FIGS. 10A-10E provide various views of a bottom footwear component that provides relative movement features included in the article of footwear of FIGS. 8A-8D.
Figure 10B:
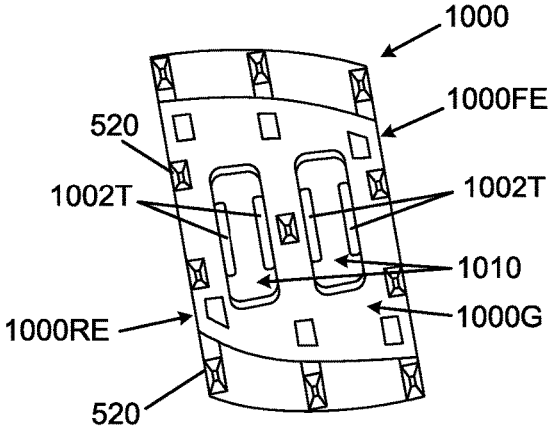
Figure 10C:
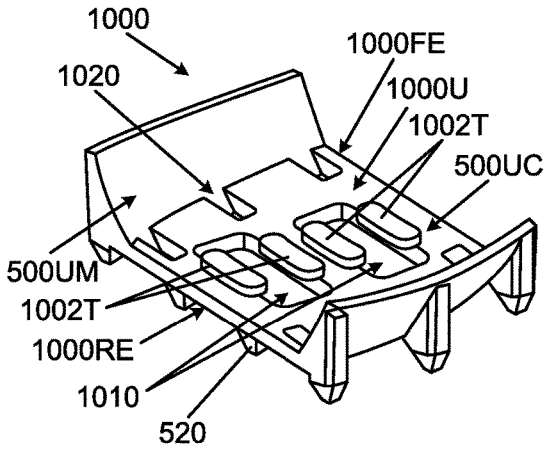
Figure 10D:
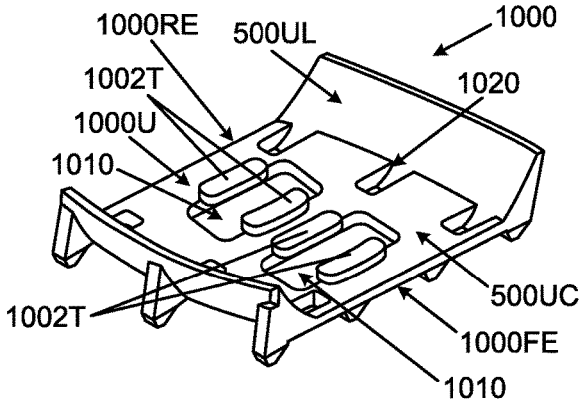
Figure 10E:
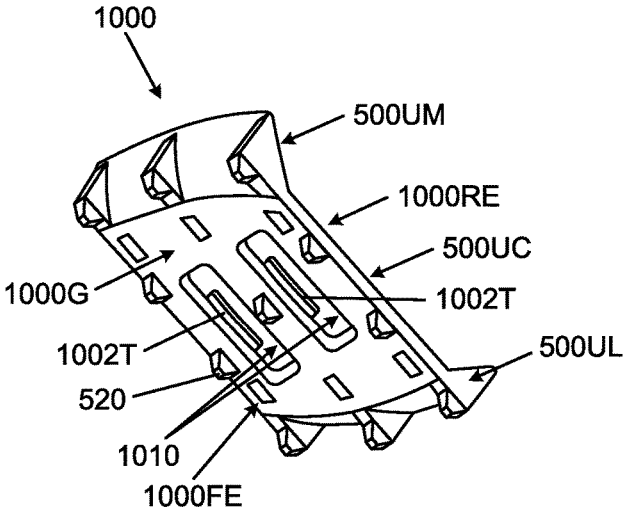
Figure 11:
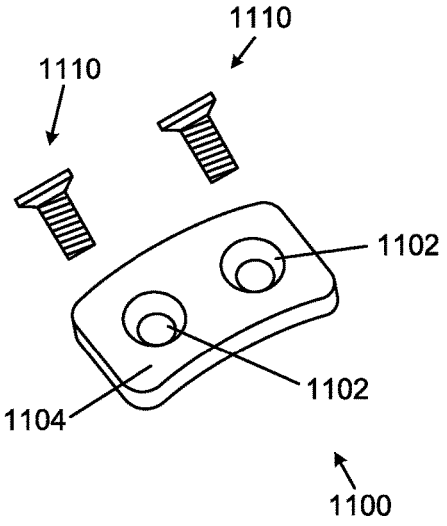
FIG. 11 illustrates a securing system included in the article of footwear of FIGS. 8A-8D.
Figure 12:
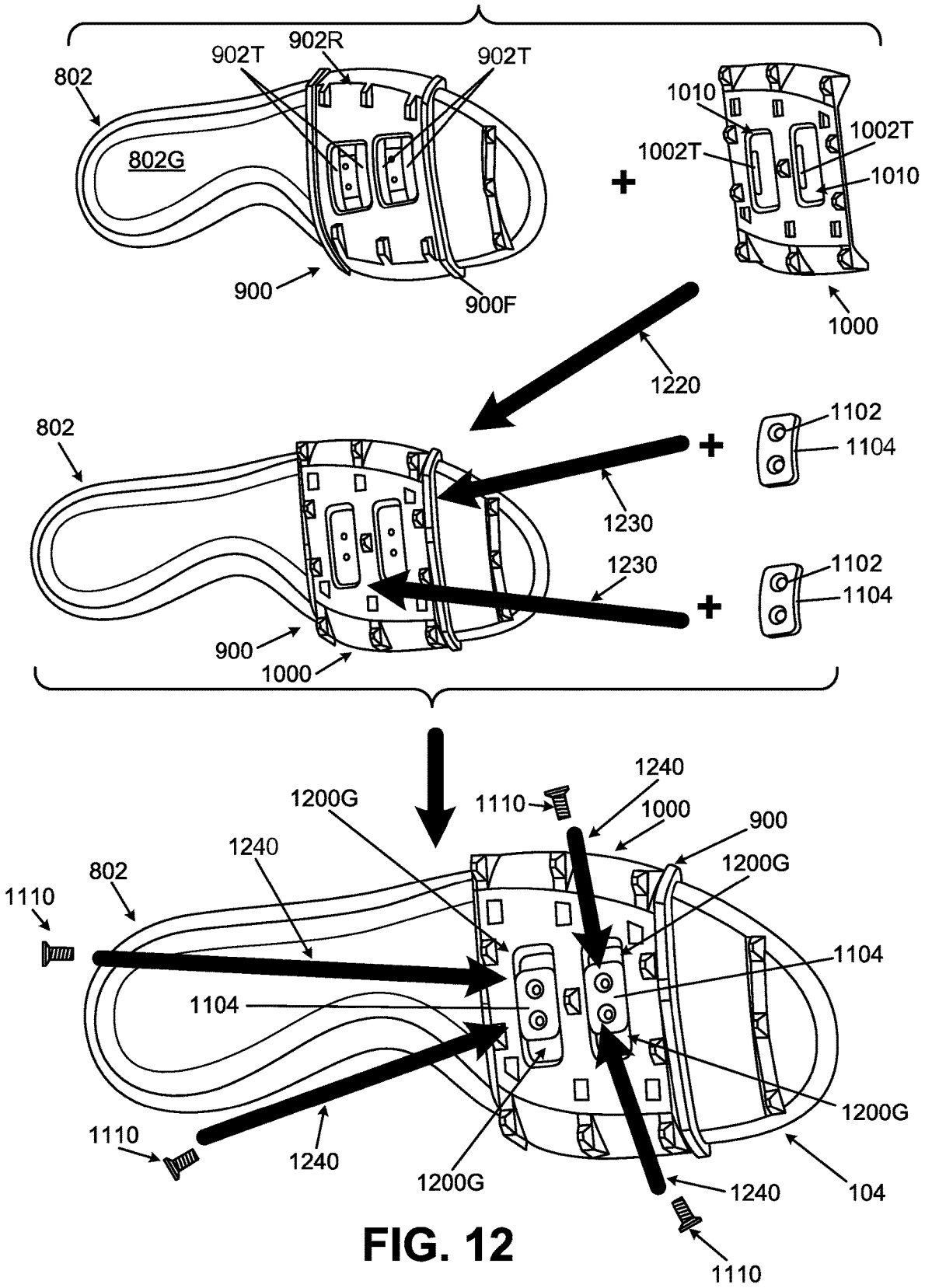
FIG. 12 illustrates assembly of the sole structure of the article of footwear of FIGS. 8A-8D.
Figure 13B:
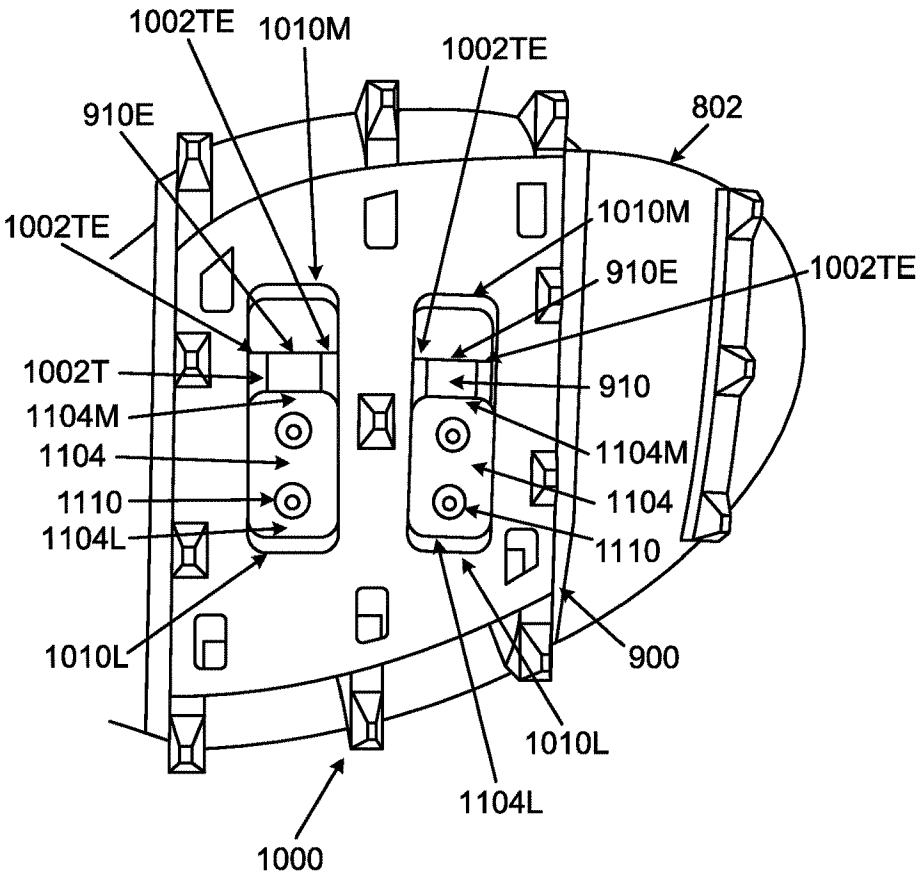
FIGS. 13A and 13B illustrate features of potential movement of the article of footwear of FIGS. 8A-8D.

FIGS. 8A-13B illustrate various features of another example article of footwear 800 in accordance with some examples of this technology. FIGS. 8A-8D illustrate the overall article of footwear 800; FIGS. 9A-9F provide various views of a main sole component 802 thereof; FIGS. 10A-10E provide various views of a bottom component 1000 thereof; FIG. 11 illustrates a retaining system thereof; FIG. 12 illustrates example assembly thereof; and FIGS. 13A-13B illustrate the relative movable parts in neutral and tilted positions, respectively. This example article of footwear 800, and particularly the sole structure 104 thereof, is well suited for use as a sprint or track shoe, although it may be used in other desired shoes as well. The description below highlights at least some differences between this example article of footwear 800 and the article of footwear 100 described above in conjunction with FIGS. 1A-7. One skilled in the art given benefit of this disclosure, however, will recognize that various features, options, alternatives, and differences provided in the structure 800 of FIGS. 8A-13B may be incorporated into the structure 100 of FIGS. 1A-7 and/or that various features, options, alternatives, and differences provided in the structure 100 of FIGS. 1A-7 may be incorporated into the structure 800 of FIGS. 8A-13B. Where FIGS. 8A-13B include references numbers the same as those included in FIGS. 1A-7, the same or similar parts are being referenced (including any disclosed characteristics, properties, variations, modifications, options and/or potential changes thereto), and some or all of the detailed repetitive description thereof may be omitted.

Figure 8A:
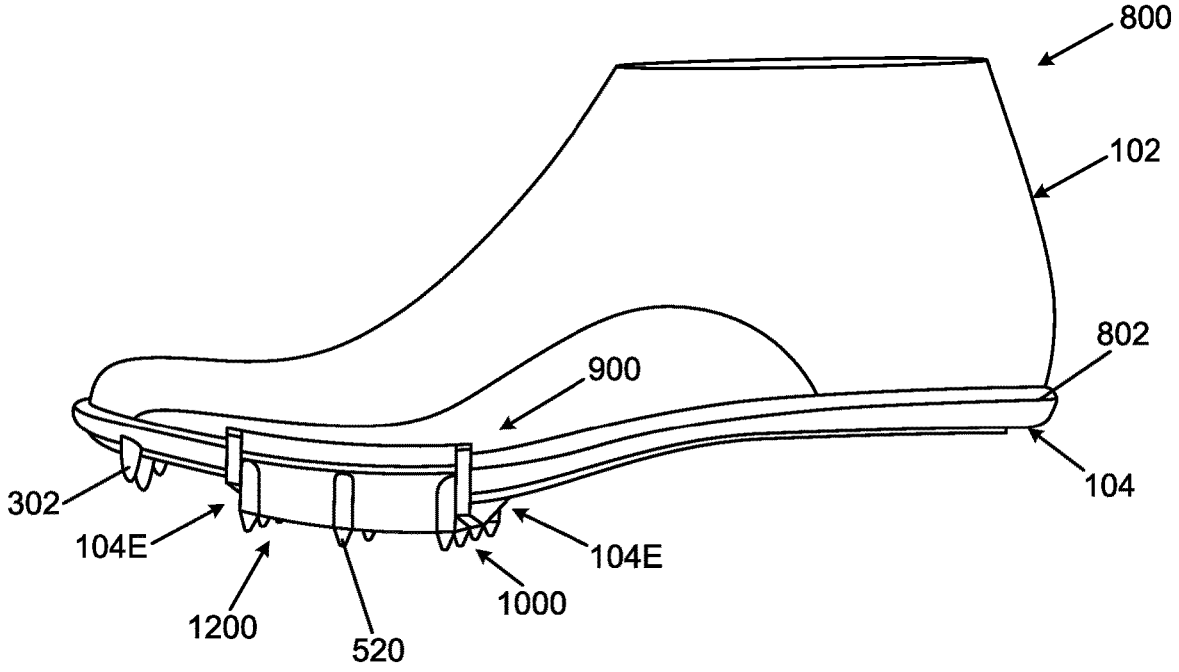
FIGS. 8A-8D provide various views of an article of footwear according to another example of this technology.
Figure 8B:
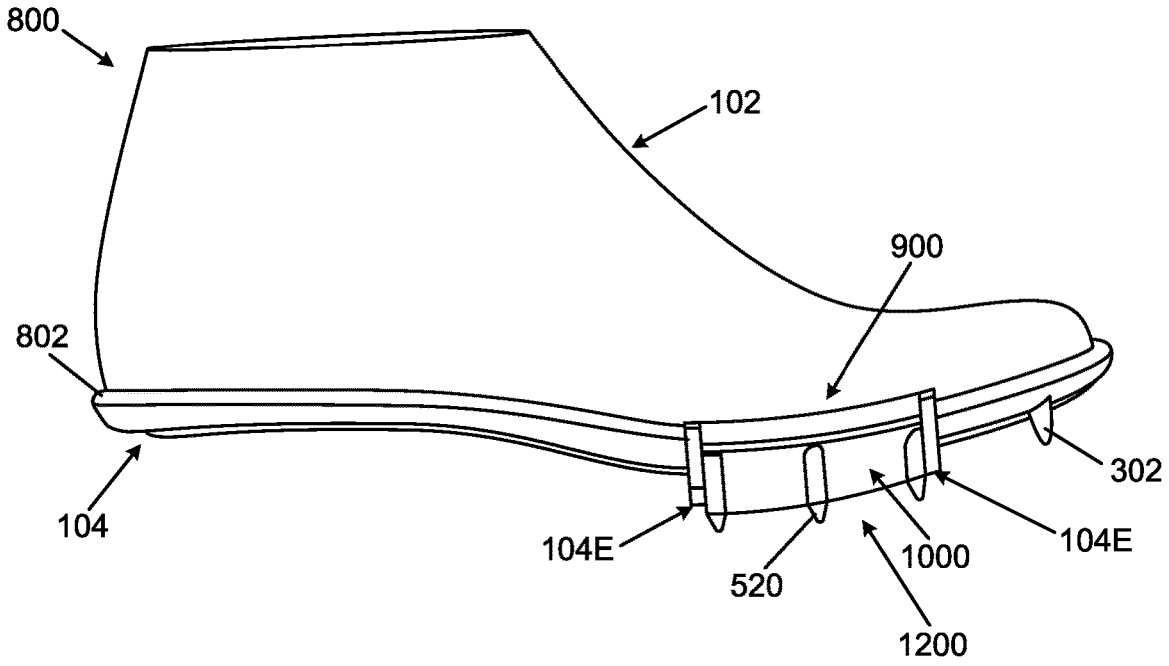
Figure 8C:
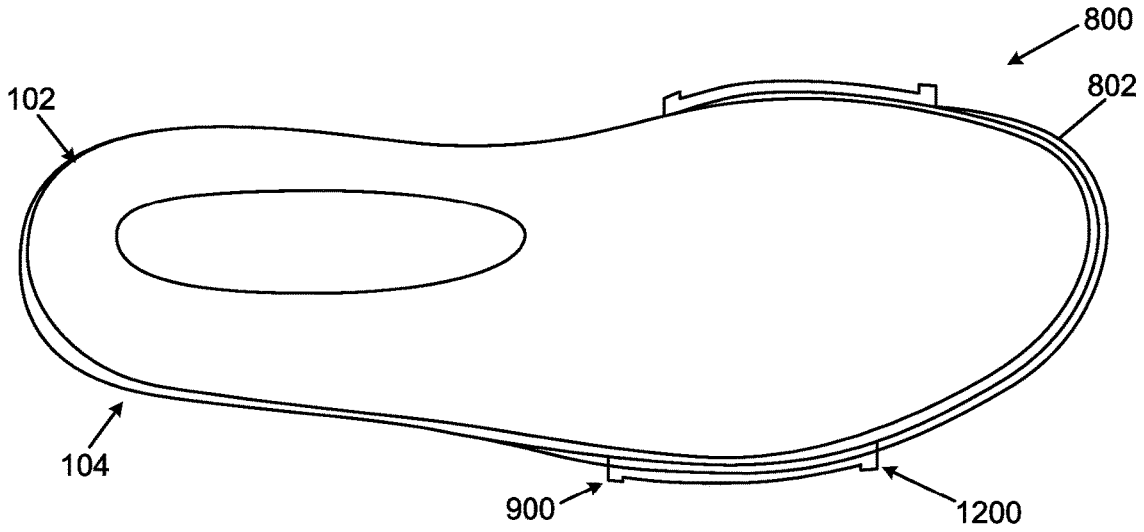
Figure 8D:
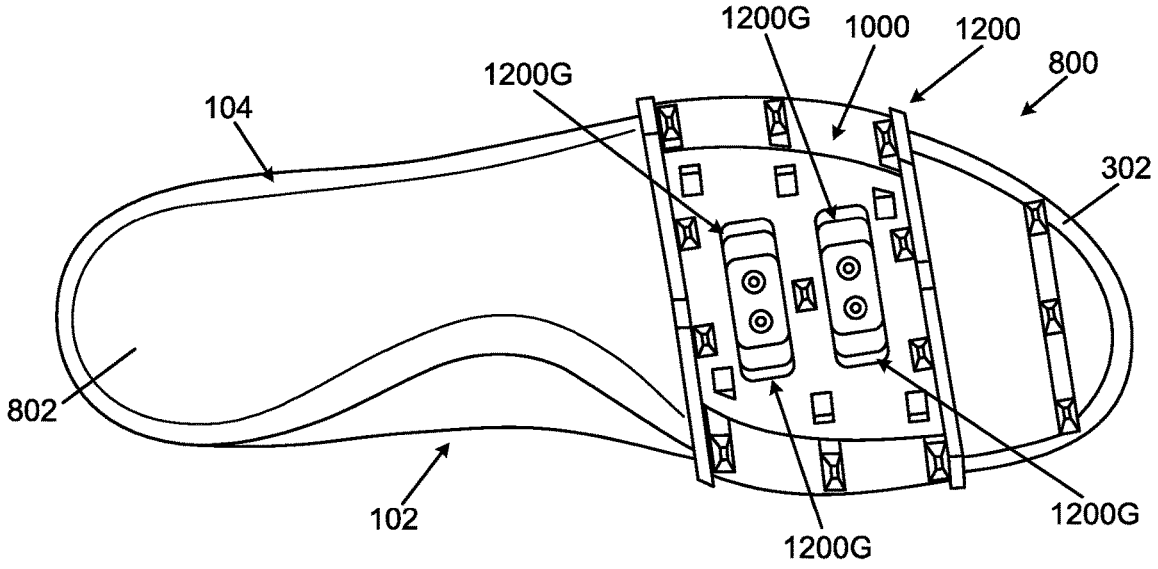

FIG. 8A provides a medial side view of article of footwear 800, FIG. 8B provides a lateral side view thereof, FIG. 8C provides a top view thereof, and FIG. 8D provides a bottom view thereof. This article of footwear 800 includes an upper 102 and a sole structure 104 engaged with the upper 102.

The sole structure 104 of this example footwear structure 800 is comprised of different component parts than that of the footwear structure 100 of FIGS. 1-7. These differences include different structural features for aspects of the "means for movably engaging" the various footwear components together. At least some of these differences will be described in more detail below.

In the structure of FIGS. 1A-7, the main sole component 200 included a recess 200R into which a separate top component 400 was secured, and top component 400 included structural features of the "means for movably engaging." In the example footwear structure 800 of FIGS. 8A-13B, however, the main sole component 802 directly includes structural features of part of the "means for movably engaging" rather than providing those components on a separate top component 400. In other words, in the footwear structure 800 of FIGS. 8A-13B as compared to the footwear structure 100 of FIGS. 1A-7, the top component 400 of the "means for movably engaging" is directly incorporated and integrally formed as part of the main sole component 802 rather than constituting a separate part. If desired, however, the sole structure 104 of FIGS. 1A-7 may include top component 400 integrally formed as part of the main sole structure (e.g., midsole 200) and/or the sole structure 104 of FIGS. 8A-13B may include a separate component that forms the structural features of top component 400.

The main sole component 802 of this example, which may include one or more component parts, includes an upper-facing surface 802U that supports an entire plantar surface of a wearer's foot (see FIG. 9C). This main sole component 802, or at least some portions thereof (and particularly the forefoot area where relative motion of parts occurs), may be made from relatively rigid materials. Examples include one or more metals (including alloys), one or more plastics (e.g., polyether block amines, thermoplastic polyurethanes, other thermoplastic elastomers, thermosetting polymers, fiber-reinforced polymers (e.g., carbon fiber materials), etc.), combinations of these materials, etc. While the specific example of FIGS. 8A-8D does not illustrate a foam or other midsole component, such a component could be included or integrally formed as part of main sole component 802, if desired (e.g., located atop upper-facing surface 802U, located beneath some or all portions of the plantar surface of a wearer's foot, etc.). The main sole component 802 may be configured to flex under an applied force during use and provide return energy to the wearer's foot as the applied force is released or sufficiently reduced.

The main sole component 802 now will be described in more detail with reference to FIGS. 9A-9F. FIG. 9A provides a lateral side view of the main sole component 802, FIG. 9B provides a lateral side view thereof, FIG. 9C provides a top view thereof, FIG. 9D provides a bottom view thereof, FIG. 9E provides a bottom, medial perspective view thereof, and FIG. 9F provides a bottom, lateral perspective view thereof. Reference number 900 identifies the portion of the main sole component 802 that includes structures and functions as the top component of the means for movably engaging in this illustrated example. The top component portion 900 may be made from the same material(s) described above for main sole component 802.

The forward edge 900F of top component portion 900 and/or the recess defined by it for receiving bottom component 1000 of this example structure may be located within any of the longitudinal location ranges described above for edge 200FE (e.g., forward of 0.7 L, forward of 0.75 L, or even forward of 0.8 L). The rearward edge 900R of top component portion 900 and/or the recess defined by it for receiving bottom component 1000 of this example structure may be located within any of the longitudinal location ranges described above for edge 200RE (e.g., forward of 0.4 L, forward of 0.45 L, or even forward of 0.5 L). In at least some examples of this technology, the overall longitudinal length of the top component portion 900 and/or the recess defined by it for receiving bottom component 1000 in this example structure may be between 0.2 L and 0.4 L. "L" in the discussion above constitutes the longitudinal length of the main sole component 802, the overall sole structure 104, and/or the footwear structure 800.

FIGS. 9D-9F further illustrate that the ground-facing surface 802G of the forefoot area of top component portion 900 includes: (a) an arched or curved lateral surface 400GL arching downward from a lateral side edge of the top component portion 900, the article of footwear 800, and/or the overall sole structure 104 and (b) an arched or curved medial surface 400GM arching downward from a medial side edge of the top component portion 900, the article of footwear 800, and/or overall sole component 104. If desired, and as shown in the example of FIGS. 9D-9F, the ground-facing surface 802G further may include a flat or curved central surface 400GC joining lateral surface 400GL and medial surface 400GM. Central surface 400GC is flatter than both of surfaces 400GL and 400GM in this example. The ground-facing surface 802G in the top component portion 900 may have any of the various size and shape options for the example structure described above for top component 400.

FIGS. 9D-9F further illustrate that the ground-facing surface 802G of sole component 802 within top component portion 900 is formed to include, or includes as part of a separately attached component, one or more channels 902T recessed into the surrounding base surface of the sole component 802. Four such channels 902T are shown in the example of FIGS. 9A-9F, although other numbers can be used without departing from at least some aspects of this technology. The four channels 902T are spaced in the longitudinal direction of the main sole component 802—two parallel rearward channels 902T and two parallel forward channels 902T. Also, the ground-facing surface 802G of sole component 802 within top component portion 900 of this example sole structure 104 is formed to include one or more structure(s) 904 (e.g., threaded holes) for engaging one or more retaining elements, as will be described in more detail below. Four such structures 904 (threaded holes in this example) are shown in FIGS. 9D-9F—two structures 904 located between the rearward parallel channels 902T and two structures 904 located between the forward parallel channels 902T. While other arrangements are possible, structures 904 between the pairs of parallel channels 902T are spaced in the lateral side-to-medial side direction. FIGS. 9D-9F further show tracks 902T located within surrounding recesses 930 (generally rectangular shaped in this example).

Because much of main sole component 802 of this example sole structure 104 is designed to contact the ground in use, if desired, some or any portion of the ground-facing surface 802G may be formed to include, or may include as a separately attached structure, one or more cleats 302 or other traction-enhancing elements. In this illustrated example sole structure 104, cleats 302 are provided only in the forefoot support area of the sole structure 104 (because sprint events typically are run on a runner's toes). Other cleat 302 arrangements are possible without departing from aspects of this technology.

FIGS. 10A-10E provide various views of a bottom component 1000 as follows: FIG. 10A provides a top view; FIG. 10B provides a bottom view; FIG. 10C provides a rear, top, lateral perspective view; FIG. 10D provides a rear, top, medial perspective view, and FIG. 10E provides a rear, medial, bottom perspective view. Bottom component 1000 includes an upper-facing surface 1000U and a ground-facing surface 1000G. The upper-facing surface 1000U of this illustrated example includes: (a) an arched or curved lateral surface 500UL arching downward from the lateral side edge of the bottom component 1000, the article of footwear 800, and/or the overall sole structure 104 toward the central region of the bottom component 1000 (and configured to face, contact, and/or lie adjacent the arched or curved lateral surface 400GL of top component portion 900) and (b) an arched or curved medial surface 500UM arching downward from the medial side edge of the bottom component 1000, the article of footwear 800, and/or overall sole component 104 toward a central region of the bottom component 1000 (and configured to face, contact, and/or lie adjacent the arched or curved medial surface 400GM of top component portion 900). If desired, and as shown in the example of FIGS. 10A and 10C-10E, the upper-facing surface 1000U further may include a flat or curved central surface 500UC configured to face, contact, and/or lie adjacent the flat or curved central surface 400GC of top component portion 900 (when present). The flat or curved central surface 500UC joins lateral surface 500UL and medial surface 500UM of upper-facing surface 1000U in this example. Central surface 500UC is flatter than both of surfaces 500UL and 500UM in this example.

The bottom component 1000 may be sized, shaped, and positioned so that its rearward edge 1000RE and forward edge 1000FE are located between: (a) the forward edge 900F of top component portion 900 (e.g., forward of 0.7 L, forward of 0.75 L, or even forward of 0.8 L) and (b) the rearward edge 900R of top component portion 900 (e.g., forward of 0.4 L, forward of 0.45 L, or even forward of 0.5 L). In at least some examples of this technology, the overall longitudinal length of the bottom component 1000 in this example structure may be between 0.2 L and 0.4 L. "L" in the discussion above constitutes the longitudinal length of the main sole component 802, the overall sole structure 104, and/or the footwear structure 800. Bottom component 1000 further includes one or more openings 1010 extending through it. Two longitudinally spaced openings 1010 are shown in the example structure of FIGS. 10A-10E. In this example, the two longitudinally spaced openings 1010 are substantially the same size and shape (but this is not a requirement).

FIGS. 10A-10E further illustrate that the upper-facing surface 1000U of bottom component 1000 is formed to include, or includes as part of one or more separately attached components, one or more tracks 1002T extending outward from the surrounding base surface of the bottom component 1000 (outward from central surface 500UC in this example). Four such tracks 1002T are shown in this example although other numbers can be used without departing from at least some aspects of this technology. The four tracks 1002T are spaced in the longitudinal direction of the bottom component 1000—two parallel rearward tracks 1002T and two parallel forward tracks 1002T. As shown in FIGS. 10A and 10B, the track(s) 1002T is/are positioned, sized, and shaped to extend beyond front and rear edges of and into the open area(s) of opening(s) 1010. The track(s) 1002T also is/are positioned, sized, and shaped to fit into the channel(s) 902T defined in top component portion 900, as will be described in more detail below.

In this illustrated example, the ground-facing surface 1000G of bottom component 1000 is designed to directly contact the ground in use. Thus, if desired (and as shown), the ground-facing surface 1000G may be formed to include, or may include as separately attached components, one or more traction elements 520 (e.g., track cleats, structures for engaging separately attached track spikes, and/or other traction-enhancing elements, of the types described above for FIGS. 3A, 3B, 5B, and 5C). Additionally or alternatively, if desired, at least some (or even all) of the ground-facing surface 1000G may be formed as a separate part including cleats, spikes, or other traction-enhancing elements that is engaged with the bottom surface of a component that includes other features of bottom component 1000.

FIG. 11 illustrates a retaining system 1100 (bottom view) included as part of the means for movably engaging in the footwear structure 800 of this example. This retaining system 1100 includes a retaining device base 1104 having through holes 1102 defined in it and positioned to axially align with the corresponding structures 904 (e.g., threaded holes) provided in the top component portion 900. The retaining system 1100 of this example further includes two connectors 1110 (e.g., threaded screws or bolts) that extend through holes 1102 and engage structures 904 to secure retaining device base 1104 with the main sole component 802.

Assembly of the sole structure 104 of FIGS. 8A-8D including the component parts of FIGS. 9A-11 will be described in conjunction with FIG. 12. This example process starts with the following separate component parts described above: (a) main sole component 802 (including integrally formed or separately attached top component portion 900); (b) bottom component 1000; and (c) two retaining systems 1100. First, as shown by arrow 1220 in FIG. 12, the bottom component 1000 is placed at top component portion 900 of main sole component 802 such that the upper-facing surface 1002U of the bottom component 1000 faces, lies adjacent, and/or contacts the ground-facing surface 802G of the main sole component 802. The bottom component 1000 is placed within a recess defined between the forward edge 900F and rearward edge 900R of top component portion 900. The bottom component 1000 is placed such that its tracks 1002T extend into corresponding channels 902T of the top component portion 900. In this manner, the recesses 910 of the top component portion 900 are exposed through the openings 1010 of the bottom component 1000. The channels 902T are longer in the medial side-to-lateral side direction of the sole structure 104 than are the tracks 1002T (to support the sliding/tilting/rotational action described in more detail below).

The upper-facing surface 1000U of bottom component 1000 may include one or more structures 1020 (e.g., recesses, holes, grooves, etc., see FIGS. 10A, 10C, 10D) that engage one or more corresponding structures 920 (e.g., raised ribs, pegs, etc., see FIGS. 9D-9F) on the ground-facing surface 802G in the top component portion 900 to help align and maintain these parts 900, 1000 in desired positions with respect to one another (provided the desired sliding/tilting/rotational action is not impeded). Additionally or alternatively, these structures 920, 1020 may act as stop members to limit the extent of relative slide/tilt/rotation of top component portion 900 with respect to bottom component 1000. In the illustrated example, these additional structures 920, 1020 are located at areas where: (a) the arched or curved lateral surfaces 400GL, 500UL meet the respective central surface 400GC, 500UC and (b) the arched or curved medial surfaces 400GM, 500UM meet the respective central surface 400GC, 500UC. Three pair of engaging structures 920, 1020 are shown on each side of sole structure 104, although more or fewer could be used without departing from at least some examples of this technology.

With the bottom component 1000 located at the top component portion 900 as described above, the top surfaces of tracks 1002 that extend into main openings 1010 of the bottom component 1000 (as shown in FIG. 10B) are exposed and extend along the channels 902T. The inner edges of the channels 902T are exposed through openings 1010. Retaining system 1100 bases 1104 then are engaged with the combined main sole component 802 and bottom component 1000 structure 1200 (shown by arrows 1230 in FIG. 12) by axially aligning their holes 1102 with the corresponding openings 904 in the top component portion 900 of main sole component 802. Connectors 1110 (part of the retaining system 1100) engage the retaining system 1100 bases 1104 with the top component portion 900 (see arrows 1240 in FIG. 12), e.g., using a threaded connection or other appropriate connection mechanism. These actions complete the sole structure 104 of this example (which may be engaged with an upper 102 at any appropriate time in the process).

The front-to-back dimensions of retaining system bases 1104 are sized and shaped in this example to correspond to the front-to-back dimensions of the corresponding openings 1010 in the bottom component 1000. Thus, as shown in FIG. 12 (as well as FIG. 8D), the front and rear edges of retaining system 1100 bases 1104 contact or lie immediately adjacent corresponding front and rear edges of the recesses 910. In this manner, the bottom surfaces of retaining system 1100 bases 1104 will extend over and/or contact the exposed top surfaces of the tracks 1002T in the opening 1010 to maintain the tracks 1002T within their respective channels 902T. But, as also shown in FIGS. 8D and 12, the lateral side and medial side edges of retaining system 1100 bases 1104 do not extend to simultaneously contact or lie immediately adjacent corresponding lateral side and medial side edges of the recesses 910. Rather, a gap 1200G may be provided on either or both sides between the lateral side and medial side edges of retaining system 1100 bases 1104 and the corresponding lateral side and medial side edges of the recesses 910 (depending on the relative positioning of the top component portion 900 with respect to the bottom component 1000). The gaps 1200G support the sliding/tilting/rotational action described in more detail below.

Thus, the sole structure 104 of FIGS. 1A-7 differs from the sole structure 104 of FIGS. 8A-13B in various structural features while still providing the same generally desired sliding/tilting/rotation motion at least at the forefoot area. As at least some specific examples, the sole structure 104 of FIGS. 1A-7 differs from that of FIGS. 8A-13B in that: (a) in the sole structure 104 of FIGS. 1A-7 the top component 400 includes raised tracks 402T while the bottom component 500 includes recessed channels 502T as part of the means for movably engaging, but (b) in the sole structure 104 of FIGS. 8A-13B the top component area 900 includes recessed channels 902T while the bottom component 1000 includes the raised tracks 1002T. If desired, however, in the structure of FIGS. 1A-7, one or more of the channels could be provided on the top component 400 and one or more of the tracks could be provided on the bottom component 500. Similarly, if desired, in the structure of FIGS. 8A-13B, one or more of the tracks could be provided on the top component portion 900 and one or more of the channels could be provided on the bottom component 1000.

Figure 13A:
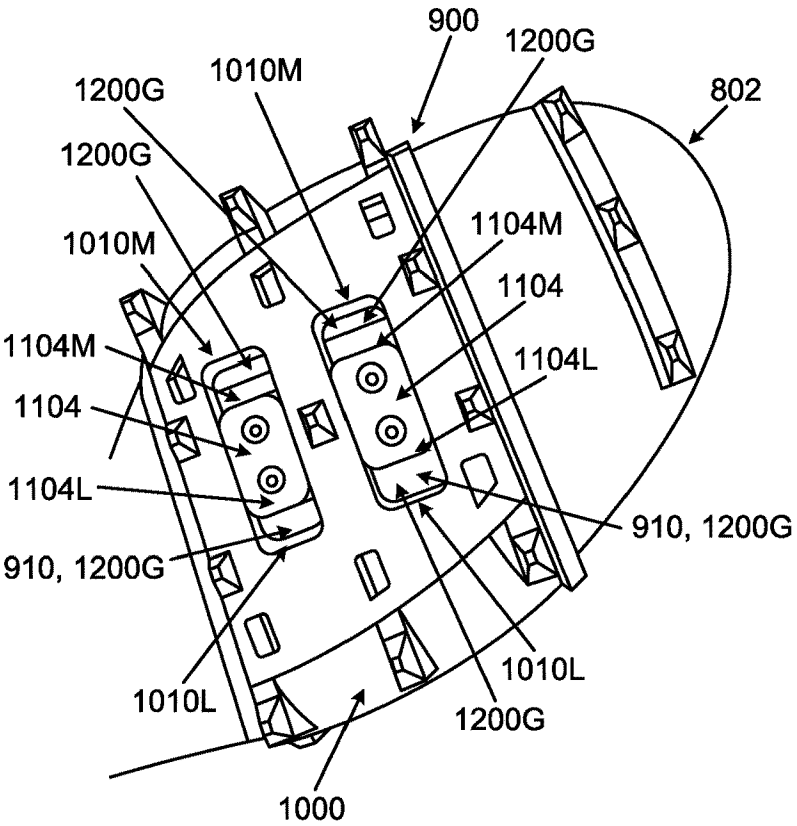

The sole structure 104 of FIGS. 8A-12 may function in a manner similar to that of FIGS. 1A-7. An example is shown in FIGS. 13A and 13B. In FIG. 13A, the top component portion 900 and bottom component 1000 are shown at a central or neutral position, e.g., with gaps 1200G between both: (a) the lateral side edges 1010L of openings 1010 and the lateral side edges 1104L of retaining bases 1104 and (b) the medial side edges 1010M of openings 1010 and the medial side edges 1104M of retaining bases 1104. From there, the main sole component 802 and the top component portion 900 thereof may shift either laterally or medially with respect to the bottom component 1000. FIG. 13B shows the top component portion 900 shifted to the lateral side with respect to bottom component 1000. As shown in this example, the retaining system 1100 bases 1104 (which are fixedly engaged with the top component portion 900 via connectors 1110 extending through openings 1102, 904) shift with respect to the bottom component 1000 until, at most, the lateral edges 1104L of retaining system 1100 bases 1104 abut lateral edges 1010L of openings 1010. Thus, the lateral edges 1104L and 1010L operate as stops on the lateral side (and similarly, the medial edges 1104M and 1010M can operate as stops on the medial side).

FIG. 13B further shows the bottom surfaces of tracks 1002T partially exposed and partially covered by the retaining systems 1100 to hold the tracks 1002T within the channels 902T of top component portion 900. Thus, during the same action described above, channels 902T of the top component portion 900 move (e.g., slide, rotate, tilt, etc.) with respect to the tracks 1002T of the bottom component 1000. In the example of FIGS. 13A and 13B, the top component portion 900 moves with respect to the bottom component 1000 until the medial ends 1002TE of the tracks 1002T reach the medial side edges 910E of recesses 910 defined in the ground-facing surface 802. When present, the medial ends 1002TE of the tracks 1002T and the medial side edges 910E of recesses 910 may function as stop members to prevent over rotation of the top component portion 900 with respect to the bottom component 1000. Additionally or alternatively, if desired, this same type of track end 1002TE and recess 910 edge 910E may be provided at the lateral sides of tracks 1002T and recess 910. These stop members (formed by abutting/contacting ends 1002TE and edges 910E) may be present to replace or in addition to any stop members formed by the edges 1104L, 1104M and the edges 1010L, 1010M of the opening 1010.

Figure 14A:
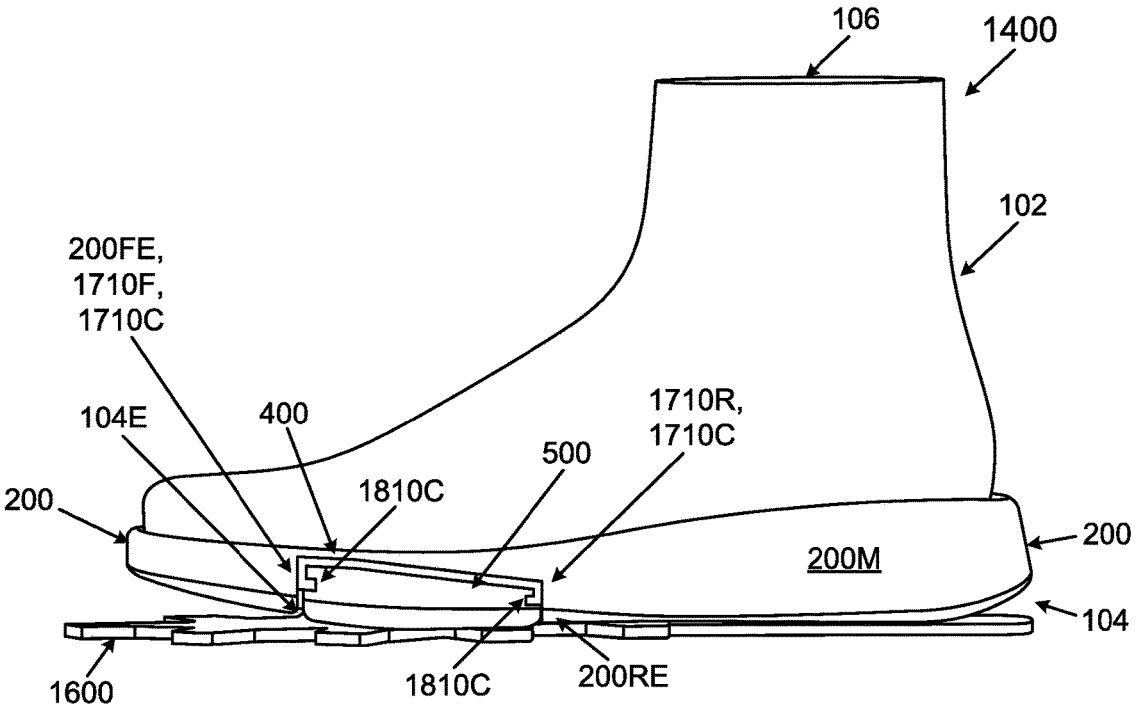
FIGS. 14A-14D provide various views of an article of footwear according to another example of this technology.
Figure 14B:
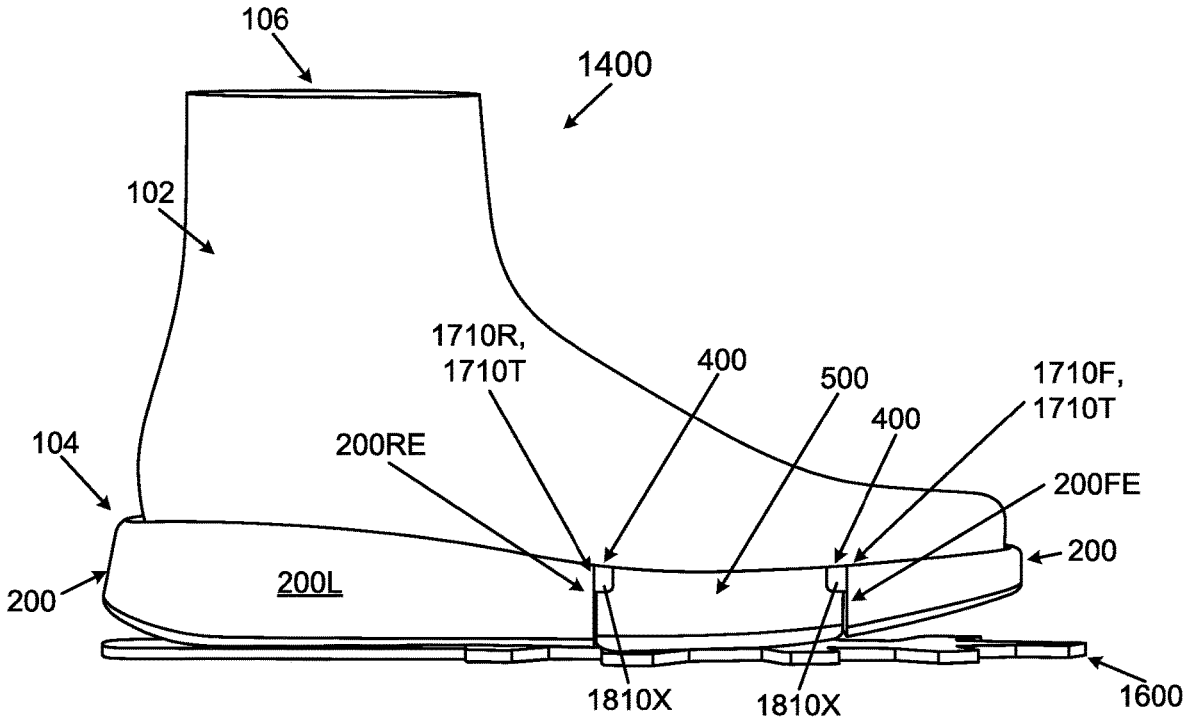
Figure 14C:
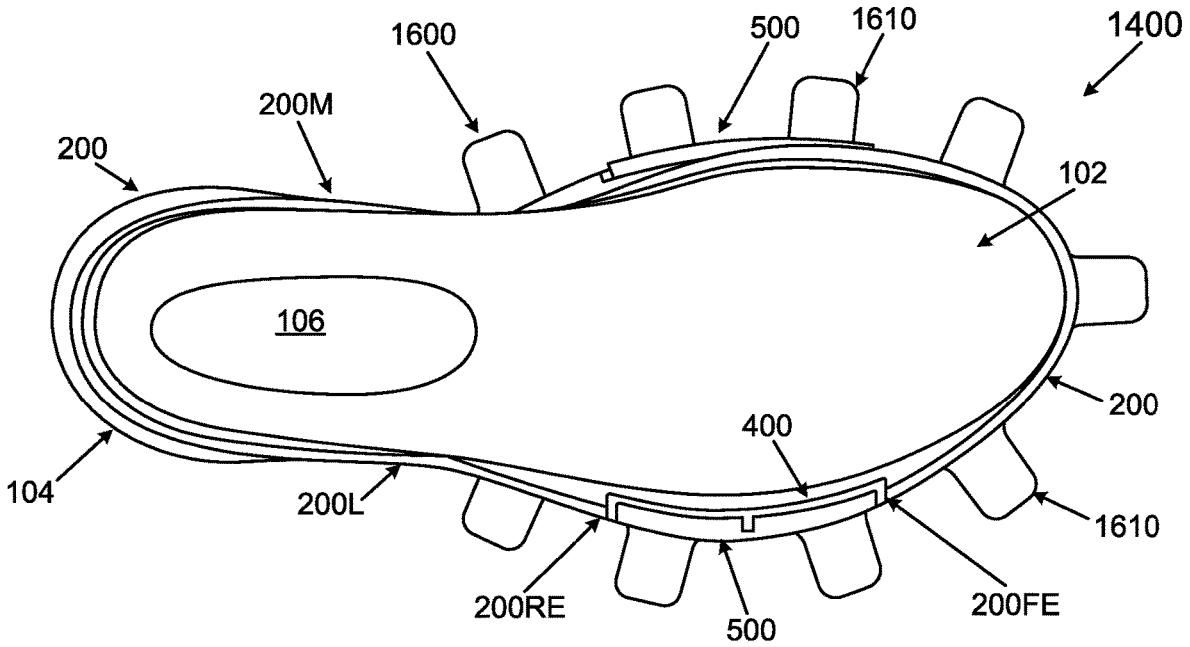
Figure 16:
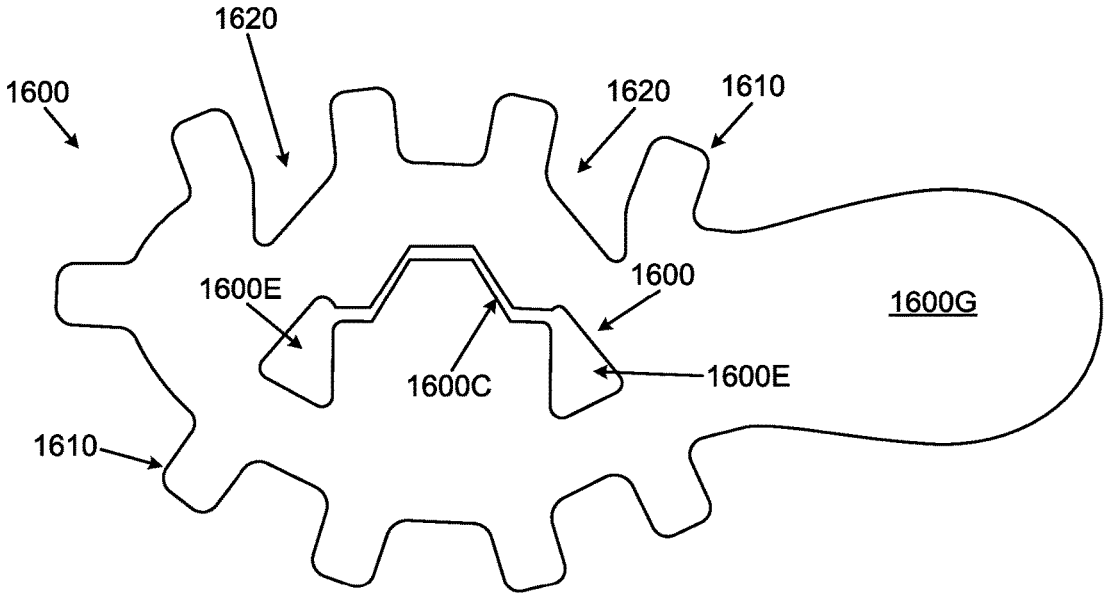
FIG. 16 illustrates an outsole component included in the article of footwear of FIGS. 14A-14D.
Figure 17A:
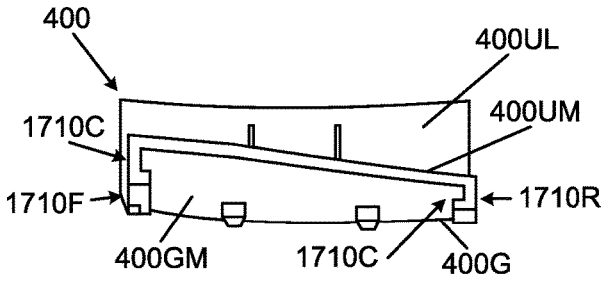
FIGS. 17A-17E provide various views of a top footwear component that provides relative movement features included in the article of footwear of FIGS. 14A-14D.
Figure 17B:
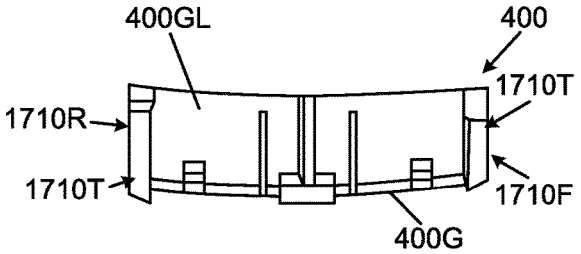
Figure 17C:
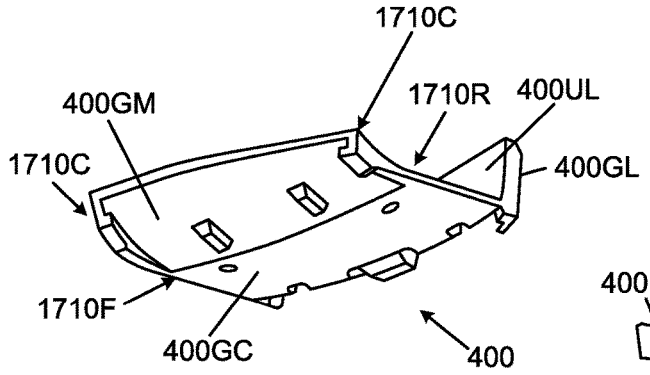
Figure 17D:
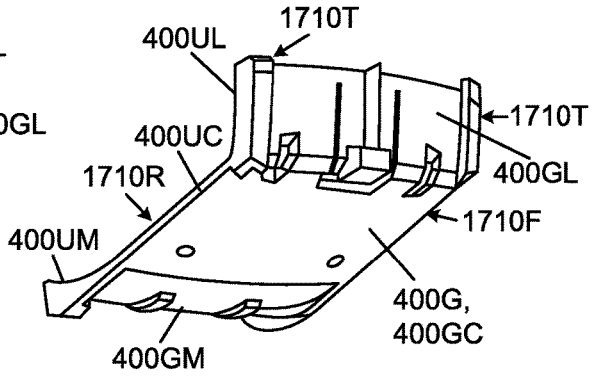
Figure 17E:
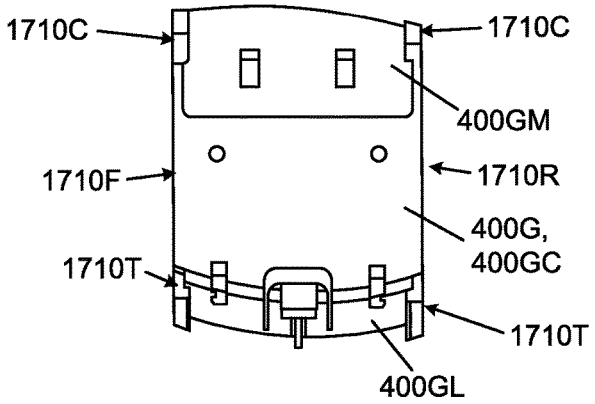
Figure 18A:
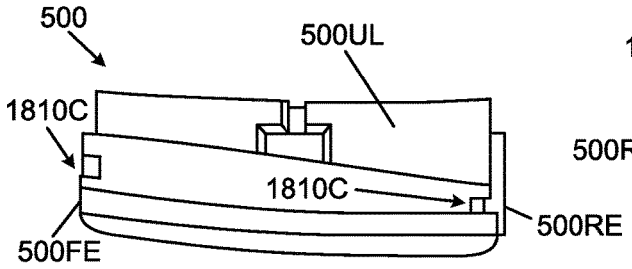
FIGS. 18A-18F provide various views of a bottom footwear component that provides relative movement features included in the article of footwear of FIGS. 14A-14D.
Figure 18B:
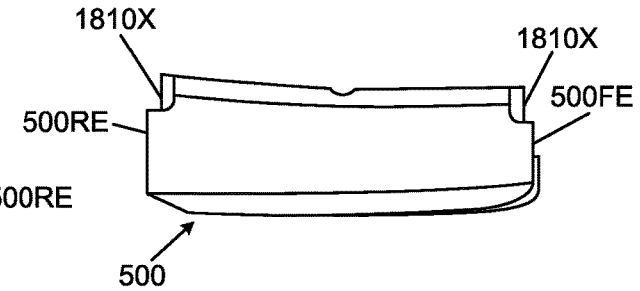
Figure 18C:
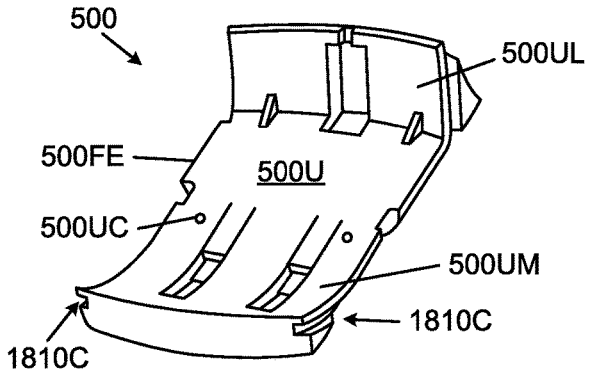
Figure 18D:
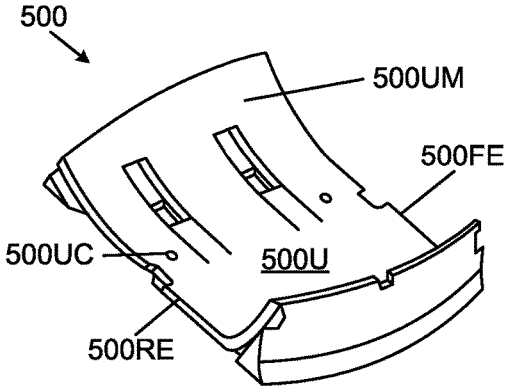
Figure 18E:
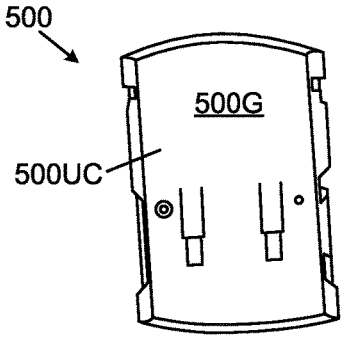
Figure 18F:
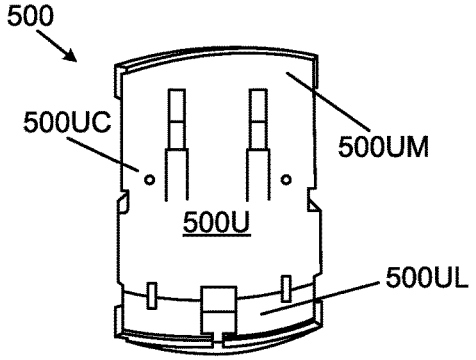
Figure 19A:
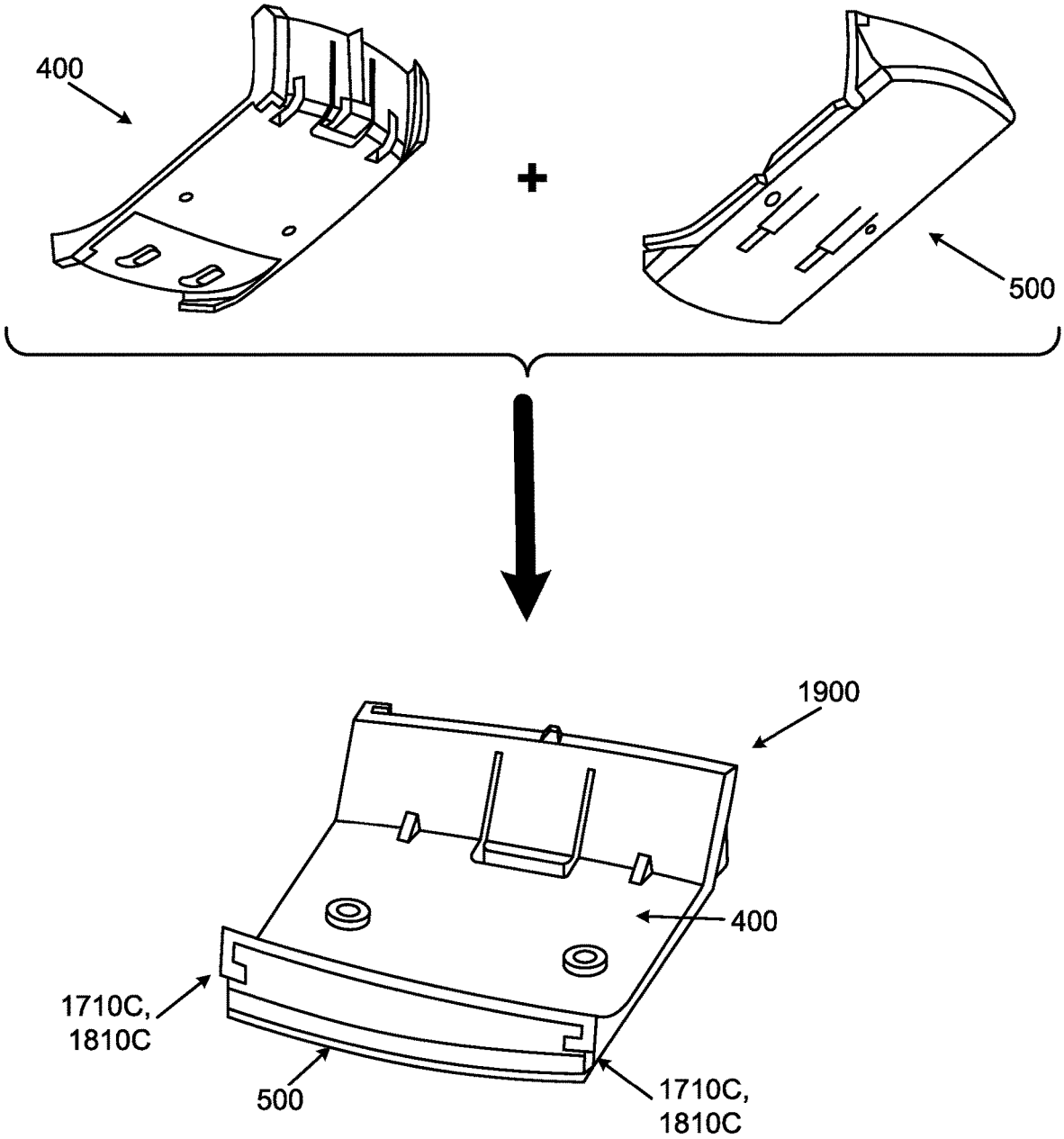
FIGS. 19A-19C illustrate assembly of the sole structure of the article of footwear of FIGS. 14A-14D.
Figure 19B:
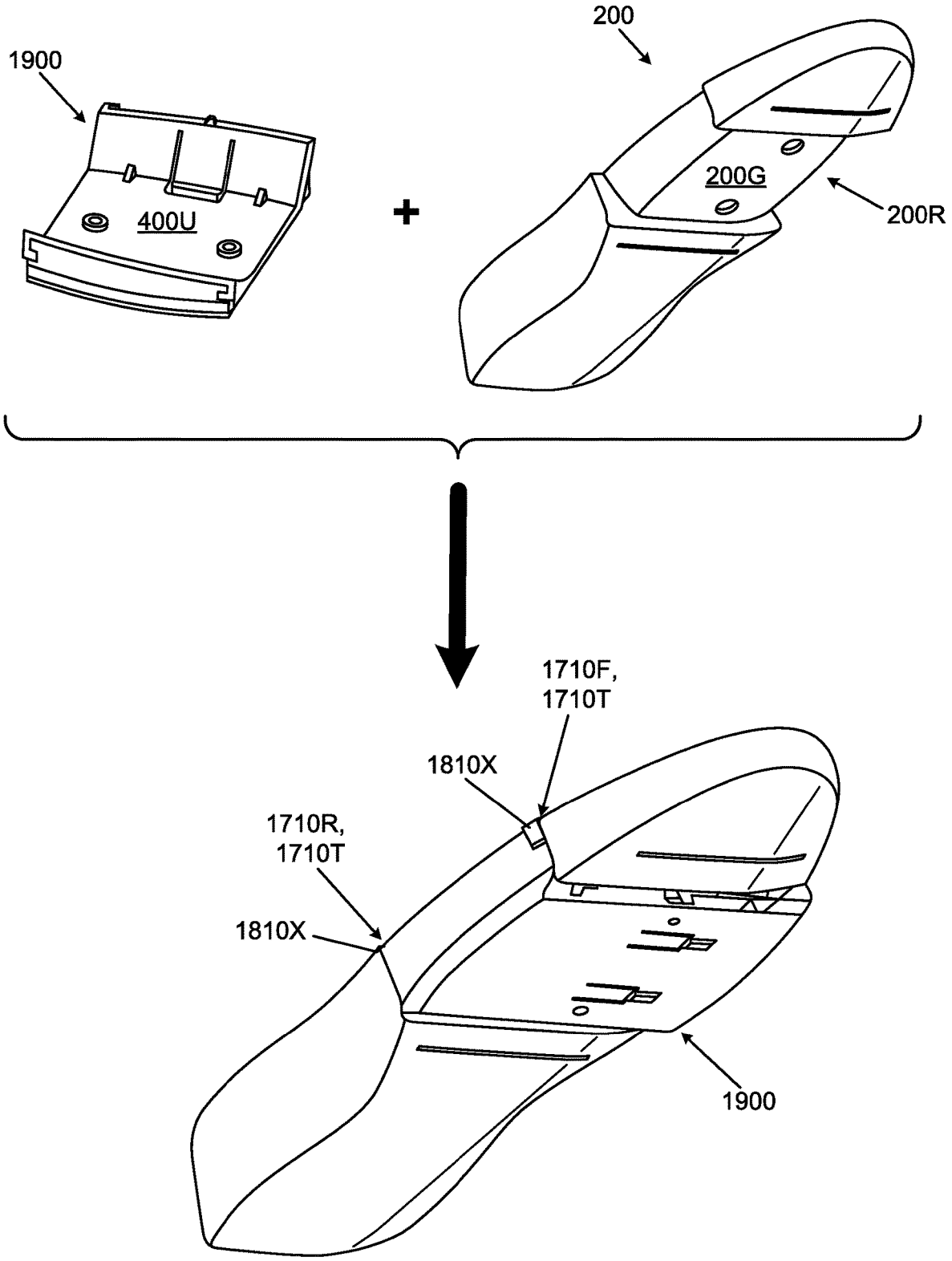
Figure 19C:
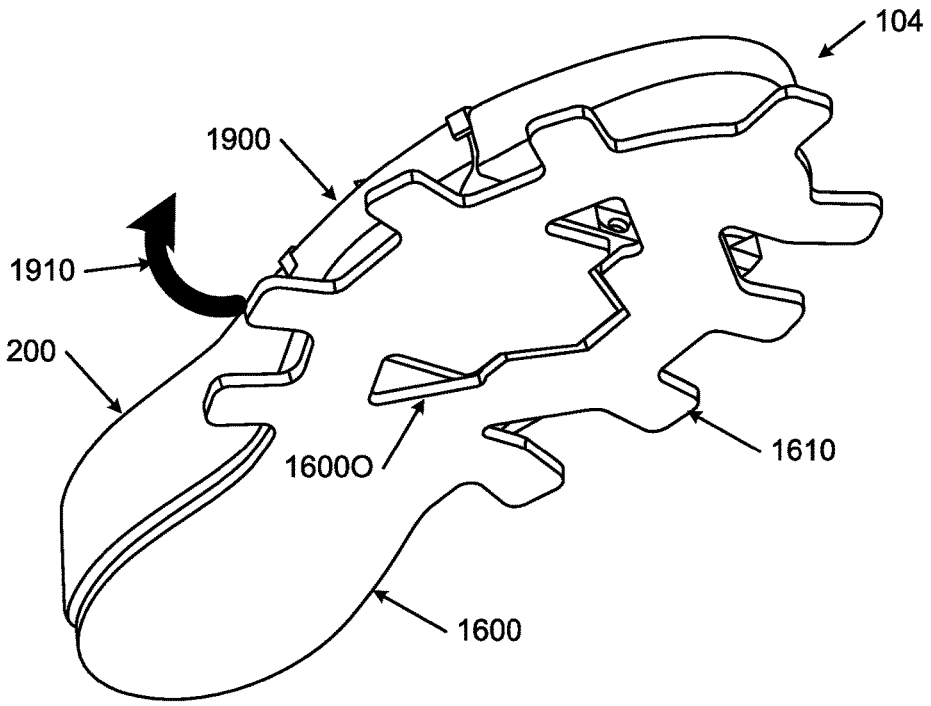

Another example article of footwear 1400 and its component parts are shown in FIGS. 14A-19C. FIG. 14A shows a medial side view of this example article of footwear 1400; FIG. 14B provides a lateral side view thereof; FIG. 14C provides a top view thereof; and FIG. 14D provides a bottom view thereof. FIG. 15A provides a medial side view of midsole component 200; FIG. 15B provides a lateral side view thereof; FIG. 15C provides a top view thereof; FIG. 15D provides a bottom view thereof; FIG. 15E provides a bottom, lateral perspective view thereof; and FIG. 15F provides a bottom, medial perspective view thereof. FIG. 16 provides a bottom view of outsole component 1600. FIGS. 17A-17E provide a medial side view, a lateral side view, a medial, bottom perspective view, a lateral bottom perspective view, and a bottom view, respectively, of top component 400. FIGS. 18A-18F provide a medial side view, a lateral side view, a medial, top perspective view, a lateral top perspective view, a bottom view, and a top view, respectively, of bottom component 500. FIGS. 19A-19C illustrate assembly of this example sole structure 104.

The component parts of this article of footwear 1400 are similar to those described above in conjunction with FIGS. 1A-7 (e.g., main midsole component 200, top component 400, bottom component 500, etc.). Thus, FIGS. 14A-19C use many of the same reference numbers as used in FIGS. 1A-7. Any of the characteristics, features, options, and/or alternatives for the component parts described in conjunction with FIGS. 1A-7 also may be provided in the component parts of FIGS. 14A-19C. For this reason, much of the repetitive discussion of these similar structures and/or features is omitted. The discussion below focuses primarily on structural differences between the examples of FIGS. 1A-7 v. the examples of FIGS. 14A-19C. While article of footwear 1400 is configured as a basketball shoe, aspects of this example footwear 1400 structure could be used in other types of footwear as well.

As shown in FIGS. 14A-14D and 16, one aspect of footwear structure 1400 that differs from the footwear structures described above relates to outsole component 1600. Outsole component 1600 of this example extends to form at least a majority of the ground-facing surface of the article of footwear 1400. In some examples of this technology, the outsole component 1600 may extend to form at least 60%, at least 75%, at least 80%, at least 90%, or even at least 95% of the ground-facing (and ground-contacting) surface of the article of footwear 1400, but less than 100% thereof. This outsole component 1600 further extends through one or more continuous paths from the forward-most toe area to the rearmost heel area of the article of footwear 1400 at its bottom ground-contacting surface 1600G. Thus, outsole component 1600 partially covers the bottom component 500 of the sole structure 104 that supports the forefoot sliding/tilting/rotational action, as will be described in more detail below. In this manner, outsole component 1600 spans across the junction of the ground-facing surface 200G of the midsole 200 and the ground-facing surface 500G of the bottom component 500 at both the forward and rearward edges thereof. The ground-facing surface 1600G of outsole component 1600 may include traction-enhancing features such as those conventionally used in basketball footwear (and/or other footwear) structures.

These noted figures further show that the outsole component 1600 includes an opening 1600O defined through it in the midfoot to forefoot area, beneath the footwear component parts 400, 500 that support the slide/tilt/rotational features. Note also FIG. 14D, which shows portions of midsole component 200 and at least bottom component 500 visible (and optionally exposed) through opening 1600O). The outsole component 1600 may be formed of sufficiently flexible material (e.g., rubbers, TPU's etc.) such that its opening 1600O can flex and change shape under an applied force, such as when top component 400 moves with respect to bottom component 500 under an applied sideways force. If necessary or desired, outsole component 1600 may be formed of a sufficiently elastic or stretchable material that will stretch under an applied sideways force and then return to its original shape when that force is sufficiently relaxed or removed. This elasticity or stretchability feature, when present, may help return the sole structure 104 to a neutral or untilted/unrotated configuration. In use, the channel 1600C will widen and pull apart when the top component 400 moves with respect to the bottom component 500 in a sideways direction and returns to the configuration of FIGS. 14D and 16 when these footwear component parts 400, 500 return to their neutral or central locations.

Figure 14D:
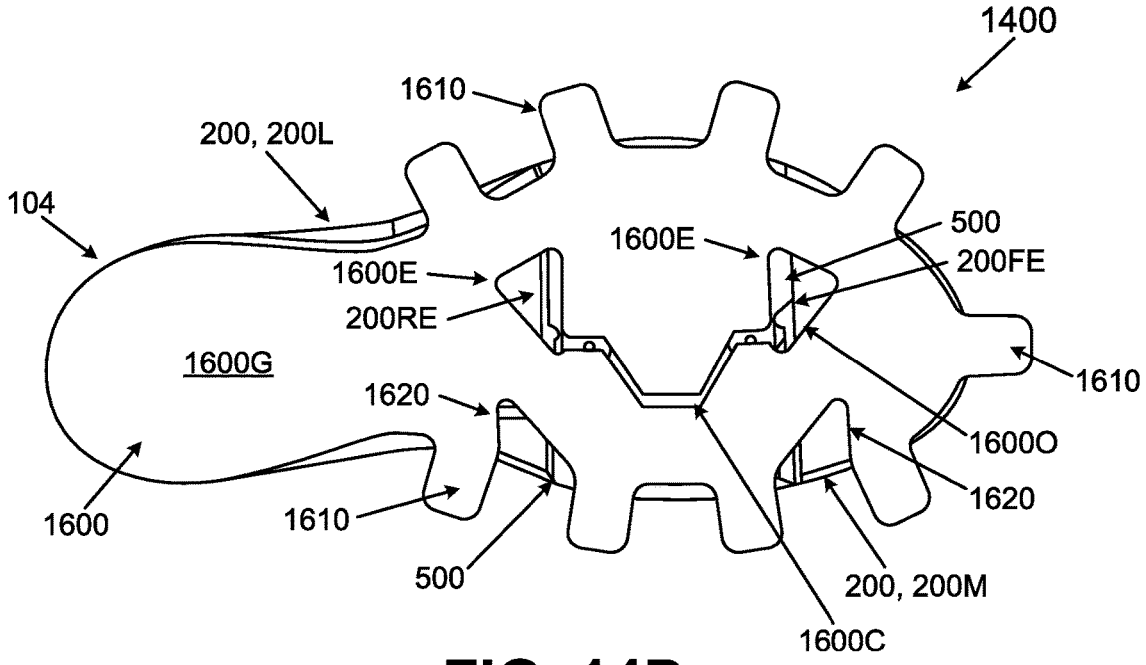
Figure 15A:
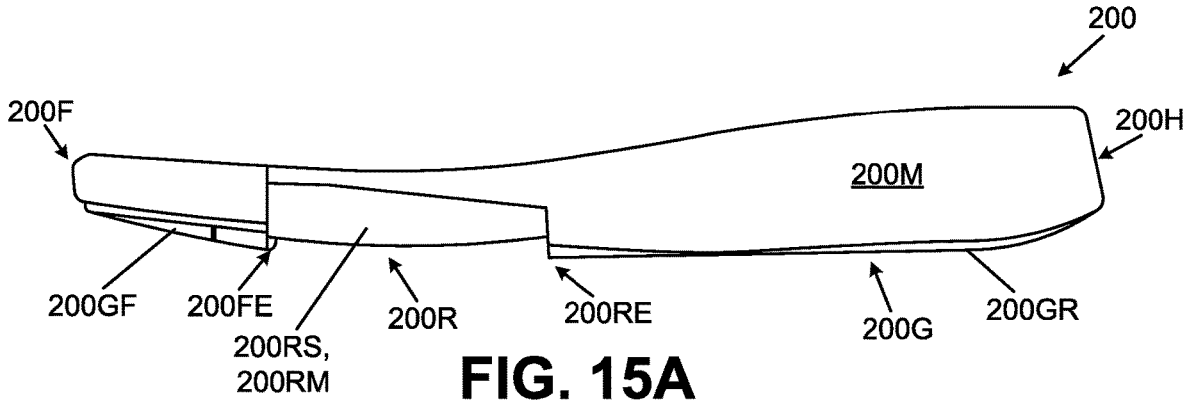
FIGS. 15A-15F provide various views of a main sole component (e.g., a midsole component) included in the article of footwear of FIGS. 14A-14D.
Figure 15B:
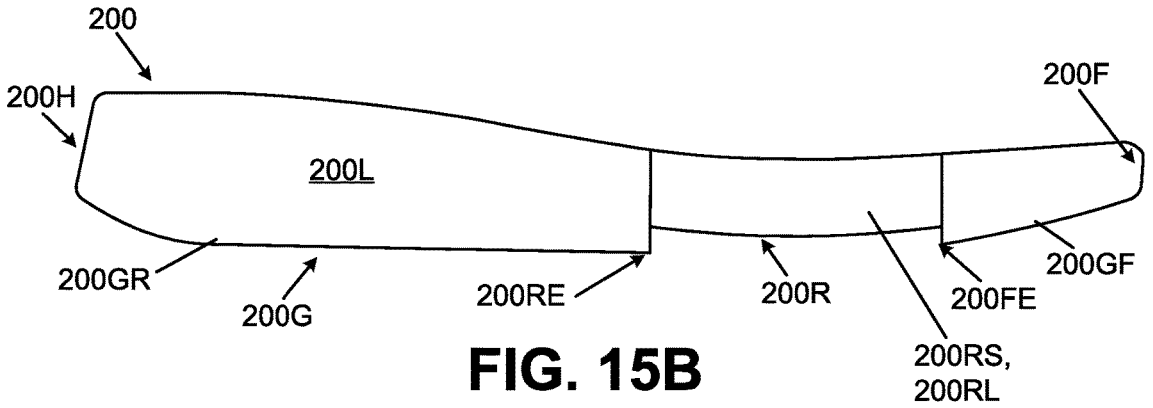
Figure 15C:
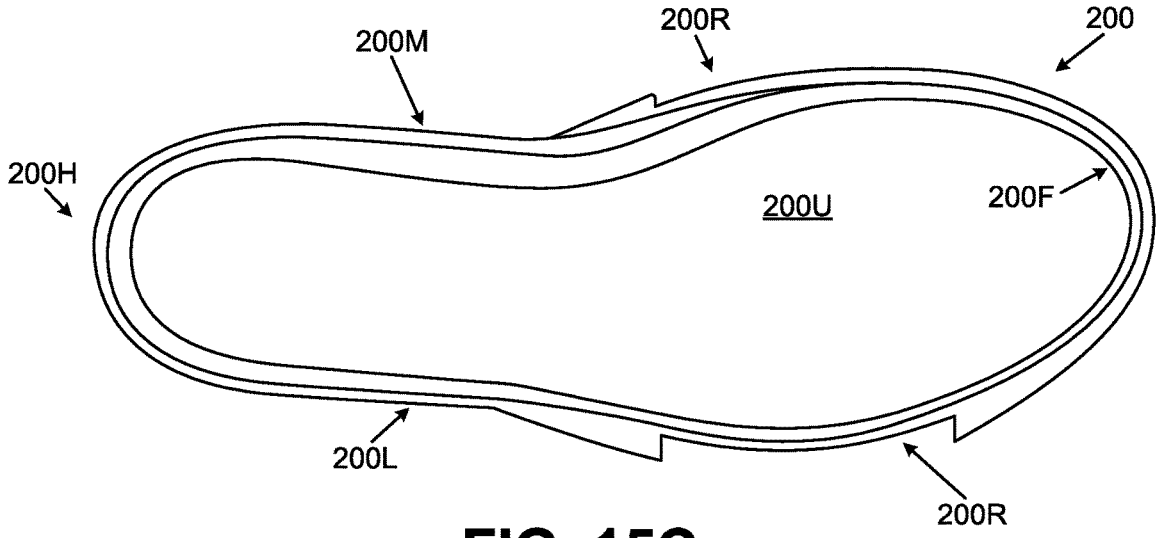
Figure 15D:
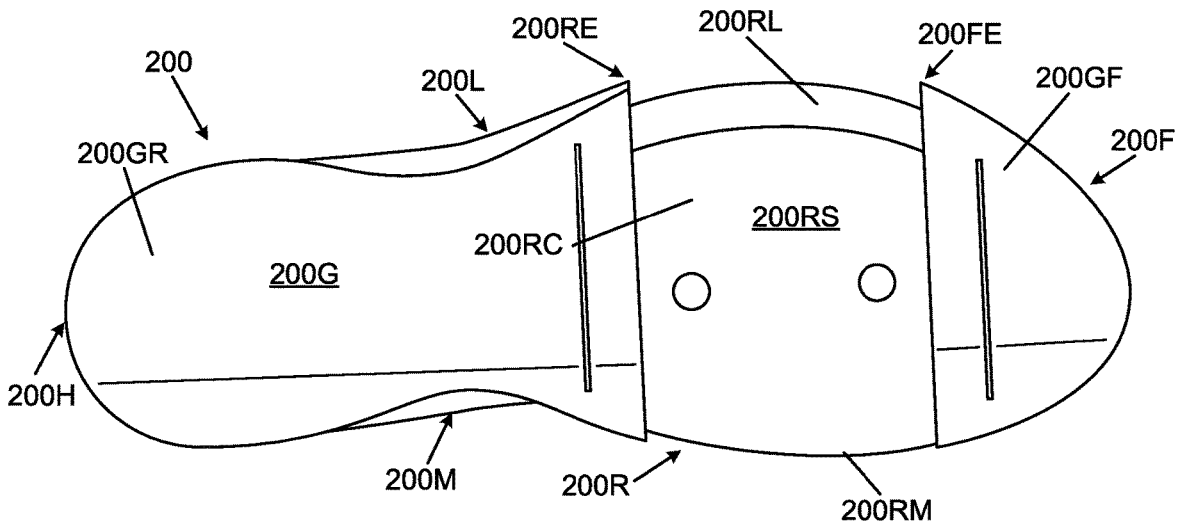
Figure 15E:
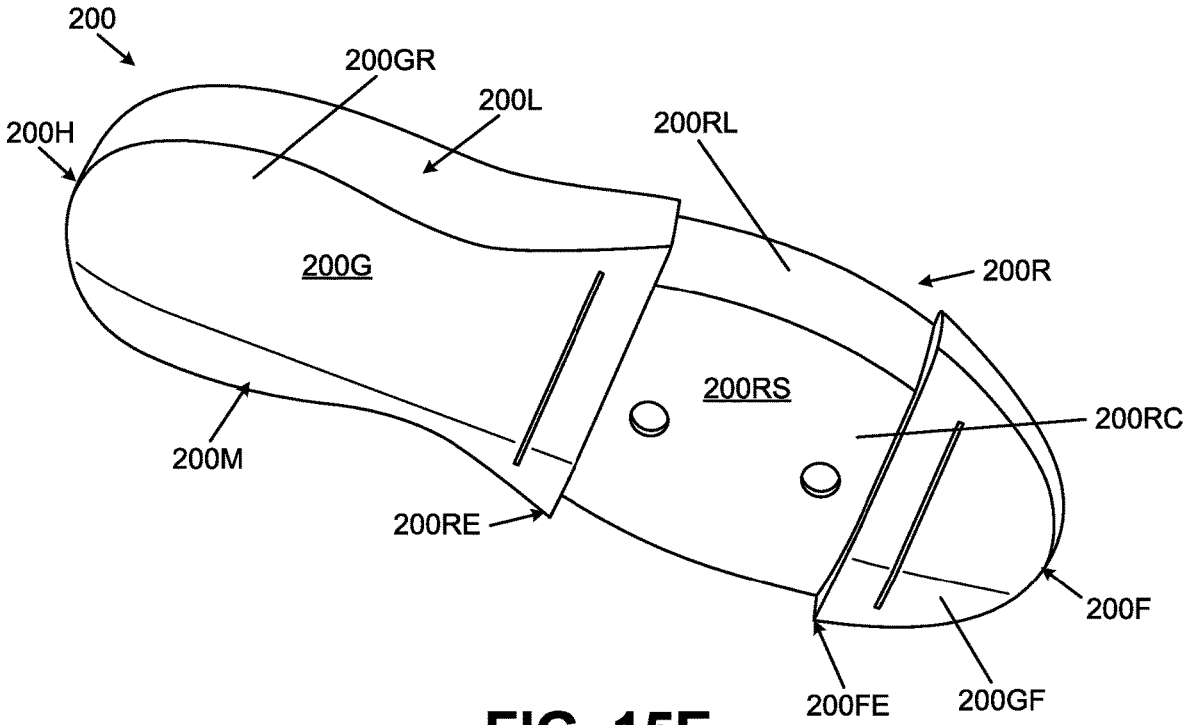
Figure 15F:
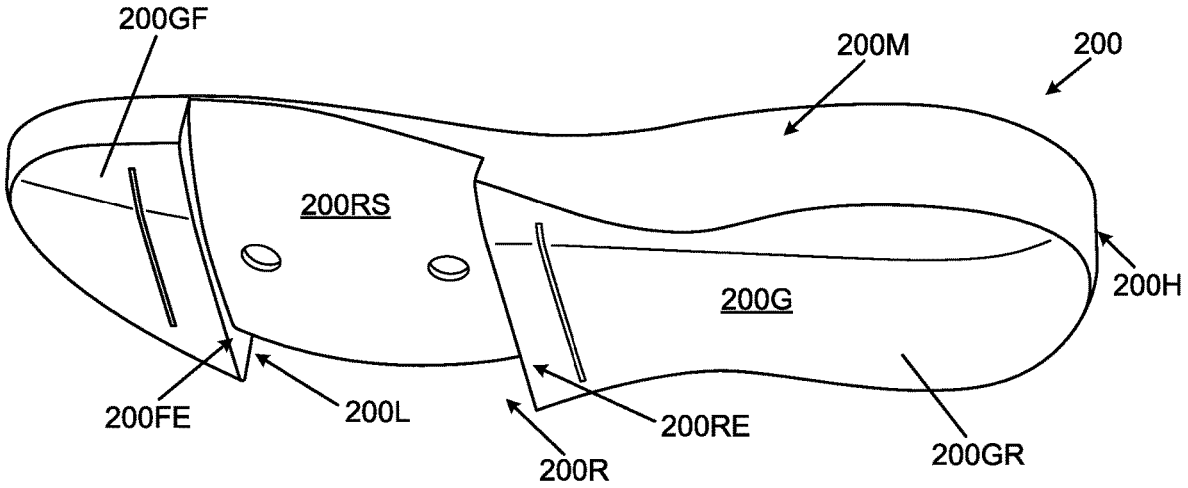

In its neutral or unloaded state (e.g., as shown in FIGS. 14D and 16), the opening 1600O includes relatively large forward and rearward end openings 1600E (e.g., 100 $mm^2$ to 500 $mm^2$) connected by a continuous channel 1600C (e.g., less than 10 mm wide). At its center, the channel 1600C also extends toward the medial side edge of the sole structure 104 from each of the end openings 1600E, e.g., in a somewhat U-shaped or V-shaped path, such that the lateral edges of the large end openings 1600E are located closer to the lateral side edge of the sole structure 104 than is the channel 1600C. Further, this example outsole component 1600 includes forward and rearward cutout areas 1620 (e.g., generally triangular shaped) at the medial side through which a portion of the forward edge 200FE and rearward edge 200RE of the midsole component 200 and the bottom component 500 are exposed. These cutout areas 1620 may be sized (at the bottom surface of the sole structure 104) within a range of (e.g., 100 $mm^2$ to 1000 $mm^2$). In contrast, the lateral side of outsole component 1600 of this example extends substantially flush or aligned with the outer lateral side edge of midsole component 200 and does not include similar cutout areas.

FIGS. 14A-14D and 16 further show that the outsole component 1600 of this example includes plural extensions 1610. During assembly, when the outsole component 1600 is attached to the ground-facing surface 200G of the midsole component 200 and the ground-facing surface 500G of bottom component 500 (e.g., by adhesives), these extensions 1610 are wrapped upward to engage outer side surfaces 200L, 200M of the midsole component 200 and outer side surfaces 500L, 500M of the bottom component 500. These side extensions 1610 also may include traction-enhancing features such as those included on the ground-facing surface 1600G (e.g., herringbone tread raised cylinders or ridges, etc.). These side extensions 1610 may provide additional traction, e.g., during extreme cutting, starting, stopping, and/or direction change actions (as commonly occur in basketball and other activities). This specific example shows nine spaced apart side extensions 1610 located from the medial midfoot area, around the forefoot area, to the lateral midfoot area (with four extensions 1610 on each side and one forward toe extension 1610). Other numbers, combinations, sizes, and shapes of such extensions 1610 may be provided, however, in some examples of this technology.

The sole structure 104 of FIGS. 14A-19C also differs from that of FIGS. 1A-7 in the structures through which footwear component parts 400, 500 are movably engaged with one another (and thus forming differences in the structures of the means for movably engaging these footwear component parts 400, 500). In the footwear component parts 400, 500 of FIGS. 17A-18F, at least some of the structures of the means for movably engaging these components together are provided at the front and rear end surfaces or the front and rear end areas of the footwear component parts 400, 500. For example, as shown in FIGS. 17A and 17C (as well as FIGS. 14A and 19A), at the medial side, the forward edge 1710F and rearward edge 1710R of top component 400 form a downwardly extending "C-shaped" edge 1710C at least at a portion of the arched or curved medial surface 400GM. The bottommost portion of C-shaped edge 1710C forms a track that extends into and engages a corresponding channel 1810C provided in the bottom component 500. Also, the space defined between the upper surface of the bottommost portion of C-shaped edge 1710C and the arched or curved medial surface 400GM defines a channel that receives a track of the bottom component 500. See FIGS. 14A and 19A. At the lateral side, the forward edge 1710F and rearward edge 1710R of top component 400 form track 1710T along at least at a portion of the arched or curved lateral surface 400GL. These tracks 1710T extend into and engage a corresponding channel 1810X provided in the bottom component 500. See FIGS. 14B, 17B, 17D, 17E, and 19B.

FIGS. 18A-18F illustrate the bottom component 500 for this example article of footwear 1400 and other differences in the structures of the means for movably engaging footwear component parts 400, 500 together. For example, as shown in FIGS. 18A and 18C (as well as FIGS. 14A and 19A), at the medial side, the forward edge 500FE and rearward edge 500RE of bottom component 500 form a "C-shaped" edge 1810C spaced downward from upper-facing surface 500U. The recesses of these C-shaped edges 1810C form channels that receive the tracks formed by the bottommost portion of the C-shaped edge 1710C of top component 400. The forward and rearward extending surfaces that form the tops of C-shaped edges 1810C form tracks that extend into and engage the channels defined by the spaces between the upper surfaces of the bottommost portion of C-shaped edge 1710C and the arched or curved medial surface 400GM of top component 400. These front and rear joints between footwear component parts 400, 500 also are referred to in this specification as types of "tongue and groove joints." See FIGS. 14A and 19A. At the lateral side, the forward edge 500FE and rearward edge 500RE of bottom component 500 includes channels 1810X that extend along at least portions of the arched wall surfaces. These channels 1810X receive the tracks 1710T formed along at least a portion of the arched or curved lateral surface 400GL of top component 400. See FIGS. 14B, 18B, and 19B.

FIGS. 19A-19C illustrate relevant portions of the assembly of sole structure 104. As shown in FIG. 19A, first the top component 400 is engaged with the bottom component 500 by engaging the corresponding tracks and channels described above (e.g., including the C-shaped components 1710C, 1810C on the medial side and the tracks 1710T and channels 1810X on the lateral side). These footwear component parts 400, 500 are not fixedly engaged together, although the shapes of the tracks and channels may prevent them from pulling apart from one another in the top-to-bottom direction. The combined footwear component parts 400, 500 constitute a relatively slidable/tiltable/rotatable component 1900. As shown in FIG. 19B, the relatively slidable/tiltable/rotatable component 1900 may be permanently engaged within the recess 200R of midsole component 200. This may be accomplished, for example, by fixing the upper-facing surface 400U of top component 400 with the ground-facing surface 200G in the recess 200R of midsole component 200, e.g., by an adhesive. This fixed arrangement allows the bottom component 500 to slide/tilt/rotate with respect to the midsole component 200, which is fixed to the top component 400. After this step, the top surface of outsole component 1600 may be attached to the ground-facing surfaces 200G, 500G. See FIG. 19C.

Also, when present, the outsole extensions 1610 may be attached to sidewall surface(s) of the midsole component 200 and/or the bottom component 500, as described above and as shown by arrow 1910 in FIG. 19C. In this illustrated example, four extensions 1610 engage with sidewalls of bottom component 500—with two extensions 1610 longitudinally spaced at the lateral side and two extensions 1610 longitudinally spaced at the medial side. One extension 1610 engages the medial sidewall of midsole component 200 rearward of the bottom component 500 and another extension 1610 engages the medial sidewall of midsole component 200 forward of the bottom component 500. Similarly, one extension 1610 engages the lateral sidewall of midsole component 200 rearward of the bottom component 500 and another extension 1610 engages the lateral sidewall of midsole component 200 forward of the bottom component 500. See also FIG. 14D. One extension 1610 engages the forward toe midsole 200 sidewall at the forward toe location. These connections maintain a stable outsole 1600 connection while still allowing the opening 1600O to expand and return and/or while still allowing the outsole component 1600 material to stretch when the top component 400 moves with respect to the bottom component 500.

Figure 20A:
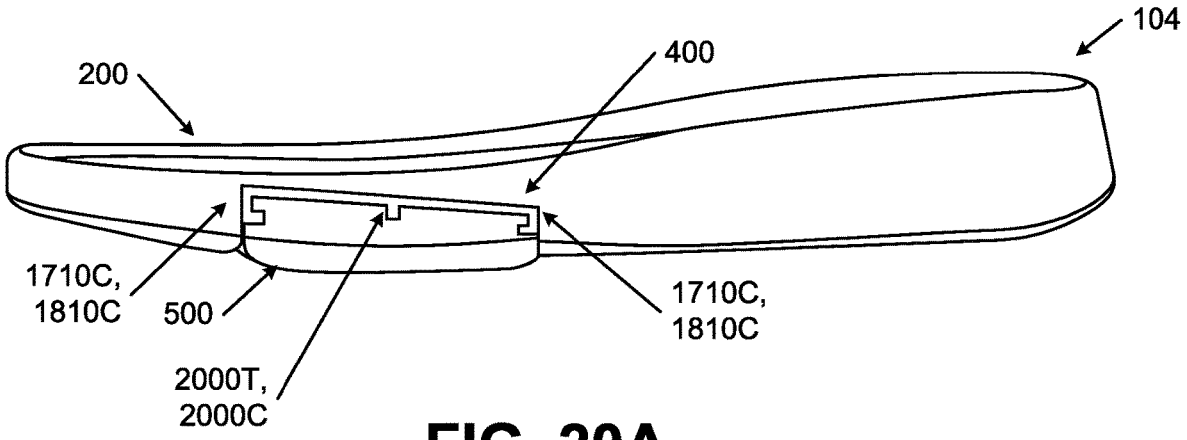
FIGS. 20A-20C illustrate various features of another example sole structure according to aspects of this technology.
Figure 20B:
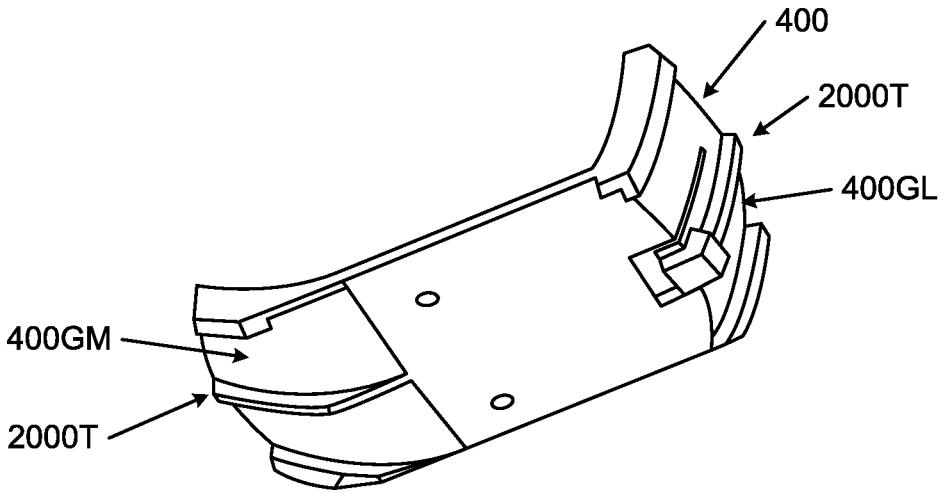
Figure 20C:
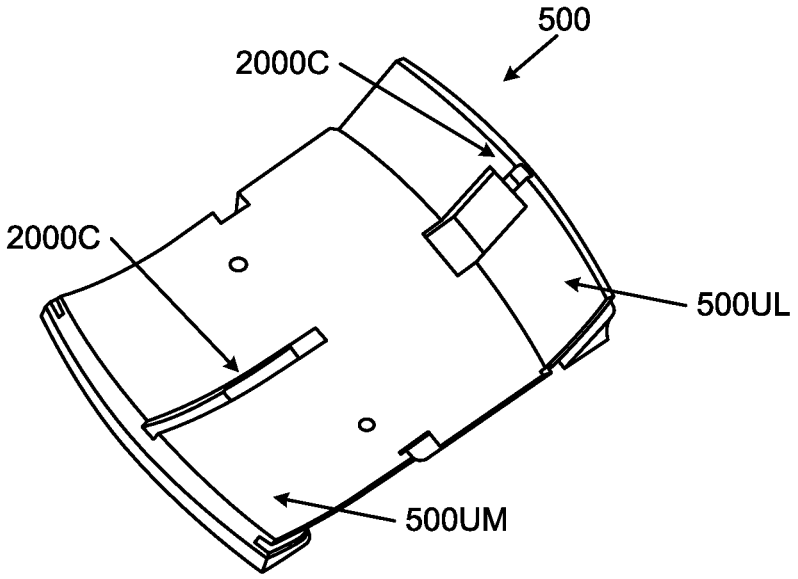

FIGS. 20A-20C illustrate at least a portion of a sole structure 104 that is structurally similar to that described above in conjunction with FIGS. 14A-19C (and thus several of the same reference numbers are used) but with some variations in the top component 400 and bottom component 500. These variations constitute variations in the means for movably engaging footwear component parts 400, 500 together. FIG. 20A shows a medial side view of this sole structure 104; FIG. 20B shows a bottom perspective view of the top component 400 thereof; and FIG. 20C shows a top perspective view of the bottom component 500 thereof. In addition to the specific engaging parts and structures shown at the forward edges and rearward edges of footwear component parts 400, 500 in FIGS. 14A-19C, this top component 400 includes intermediate tracks 2000T at the lateral and medial sides of its ground-facing surface 400G. These intermediate tracks 2000T extend into and engage intermediate channels 2000C provided in the lateral and medial sides of the bottom component 500 at its upper-facing surface 500U. "Intermediate" in this context means between the forward and rearward edges of the respective footwear component part 400, 500. More than one such intermediate track 2000T/intermediate channel 2000C sets may be provided on either or both sides of the footwear component parts 400, 500. The intermediate track 2000T/intermediate channel 2000C set(s) may help provide more secure engagement of the footwear component parts 400, 500 and may help reduce undesired play and/or relative wobbling of these footwear component parts 400, 500 with respect to one another in the longitudinal direction of the sole structure 104. The sole structure 104 of FIGS. 20A-20C may include any of the other various features of the sole structure 104 of FIGS. 14A-19C, including any variations, options, or alternatives associated with the sole structure 104 of FIGS. 14A-19C, without departing from aspects of this technology. Also, the tracks 2000T and channels 2000C may include any of the features of the similar parts described above in conjunction with FIGS. 1A-7.

As described above, aspects of this technology allow at least a forefoot region corresponding to the location of top footwear component part 400, 900 and the bottom component 500, 1000 to tilt, rotate, and/or slide laterally and/or medially with respect to one another. If desired, stop members of any of the types described above may be provided to limit or even eliminate such tilt, rotation, and/or slide in one sideways direction or the other.

Figure 21:
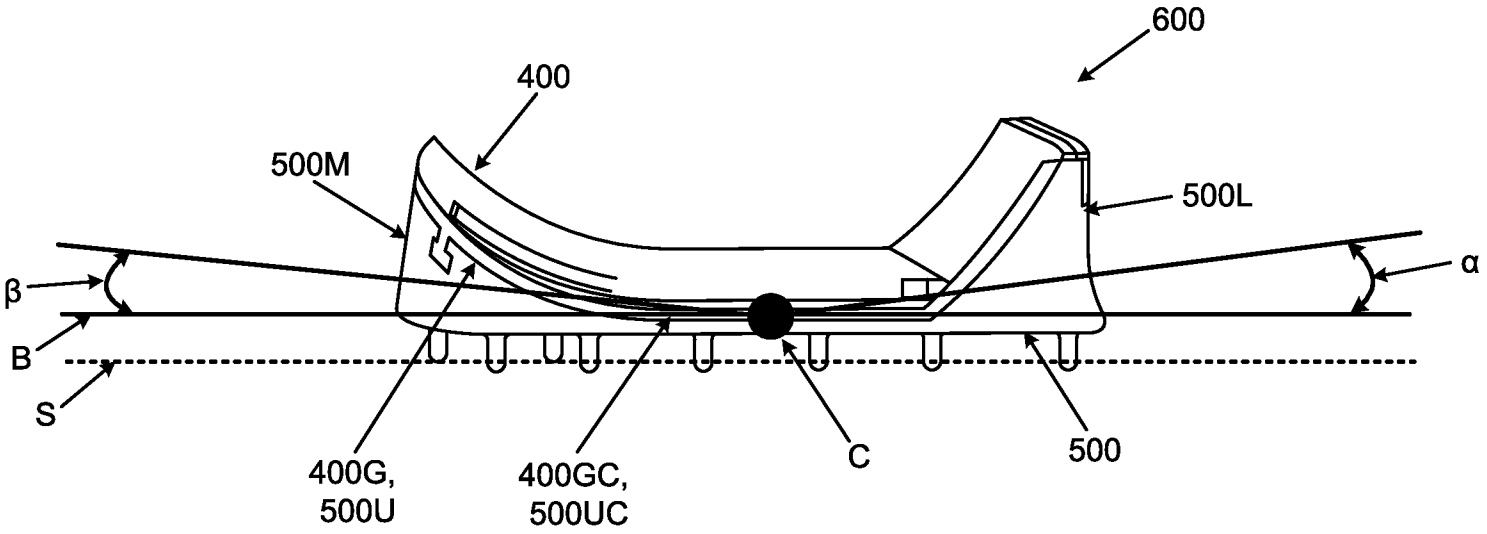
FIG. 21 provides additional information regarding relative motion characteristics of various footwear component parts according to aspects of this technology.

FIG. 21 illustrates a rear view of the combined aggregate part 600 formed by top component 400 (or top component portion 900) and bottom component 500 (or 1000). The view of FIG. 21 looks down the axial direction of slide/tilt/rotation from the heel toward the toe with the aggregate part 600 supported on a support surface S. In the orientation of FIG. 21, the aggregate part 600 is in a neutral position (e.g., with top component 400 positioned at the bottom of its movable extent with respect to the bottom component 500 and/or with the two footwear component parts 400, 500 centered with respect to one another). This neutral base orientation is shown by line B in FIG. 21, which extends along and is in contact with the junction of facing central surfaces 400GC, 500UC of footwear component parts 400, 500 at their lowest points/surfaces (e.g., tangent point). Line B may or may not be parallel to surface S. In use, the bottom component 500 typically will be planted on the ground or other contact surface S (and may be temporarily fixed with respect to surface S). A sideways force, either laterally or medially, may be applied to move (e.g., slide, tilt, rotate) the ground-facing surface 400G of top component 400 with respect to the upper-facing surface 500U of the bottom component 500. An example angle of tilt in the lateral direction is shown as angle α in FIG. 21 (tilt about central point C with respect to base surface B). An example angle of tilt in the medial direction is shown as angle β in FIG. 21 (tilt about central point C with respect to base surface B). The upper tilt limits of angles α and β may be controlled, e.g., by stop members, as described above. While the upper tilt limits of angles α and β may be the same, in some aspects of this technology, the upper tilt limit on angle α may be greater than that of angle β (so that the tilt in the lateral direction may extend farther than the tilt in the medial direction).

In some examples of this technology, the footwear component parts 400, 500 may be structured and configured to allow tilt/rotation about an angle α of at least 2 degrees, and in some examples within at least any of the following ranges: at least 4 degrees; at least 6 degrees; at least 8 degrees; within the range of 2 degrees to 20 degrees; within the range of 3 degrees to 18 degrees; or within the range of 4 degrees to 15 degrees. Additionally or alternatively, in some examples of this technology, the footwear component parts 400, 500 may be structured and configured to allow rotation about an angle α of at least 0.5 degrees, and in some examples within at least any of the following ranges: at least 1 degree; at least 2 degrees; at least 4 degrees; within the range of 0 degrees to 16 degrees; within the range of 1 degree to 14 degrees; or within the range of 2 degrees to 12 degrees. In some examples of this technology, relative tilt/rotation in the medial direction may be stopped (angle (β's tilt limit at 0 degrees). In other examples, the tilt/rotation may be allowed to the same extent on both sides. The relative movement (e.g., tilt, rotation, etc.) takes place about an axis that extends in the heel-to-toe direction of the sole structure 104 and the article of footwear containing it, which may be a substantially horizontal axis (e.g., ±10 degrees from horizontal) when the sole structure 104 and/or article of footwear containing it is oriented on its ground-facing surface on a horizontal base surface S in an unloaded condition (with no force applied to it other than the weight of the footwear components themselves).

III. Conclusion

The present invention is disclosed above and in the accompanying drawings with reference to a variety of embodiments. The purpose served by the disclosure, however, is to provide an example of the various features and concepts related to the invention, not to limit the scope of the invention. One skilled in the relevant art will recognize that numerous variations and modifications may be made to the embodiments described above without departing from the scope of the present invention, as defined by the appended claims.

For the avoidance of doubt, the present application includes at least the subject matter described in the following numbered Clauses:

Clause 1. A sole structure for an article of footwear, comprising:

a first footwear component including a ground-facing surface, wherein a forefoot portion of the ground-facing surface includes: (a) an arched medial surface arching downward from a medial side edge of the sole structure toward a central region of the first footwear component, and (b) an arched lateral surface arching downward from a lateral side edge of the sole structure toward the central region of the first footwear component;

a second footwear component including an upper-facing surface, wherein a forefoot portion of the upper-facing surface includes: (a) an arched medial surface arching downward from a medial side edge of the second footwear component toward a central region of the second footwear component and facing the arched medial surface of the first footwear component, and (b) an arched lateral surface arching downward from a lateral side edge of the second footwear component toward the central region of the second footwear component and facing the arched lateral surface of the first footwear component; and means for movably engaging the first footwear component with the second footwear component such that: (a) the arched medial surface of the first footwear component moves with respect to and along the arched medial surface of the second footwear component and (b) the arched lateral surface of the first footwear component moves with respect to and along the arched lateral surface of the second footwear component.

Clause 2. An article of footwear, comprising:

a first footwear component including a ground-facing surface, wherein a forefoot portion of the ground-facing surface includes: (a) an arched medial surface arching downward from a medial side edge of the article of footwear toward a central region of the first footwear component, and (b) an arched lateral surface arching downward from a lateral side edge of the article of footwear toward the central region of the first footwear component;

a second footwear component including an upper-facing surface, wherein a forefoot portion of the upper-facing surface includes: (a) an arched medial surface arching downward from a medial side edge of the second footwear component toward a central region of the second footwear component and facing the arched medial surface of the first footwear component, and (b) an arched lateral surface arching downward from a lateral side edge of the second footwear component toward the central region of the second footwear component and facing the arched lateral surface of the first footwear component; and means for movably engaging the first footwear component with the second footwear component such that: (a) the arched medial surface of the first footwear component moves with respect to and along the arched medial surface of the second footwear component and (b) the arched lateral surface of the first footwear component moves with respect to and along the arched lateral surface of the second footwear component.

Clause 3. The sole structure or the article of footwear according to Clause 1 or 2, wherein: (a) the arched medial surface of the first footwear component includes an axial direction extending in a heel-to-toe direction of the article of footwear; (b) the arched medial surface of the second footwear component includes an axial direction extending in the heel-to-toe direction of the article of footwear; (c) the arched lateral surface of the first footwear component includes an axial direction extending in the heel-to-toe direction of the article of footwear; and/or (d) the arched lateral surface of the second footwear component includes an axial direction extending in the heel-to-toe direction of the article of footwear.

Clause 4. The sole structure or the article of footwear according to any one of Clauses 1 to 3, wherein the means for movably engaging the first footwear component with the second footwear component rotates the first footwear component with respect to the second footwear component about an axis extending in a heel-to-toe direction of the article of footwear.

Clause 5. The sole structure or the article of footwear according to any one of Clauses 1 to 3, wherein the means for movably engaging the first footwear component with the second footwear component: (a) slides the arched medial surface of the first footwear component with respect to and along the arched medial surface of the second footwear component and (b) slides the arched lateral surface of the first footwear component with respect to and along the arched lateral surface of the second footwear component.

Clause 6. The sole structure or the article of footwear according to any one of Clauses 1 to 5, wherein the means for movably engaging the first footwear component with the second footwear component includes: (a) a first track provided at the ground-facing surface of the first footwear component, and (b) a first channel provided at the upper-facing surface of the second footwear component, wherein the first track is engaged with the first channel.

Clause 7. The sole structure or the article of footwear according to Clause 6, wherein the means for movably engaging the first footwear component with the second footwear component further includes: (a) a second track provided at the ground-facing surface of the first footwear component, and (b) a second channel provided at the upper-facing surface of the second footwear component, wherein the second track is engaged with the second channel.

Clause 8. The sole structure or the article of footwear according to Clause 7, wherein each of the first track and the second track is provided on the arched medial surface of the first footwear component and each of the first channel and the second channel is provided on the arched medial surface of the second footwear component.

Clause 9. The sole structure or the article of footwear according to Clause 7, wherein each of the first track and the second track is provided on the arched lateral surface of the first footwear component and each of the first channel and the second channel is provided on the arched lateral surface of the second footwear component.

Clause 10. The sole structure or the article of footwear according to Clause 7, wherein: (a) the first track is provided on the arched medial surface of the first footwear component, (b) the second track is provided on the arched lateral surface of the first footwear component, (c) the first channel is provided on the arched medial surface of the second footwear component, and (d) the second channel is provided on the arched lateral surface of the second footwear component.

Clause 11. The sole structure or the article of footwear according to any one of Clauses 6 to 10, wherein the means for movably engaging the first footwear component with the second footwear component further includes: (a) a third track provided at the ground-facing surface of the first footwear component, and (b) a third channel provided at the upper-facing surface of the second footwear component, wherein the third track is engaged with the third channel.

Clause 12. The sole structure or the article of footwear according to Clause 11, wherein the third track is provided on the arched medial surface of the first footwear component and the third channel is provided on the arched medial surface of the second footwear component.

Clause 13. The sole structure or the article of footwear according to Clause 11, wherein the third track is provided on the arched lateral surface of the first footwear component and the third channel is provided on the arched lateral surface of the second footwear component.

Clause 14. The sole structure or the article of footwear according to any one of Clauses 6 to 11, wherein the means for movably engaging the first footwear component with the second footwear component further includes: (a) a fourth track provided at the ground-facing surface of the first footwear component, and (b) a fourth channel provided at the upper-facing surface of the second footwear component, wherein the fourth track is engaged with the fourth channel.

Clause 15. The sole structure or the article of footwear according to Clause 14, wherein: (a) the third track is provided on the arched medial surface of the first footwear component, (b) the third channel is provided on the arched medial surface of the second footwear component, (c) the fourth track is provided on the arched lateral surface of the first footwear component, and (d) the fourth channel is provided on the arched lateral surface of the second footwear component.

Clause 16. The sole structure or the article of footwear according to any one of Clauses 1 to 5, wherein the means for movably engaging the first footwear component with the second footwear component includes: (a) a first channel provided at the ground-facing surface of the first footwear component, and (b) a first track provided at the upper-facing surface of the second footwear component, wherein the first track is engaged with the first channel.

Clause 17. The sole structure or the article of footwear according to Clause 16, wherein the means for movably engaging the first footwear component with the second footwear component further includes: (a) a second channel provided at the ground-facing surface of the first footwear component, and (b) a second track provided at the upper-facing surface of the second footwear component, wherein the second track is engaged with the second channel.

Clause 18. The sole structure or the article of footwear according to Clause 17, wherein each of the first channel and the second channel is provided at the central region of the first footwear component and each of the first track and the second track is provided at the central region of the second footwear component.

Clause 19. The sole structure or the article of footwear according to any of Clauses 17 or 18, wherein the means for movably engaging the first footwear component with the second footwear component further includes a first retaining element secured to the first footwear component to hold the first track in the first channel and to hold the second track in the second channel.

Clause 20. The sole structure or the article of footwear according to any of Clauses 17 or 18, wherein the means for movably engaging the first footwear component with the second footwear component further includes a first retaining element secured to the first footwear component to hold the first track in the first channel, and a second retaining element secured to the first footwear component to hold the second track in the second channel.

Clause 21. The sole structure or the article of footwear according to any one of Clauses 17 to 20, wherein the means for movably engaging the first footwear component with the second footwear component further includes: (a) a third channel provided at the ground-facing surface of the first footwear component, and (b) a third track provided at the upper-facing surface of the second footwear component, wherein the third track is engaged with the third channel.

Clause 22. The sole structure or the article of footwear according to Clause 21, wherein the third channel is provided at the central region of the first footwear component and the third track is provided at the central region of the second footwear component.

Clause 23. The sole structure or the article of footwear according to any one of Clauses 21 or 22, wherein the means for movably engaging the first footwear component with the second footwear component further includes: (a) a fourth channel provided at the ground-facing surface of the first footwear component, and (b) a fourth track provided at the upper-facing surface of the second footwear component, wherein the fourth track is engaged with the fourth channel.

Clause 24. The sole structure or the article of footwear according to Clause 23, wherein the fourth channel is provided at the central region of the first footwear component and the fourth track is provided at the central region of the second footwear component.

Clause 25. The sole structure or the article of footwear according to Clause 23 or 24, wherein the means for movably engaging the first footwear component with the second footwear component further includes: (a) a first retaining element secured to the first footwear component to hold the first track in the first channel and to hold the second track in the second channel, and (b) a second retaining element secured to the first footwear component to hold the third track in the third channel and to hold the fourth track in the fourth channel.

Clause 26. The sole structure or the article of footwear according to any one of Clauses 1 to 5, wherein the means for movably engaging the first footwear component with the second footwear component includes a tongue and groove joint joining a forward end of the first footwear component with a forward end of the second footwear component.

Clause 27. The sole structure or the article of footwear according to any one of Clauses 1 to 5 or 26, wherein the means for movably engaging the first footwear component with the second footwear component includes a tongue and groove joint joining a rearward end of the first footwear component with a rearward end of the second footwear component.

Clause 28. The sole structure or the article of footwear according to Clause 27, wherein the tongue and groove joint joining the rearward end of the first footwear component with the rearward end of the second footwear component is located at a medial side of the first footwear component and at a medial side of the second footwear component.

Clause 29. The sole structure or the article of footwear according to any one of Clauses 26 to 28, wherein the tongue and groove joint joining the forward end of the first footwear component with the forward end of the second footwear component is located at a medial side of the first footwear component and at a medial side of the second footwear component.

Clause 30. The sole structure or the article of footwear according to any one of Clauses 1 to 5 or 26 to 29, wherein the means for movably engaging the first footwear component with the second footwear component includes a first track located at a forward end of the first footwear component joined with a first channel located at a forward end of the second footwear component.

Clause 31. The sole structure or the article of footwear according to any one of Clauses 1 to 5 or 26 to 30, wherein the means for movably engaging the first footwear component with the second footwear component includes a first channel located at a rearward end of the first footwear component joined with a first track located at a rearward end of the second footwear component.

Clause 32. The sole structure or the article of footwear according to any one of Clauses 30 or 31, wherein each of the first track and the first channel is located at a lateral side of the article of footwear.

Clause 33. The sole structure or the article of footwear according to any preceding Clause, further comprising: a midsole component including a ground-facing surface having a recess defined therein, wherein the first footwear component is a separate part fixedly engaged with the ground-facing surface of the midsole component in the recess.

Clause 34. The sole structure or the article of footwear according to any preceding Clause, wherein the second footwear component does not extend to a heel region of the article of footwear.

Clause 35. The sole structure or the article of footwear according to any preceding Clause, wherein the first footwear component extends continuously from a heel region to a forefoot region of the article of footwear and is configured to support an entire plantar surface of a wearer's foot.

Clause 36. The sole structure or the article of footwear according to any one of Clauses 1 to 34, wherein the first footwear component does not extend to a heel region of the article of footwear.

Clause 37. The sole structure or the article of footwear according to any preceding Clause, wherein a ground-facing surface of the first footwear component includes a plurality of golf spikes or track spikes integrally formed or engaged with it.

Clause 38. The sole structure or the article of footwear according to any preceding Clause, further comprising: an outsole component engaged with a ground-facing surface of at least one of the first footwear component or the second footwear component.

Clause 39. The sole structure or the article of footwear according to Clause 38, wherein an opening is defined through the outsole component, and wherein a portion of a ground-facing surface of the second footwear component is exposed through the opening.

Clause 40. The sole structure or the article of footwear according to Clause 38, wherein a ground-facing surface of the outsole component includes a plurality of golf spikes or track spikes integrally formed or engaged with it.

Clause 41. The sole structure or the article of footwear according to Clause 38, wherein the outsole component is a first outsole component located forward of the second footwear component, and wherein the article of footwear further comprises: a second outsole component located rearward of the second footwear component and separated from the first outsole component by the second footwear component.

Clause 42. The sole structure or the article of footwear according to Clause 41, wherein ground-facing surfaces of each of the first outsole component and the second outsole component includes a plurality of golf spikes or track spikes integrally formed or engaged with it.

Clause 43. The sole structure or the article of footwear according to any preceding Clause, wherein a ground-facing surface of the second footwear component includes a plurality of golf spikes or track spikes integrally formed or engaged with it.

Clause 44. The article of footwear according to any one of Clauses 2 to 43, further comprising: a footwear upper engaged with an upper-facing surface of the first footwear component.

Clause 45. A sole structure for an article of footwear, comprising:

a first footwear component including a ground-facing surface, wherein a forefoot portion of the ground-facing surface includes: (a) an arched medial surface arching downward from a medial side edge of the sole structure toward a central region of the first footwear component, and (b) an arched lateral surface arching downward from a lateral side edge of the sole structure toward the central region of the first footwear component, wherein the first footwear component includes one of a first track or a first channel; and a second footwear component including an upper-facing surface, wherein a forefoot portion of the upper-facing surface includes: (a) an arched medial surface arching downward from a medial side edge of the second footwear component toward a central region of the second footwear component and facing the arched medial surface of the first footwear component, and (b) an arched lateral surface arching downward from a lateral side edge of the second footwear component toward the central region of the second footwear component and facing the arched lateral surface of the first footwear component, wherein the second footwear component includes the other of the first track or the first channel, wherein the first track is engaged with the first channel, and wherein the first footwear component is movably engaged with the second footwear component by movement of the first channel with respect to the first track.

Clause 46. An article of footwear, comprising:

a first footwear component including a ground-facing surface, wherein a forefoot portion of the ground-facing surface includes: (a) an arched medial surface arching downward from a medial side edge of the article of footwear toward a central region of the first footwear component, and (b) an arched lateral surface arching downward from a lateral side edge of the article of footwear toward the central region of the first footwear component, wherein the first footwear component includes one of a first track or a first channel; and a second footwear component including an upper-facing surface, wherein a forefoot portion of the upper-facing surface includes: (a) an arched medial surface arching downward from a medial side edge of the second footwear component toward a central region of the second footwear component and facing the arched medial surface of the first footwear component, and (b) an arched lateral surface arching downward from a lateral side edge of the second footwear component toward the central region of the second footwear component and facing the arched lateral surface of the first footwear component, wherein the second footwear component includes the other of the first track or the first channel, wherein the first track is engaged with the first channel, and wherein the first footwear component is movably engaged with the second footwear component by movement of the first channel with respect to the first track.

Clause 47. The sole structure or the article of footwear according to Clause 45 or 46, wherein: (a) the arched medial surface of the first footwear component includes an axial direction extending in a heel-to-toe direction of the article of footwear; (b) the arched medial surface of the second footwear component includes an axial direction extending in the heel-to-toe direction of the article of footwear; (c) the arched lateral surface of the first footwear component includes an axial direction extending in the heel-to-toe direction of the article of footwear; and/or (d) the arched lateral surface of the second footwear component includes an axial direction extending in the heel-to-toe direction of the article of footwear.

Clause 48. The sole structure or the article of footwear according to any one of Clauses 45 to 47, wherein the first footwear component is movably engaged with the second footwear component about a rotational axis extending in a heel-to-toe direction of the sole structure or the article of footwear.

Clause 49. The sole structure or the article of footwear according to any one of Clauses 45 to 47, wherein the first footwear component is movably engaged with the second footwear component such that: (a) the arched medial surface of the first footwear component slides with respect to and along the arched medial surface of the second footwear component and (b) the arched lateral surface of the first footwear component slides with respect to and along the arched lateral surface of the second footwear component.

Clause 50. The sole structure or the article of footwear according to any one of Clauses 45 to 49, wherein the first track is provided at the ground-facing surface of the first footwear component, and the first channel is provided at the upper-facing surface of the second footwear component.

Clause 51. The sole structure or the article of footwear according to Clause 50, wherein the first footwear component is movably engaged with the second footwear component further via: (a) a second track provided at the ground-facing surface of the first footwear component, and (b) a second channel provided at the upper-facing surface of the second footwear component, wherein the second track is engaged with the second channel.

Clause 52. The sole structure or the article of footwear according to Clause 51, wherein each of the first track and the second track is provided on the arched medial surface of the first footwear component and each of the first channel and the second channel is provided on the arched medial surface of the second footwear component.

Clause 53. The sole structure or the article of footwear according to Clause 51, wherein each of the first track and the second track is provided on the arched lateral surface of the first footwear component and each of the first channel and the second channel is provided on the arched lateral surface of the second footwear component.

Clause 54. The sole structure or the article of footwear according to Clause 51, wherein: (a) the first track is provided on the arched medial surface of the first footwear component, (b) the second track is provided on the arched lateral surface of the first footwear component, (c) the first channel is provided on the arched medial surface of the second footwear component, and (d) the second channel is provided on the arched lateral surface of the second footwear component.

Clause 55. The sole structure or the article of footwear according to any one of Clauses 50 to 54, wherein the first footwear component is movably engaged with the second footwear component further via: (a) a third track provided at the ground-facing surface of the first footwear component, and (b) a third channel provided at the upper-facing surface of the second footwear component, wherein the third track is engaged with the third channel.

Clause 56. The sole structure or the article of footwear according to Clause 55, wherein the third track is provided on the arched medial surface of the first footwear component and the third channel is provided on the arched medial surface of the second footwear component.

Clause 57. The sole structure or the article of footwear according to Clause 55, wherein the third track is provided on the arched lateral surface of the first footwear component and the third channel is provided on the arched lateral surface of the second footwear component.

Clause 58. The sole structure or the article of footwear according to any one of Clauses 50 to 55, wherein the first footwear component is movably engaged with the second footwear component further via: (a) a fourth track provided at the ground-facing surface of the first footwear component, and (b) a fourth channel provided at the upper-facing surface of the second footwear component, wherein the fourth track is engaged with the fourth channel.

Clause 59. The sole structure or the article of footwear according to Clause 58, wherein: (a) the third track is provided on the arched medial surface of the first footwear component, (b) the third channel is provided on the arched medial surface of the second footwear component, (c) the fourth track is provided on the arched lateral surface of the first footwear component, and (d) the fourth channel is provided on the arched lateral surface of the second footwear component.

Clause 60. The sole structure or the article of footwear according to any one of Clauses 45 to 49, wherein the first channel is provided at the ground-facing surface of the first footwear component, and the first track is provided at the upper-facing surface of the second footwear component.

Clause 61. The sole structure or the article of footwear according to Clause 60, wherein the first footwear component is movably engaged with the second footwear component via: (a) a second channel provided at the ground-facing surface of the first footwear component, and (b) a second track provided at the upper-facing surface of the second footwear component, wherein the second track is engaged with the second channel.

Clause 62. The sole structure or the article of footwear according to Clause 61, wherein each of the first channel and the second channel is provided at the central region of the first footwear component and each of the first track and the second track is provided at the central region of the second footwear component.

Clause 63. The sole structure or the article of footwear according to any of Clauses 61 or 62, further comprising: a first retaining element secured to the first footwear component to hold the first track in the first channel and to hold the second track in the second channel.

Clause 64. The sole structure or the article of footwear according to any of Clauses 61 or 62, further comprising: a first retaining element secured to the first footwear component to hold the first track in the first channel; and a second retaining element secured to the first footwear component to hold the second track in the second channel.

Clause 65. The sole structure or the article of footwear according to any one of Clauses 61 to 64, wherein the first footwear component is movably engaged with the second footwear component via: (a) a third channel provided at the ground-facing surface of the first footwear component, and (b) a third track provided at the upper-facing surface of the second footwear component, wherein the third track is engaged with the third channel.

Clause 66. The sole structure or the article of footwear according to Clause 65, wherein the third channel is provided at the central region of the first footwear component and the third track is provided at the central region of the second footwear component.

Clause 67. The sole structure or the article of footwear according to any one of Clauses 65 or 66, wherein the first footwear component is movably engaged with the second footwear component further includes: (a) a fourth channel provided at the ground-facing surface of the first footwear component, and (b) a fourth track provided at the upper-facing surface of the second footwear component, wherein the fourth track is engaged with the fourth channel.

Clause 68. The sole structure or the article of footwear according to Clause 67, wherein the fourth channel is provided at the central region of the first footwear component and the fourth track is provided at the central region of the second footwear component.

Clause 69. The sole structure or the article of footwear according to Clause 67 or 68, further comprising: (a) a first retaining element secured to the first footwear component to hold the first track in the first channel and to hold the second track in the second channel; and (b) a second retaining element secured to the first footwear component to hold the third track in the third channel and to hold the fourth track in the fourth channel.

Clause 70. The sole structure or the article of footwear according to any one of Clauses 45 to 49, wherein the first track and the first channel form a tongue and groove joint joining a forward end of the first footwear component with a forward end of the second footwear component.

Clause 71. The sole structure or the article of footwear according to any one of Clauses 45 to 49, wherein the first track and the first channel form a tongue and groove joint joining a rearward end of the first footwear component with a rearward end of the second footwear component.

Clause 72. The sole structure or the article of footwear according to any one of Clauses 45 to 49, wherein the first track and the first channel form a first tongue and groove joint joining a rearward end of the first footwear component with a rearward end of the second footwear component, and wherein the sole structure or the article of footwear further includes a second tongue and groove joint joining a forward end of the first footwear component with a forward end of the second footwear component.

Clause 73. The sole structure or the article of footwear according to Clause 71 or 72, wherein the tongue and groove joint joining the rearward end of the first footwear component with the rearward end of the second footwear component is located at a medial side of the first footwear component and at a medial side of the second footwear component.

Clause 74. The sole structure or the article of footwear according to any one of Clauses 70 to 72, wherein the tongue and groove joint joining the forward end of the first footwear component with the forward end of the second footwear component is located at a medial side of the first footwear component and at a medial side of the second footwear component.

Clause 75. The sole structure or the article of footwear according to any one of Clauses 45 to 49, wherein the first track is located at a forward end of the first footwear component and the first channel is located at a forward end of the second footwear component.

Clause 76. The sole structure or the article of footwear according to any one of Clauses 45 to 49, wherein the first track is located at a rearward end of the first footwear component and the first channel is located at a rearward end of the second footwear component.

Clause 77. The sole structure or the article of footwear according to any one of Clauses 75 or 76, wherein each of the first track and the first channel is located at a lateral side of the article of footwear.

Clause 78. The sole structure or the article of footwear according to any one of Clauses 45 to 77, further comprising: a midsole component including a ground-facing surface having a recess defined therein, wherein the first footwear component is a separate part fixedly engaged with the ground-facing surface of the midsole component in the recess.

Clause 79. The sole structure or the article of footwear according to any one of Clauses 45 to 78, wherein the second footwear component does not extend to a heel region of the article of footwear.

Clause 80. The sole structure or the article of footwear according to any one of Clauses 45 to 79, wherein the first footwear component extends continuously from a heel region to a forefoot region of the article of footwear and is configured to support an entire plantar surface of a wearer's foot.

Clause 81. The sole structure or the article of footwear according to any one of Clauses 45 to 79, wherein the first footwear component does not extend to a heel region of the article of footwear.

Clause 82. The sole structure or the article of footwear according to any one of Clauses 45 to 81, wherein a ground-facing surface of the first footwear component includes a plurality of golf spikes or track spikes integrally formed or engaged with it.

Clause 83. The sole structure or the article of footwear according to any one of Clauses 45 to 82, further comprising: an outsole component engaged with a ground-facing surface of at least one of the first footwear component or the second footwear component.

Clause 84. The sole structure or the article of footwear according to Clause 83, wherein an opening is defined through the outsole component, and wherein a portion of a ground-facing surface of the second footwear component is exposed through the opening.

Clause 85. The sole structure or the article of footwear according to Clause 83, wherein a ground-facing surface of the outsole component includes a plurality of golf spikes or track spikes integrally formed or engaged with it.

Clause 86. The sole structure or the article of footwear according to Clause 83, wherein the outsole component is a first outsole component located forward of the second footwear component, and wherein the article of footwear further comprises: a second outsole component located rearward of the second footwear component and separated from the first outsole component by the second footwear component.

Clause 87. The sole structure or the article of footwear according to Clause 86, wherein ground-facing surfaces of each of the first outsole component and the second outsole component includes a plurality of golf spikes or track spikes integrally formed or engaged with it.

Clause 88. The sole structure or the article of footwear according to any one of Clauses 45 to 87, wherein a ground-facing surface of the second footwear component includes a plurality of golf spikes or track spikes integrally formed or engaged with it.

Clause 89. The article of footwear according to any one of Clauses 46 to 88, further comprising: a footwear upper engaged with an upper-facing surface of the first footwear component.

What is claimed is:

1. A sole structure for an article of footwear, comprising:

a first footwear component including a ground-facing surface, wherein a forefoot portion of the ground-facing surface includes: (a) an arched medial surface arching downward from a medial side edge of the sole structure toward a central region of the first footwear component, and (b) an arched lateral surface arching downward from a lateral side edge of the sole structure toward the central region of the first footwear component, wherein the first footwear component includes one of a first track or a first channel; and a second footwear component including an upper-facing surface, wherein a forefoot portion of the upper-facing surface includes: (a) an arched medial surface arching downward from a medial side edge of the second footwear component toward a central region of the second footwear component and facing the arched medial surface of the first footwear component, and (b) an arched lateral surface arching downward from a lateral side edge of the second footwear component toward the central region of the second footwear component and facing the arched lateral surface of the first footwear component, wherein the second footwear component includes the other of the first track or the first channel, and wherein the first track is slidably engaged with the first channel to slide, tilt, and/or rotate the first footwear component with respect to the second footwear component.

2. The sole structure according to claim 1, further comprising: a midsole component including a ground-facing surface having a recess defined therein, wherein the first footwear component is a separate part fixedly engaged with the ground-facing surface of the midsole component in the recess.

3. The sole structure according to claim 1, wherein a plurality of golf spikes or track spikes are integrally formed or engaged with the ground-facing surface of the first footwear component.

4. The sole structure according to claim 1, further comprising: an outsole component engaged with at least one of the ground-facing surface of the first footwear component or a ground-facing surface of the second footwear component.

5. The sole structure according to claim 4, wherein an opening is defined through the outsole component, and wherein a portion of the ground-facing surface of the second footwear component is exposed through the opening.

6. The sole structure according to claim 4, wherein the outsole component is a first outsole component located forward of the second footwear component, and wherein the sole structure further comprises: a second outsole component located rearward of the second footwear component and separated from the first outsole component by the second footwear component.

7. The sole structure according to claim 6, wherein a plurality of golf spikes or track spikes are integrally formed or engaged with the ground-facing surface of the first outsole component, and wherein a plurality of golf spikes or track spikes are integrally formed or engaged with a ground-facing surface of the second outsold component.

8. The sole structure according to claim 1, wherein a plurality of golf spikes or track spikes are integrally formed or engaged with a ground-facing surface of the second footwear component.

9. The sole structure according to claim 1, further comprising: an outsole component engaged with the ground-facing surface of the first footwear component and with a ground-facing surface of the second footwear component.

10. The sole structure according to claim 9, wherein an opening is defined through the outsole component, and wherein a portion of the ground-facing surface of the second footwear component is exposed through the opening.

11. The sole structure according to claim 10, wherein the opening defined through the outsole component changes shape when the first footwear component slides, tilts, and/or rotates with respect to the second footwear component.

12. The sole structure according to claim 10, wherein the opening includes a forward open region, a rearward open region, and a continuous channel connecting the forward open region and the rearward open region.

13. The sole structure according to claim 12, wherein a lateral edge of the forward open region and a lateral edge of the rearward open region are located closer to a lateral side edge of the sole structure than is the continuous channel.

14. An article of footwear, comprising:

an upper; and a sole structure engaged with the upper, the sole structure including:

(i) a first footwear component including a ground-facing surface, wherein a forefoot portion of the ground-facing surface includes: (a) an arched medial surface arching downward from a medial side edge of the article of footwear toward a central region of the first footwear component, and (b) an arched lateral surface arching downward from a lateral side edge of the article of footwear toward the central region of the first footwear component, wherein the first footwear component includes one of a first track or a first channel; and (ii) a second footwear component including an upper-facing surface, wherein a forefoot portion of the upper-facing surface includes: (a) an arched medial surface arching downward from a medial side edge of the second footwear component toward a central region of the second footwear component and facing the arched medial surface of the first footwear component, and (b) an arched lateral surface arching downward from a lateral side edge of the second footwear component toward the central region of the second footwear component and facing the arched lateral surface of the first footwear component, wherein the second footwear component includes the other of the first track or the first channel, and wherein the first track is slidably engaged with the first channel to slide, tilt, and/or rotate the first footwear component with respect to the second footwear component.

15. The article of footwear according to claim 14, further comprising: a midsole component including a ground-facing surface having a recess defined therein, wherein the first footwear component is a separate part fixedly engaged with the ground-facing surface of the midsole component in the recess.

16. The article of footwear according to claim 14, further comprising: an outsole component engaged with at least one of the ground-facing surface of the first footwear component or a ground-facing surface of the second footwear component.

17. The article of footwear according to claim 16, wherein the outsole component is a first outsole component located forward of the second footwear component, and wherein the article of footwear further comprises: a second outsole component located rearward of the second footwear component and separated from the first outsole component by the second footwear component.

18. The article of footwear according to claim 14, further comprising: an outsole component engaged with the ground-facing surface of the first footwear component and with a ground-facing surface of the second footwear component.

19. The article of footwear according to claim 18, wherein an opening is defined through the outsole component, wherein a portion of the ground-facing surface of the second footwear component is exposed through the opening, and wherein the opening defined through the outsole component changes shape when the first footwear component slides, tilts, and/or rotates with respect to the second footwear component.

20. The article of footwear according to claim 19, wherein the opening includes a forward open region, a rearward open region, and a continuous channel connecting the forward open region and the rearward open region, and wherein a lateral edge of the forward open region and a lateral edge of the rearward open region are located closer to a lateral side edge of the sole structure than is the continuous channel.

* * * * *